US007859366B2

(12) United States Patent
Guan

(10) Patent No.: US 7,859,366 B2
(45) **Date of Patent: *Dec. 28, 2010**

(54) REFLECTION-TYPE BANDPASS FILTER

(75) Inventor: Ning Guan, Sakura (JP)

(73) Assignee: Fujikura Ltd., Tokyo (JP)

( * ) Notice: Subject to any disclaimer, the term of this patent is extended or adjusted under 35 U.S.C. 154(b) by 236 days.

This patent is subject to a terminal disclaimer.

(21) Appl. No.: 11/867,550

(22) Filed: Oct. 4, 2007

(65) Prior Publication Data

US 2008/0084257 A1 Apr. 10, 2008

(30) Foreign Application Priority Data

Oct. 5, 2006 (JP) ..... 2006-274327

(51) Int. Cl.
*H01P 1/203* (2006.01)

(52) U.S. Cl. ..... 333/204

(58) Field of Classification Search ..... 333/202, 333/204, 166–168, 175, 176, 185, 238
See application file for complete search history.

(56) References Cited

U.S. PATENT DOCUMENTS

| | | | | |
|---|---|---|---|---|
| 2,411,555 | A | 11/1946 | Rogers | |
| 3,617,877 | A | 11/1971 | Hobson | |
| 4,371,853 | A | 2/1983 | Makimoto et al. | |
| 4,992,760 | A * | 2/1991 | Takeda et al. | 333/219.2 |
| 5,418,507 | A * | 5/1995 | Keane et al. | 333/202 |
| 5,525,953 | A | 6/1996 | Okada et al. | |
| 5,923,295 | A | 7/1999 | Nakano et al. | |
| 6,323,740 | B1 | 11/2001 | Ishikawa et al. | |
| 6,353,371 | B1 | 3/2002 | Kadota et al. | |
| 6,563,403 | B2 | 5/2003 | Kanba et al. | |
| 6,577,211 | B1 * | 6/2003 | Tsujiguchi | 333/204 |
| 6,603,376 | B1 * | 8/2003 | Handforth et al. | 333/238 |
| 6,686,808 | B1 | 2/2004 | Sugawara et al. | |
| 6,924,714 | B2 * | 8/2005 | Jain | 333/123 |

(Continued)

FOREIGN PATENT DOCUMENTS

| | | |
|---|---|---|
| CH | 663690 | 12/1987 |

(Continued)

OTHER PUBLICATIONS

Sun S et al: "Guided-Wave Characteristics of Periodically Nonuniform Coupled Microstrip Lines-Even and Odd Modes" IEEE Transaction on Microwave Theory and Techniques, IEEE Servicve Center. Piscataway, NJ, US, vol. 53, No. 4 Apr. 2005, pp. 1221-1227.

(Continued)

*Primary Examiner*—Benny Lee
*Assistant Examiner*—Gerald Stevens
(74) *Attorney, Agent, or Firm*—Sughrue Mion, PLLC

(57) ABSTRACT

Provided is a reflection-type bandpass filter for ultra-wide-band wireless data communication, including a substrate. The substrate includes a dielectric layer and a ground layer deposited on one surface of the dielectric layer, a center conductor provided on a surface of the dielectric layer opposite the ground layer, and a side conductor provided on the surface of the dielectric layer opposite the ground layer. There is a prescribed distance between conductors with a non-conducting portion intervening therebetween. A center conductor width or a distance between conductors, or both, are distributed non-uniformly along a length direction of the center conductor.

17 Claims, 19 Drawing Sheets

U.S. PATENT DOCUMENTS

| | | | | |
|---|---|---|---|---|
| 2005/0140472 | A1 | 6/2005 | Ko et al. | |
| 2006/0061438 | A1 | 3/2006 | Toncich | |
| 2006/0255886 | A1 * | 11/2006 | Ninomiya et al. | 333/204 |
| 2007/0159276 | A1 | 7/2007 | Han et al. | |
| 2007/0210880 | A1 | 9/2007 | Bobier et al. | |

FOREIGN PATENT DOCUMENTS

| | | | |
|---|---|---|---|
| CN | 1097082 | A | 1/1995 |
| JP | 56-64501 | A | 6/1981 |
| JP | 9-172318 | A | 6/1997 |
| JP | 9-232820 | A | 9/1997 |
| JP | 10-65402 | A | 3/1998 |
| JP | 10-242746 | A | 9/1998 |
| JP | 2000-4108 | A | 1/2000 |
| JP | 2000-101301 | A | 4/2000 |
| JP | 2002-43810 | A | 2/2002 |
| SU | 1 728 904 | A1 | 4/1992 |

OTHER PUBLICATIONS

Le Roy M et al: "Novel Circuit Models of Arbitrary-Shape Line: Application to Parallel Coupled Microstrip Filters with Suppression of Multi-Harmonic Responses" 2005 European Microwave Conference CNIT LA Defence, Paris, France Oct. 4-6, 2005, Piscataway, NJ, USA, IEEE, Oct. 4, 2005, pp. 921-924.

Tun-Ruey Cheng et al: "Inverse Scattering of Nonuniform, Symmetrical Coupled Lines" IEEE Inc Microwave and Guided Wave Letters, IEEE Inc, New York, US, vol. 8, No. 7, (Jul. 1998).

Kaixue Ma et al: "Experimentally investigating slow-wave transmission lines and filters based on conductor-backed CPW periodic cells" Microwave Symposium Digest, 2005 IEEE MTT-S International Long Beach, CA, USA Jun. 12-17, 2005, Piscataway, NJ, USA IEEE, Jun. 12, 2005, pp. 1653-1656.

K.W. Tan and S. Uysal, "Analysis and design of conductor-backed asymmetric coplanar wave-guide lines using conformal mapping techniques and their application to end-coupled filters," IEICE Trans. Electron., vol. E82-C, No. 7, pp. 1098-1103,1999.

A.V. Oppenheim and R. W. Schafer, "Discrete-time signal processing," pp. 465-478, Prenticehall, 1998.

G-B. Xiao, K. Yashiro, N, Guan, and S. Ohokawa, "An effective method for designing nonuniformly coupled transmission-line filters," IEEE Trans Microwave Theory tech., vol. 49, pp. 1027-1031, Jun. 2001.

Y. Konishi, "Microwave Integrated Circuits", 1991, pp. 9-11, Marcel Dekker.

Mirshekar-Syahkal et al., "Accurate Analysis of Tapered Planar Transmission Lines for Microwave Integrated Circuits", IEEE Transactions on Microwave Theory and Techniques, Feb. 1981, pp. 123-128, vol. 29, No. 2, IEEE.

Wang et al., "Ultra-Wideband Bandpass Filter with Hybrid Microstrip/CPW Structure", IEEE Microwave and Wireless Components Letters, Dec. 2005, pp. 844-846, vol. 15, No. 12, IEEE.

Chen et al., "Design of a UWB low insertion loss bandpass filter with spurious response suppression," Microwave Journal, Feb. 2006, pp. 112-116.

Xiao, et al., "A New Numerical Method for Synthesis of Arbitrarily Terminated Lossless Nonuniform Transmission Lines", IEEE Transactions on Microwave Theory and Techniques, Feb. 2001, pp. 369-376, vol. 49, No. 2, IEEE Service Center, Piscataway, NJ, US, XP011038268.

Xiao, et al., "Impedance Matching for Complex Loads Through Nonuniform Transmission Lines", IEEE Transactions on Microwave Theory and Techniques, Jun. 2002, pp. 1520-1525, vol. 50, No. 6, IEEE Service Center, Piscataway, NJ, US, XP011076613.

Chang, et al., "Wide-Band Equal-Ripple Filters in Nonuniform Transmission Lines", IEEE Transactions on Microwave Theory and Techniques, Apr. 2002, pp. 1114-1119, vol. 50, No. 4, IEEE Service Center, Piscataway, NJ, US, XP011076539.

Moreira, et al., "Direct Synthesis of Microwave Filters Using Inverse Scattering Transmission-Line Matrix Method", IEEE Transactions on Microwave Theory and Techniques, Dec. 2000, pp. 2271-2276, vol. 48, No. 12, IEEE Service Center, Piscataway, NJ, US, XP011038181.

Le Roy et al., "A New Design of Microwave Filters by Using Continuously Varying Transmission Lines", Microwave Symposium Digest 1997, IEEE MTT-S International Denver, CO, USA Jun. 8-13, 1997, pp. 639-642, vol. 2, IEEE, New York, NY, US, XP010228412.

Le Roy et al., "The Continuously Varying Transmission-Line Technique-Application to Filter Design", IEEE Transactions on Microwave Theory and Techniques, Sep. 1999, pp. 1680-1687, vol. 47, No. 9, IEEE, XP 11037721.

Pan et al., "Arbitrary Filter Design by Using Nonuniform Transmission Lines", IEEE Microwave and Guided Wave Letters, Feb. 1999, pp. 60-62, vol. 9, No. 2, IEEE, XP 011035415.

Konishi, "Microwave integrated circuits", 1991, pp. 19-21, Marcel Dekker.

Yang et al., "Design of Dual Passband Filter Based on Zakharov-Shabat Inverse Scattering Problem", APMC2005 Proceedings, Dec. 4-7, 2005, pp. 1-3, IEEE, XP 10901861.

Huang, "Quasi-Transversal Synthesis of Microwave Chirped Filters", Electronics Letters, May 21, 1992, pp. 1062-1064, vol. 28, No. 11, IEE Stevenage, GB, XP000305900.

Deng et al., "Multiple-Mode Resonance Bands in Periodically Nonuniform Conductor-Backed Coplanar Waveguides", Microwave Conference, 1999 Asia Pacific Singapore Nov. 30-Dec. 3, 1999, pp. 5-8, vol. 1, IEEE, Piscataway, NJ, USA, XP010374097.

Xiao et al, "An Efficient Algorithm for Solving Zakharov-Shabat Inverse Scattering Problem", IEEE Transactions on Antennas and Propagation, Jun. 2002, pp. 807-811, vol. 50, No. 6, IEEE.

Young et al., "Accurate non-uniform transmission line model and its application to the de-embedding of on-wafer measurements" IEE Proceedings H. Microwaves, Antennas & Propagation, Institution of Electrical Engineers. Stevenage , GB, vol. 148, No. 3, Jun. 11, 2001 , pp. 153-156, XP006016881.

Boulejfen et al., "A robust and efficient method for the frequency domain analysis of non-uniform, lossy multi-line transmission structures" Microwave Symposium Digest, 1998 IEEE MTT-S International Baltimore, MD, USA Jun. 7-12, 1998, pp. 1763-1766, XP010290106.

Japanese Office Action issued in related Japanese Patent Application No. 2006-274327 with English translation mailed Jun. 22, 2010.

Japanese Office Action issued in related Japanese Patent Application No. 2006-274326 with English language translation mailed Jun. 22, 2010.

Japanese Office Action issued in related Japanese Patent Application No. 2006-274324 with English language translation mailed Jun. 22, 2010.

Y. Qian and E. Yamashita, "Additional Approximate formulas and Experimental Data on Micro-Coplanar Striplines," IEEE Transaction on Microwave Theory and Techniques, IEEE, Apr. 1990, vol. 38, No. 4, pp. 443-445.

J. Svacine, "Special Types of Coplanar Transmission Lines Suitable Up to mm-Wave Bands, "6th Topical Meeting on Electrical Performance of Electronic Packaging, IEEE, Oct. 1997, pp. 99-102.

P. Ghanipour et al., "Suppression Mode Coupling in Conductor-Backer Asymmetric Coplanar Strips Using Slow-Wave Electrodes", IEEE Microwave and Wireless Components Letters, May 2006, vol. 16, No. 5, 272-274.

L. Vegni et al., "Tapered Stripline Embedded in Inhomogeneous Media as Microwave Matching Line", IEEE Transaction on Microwave Theory and Techniques, IEEE, May 2001, vol. 49, No. 5, pp. 970-978.

* cited by examiner

REFLECTION-TYPE BANDPASS FILTER

BACKGROUND OF THE INVENTION

This application claims priority from Japanese Patent Application No. 2006-274327, filed on Oct. 5, 2006, the entire contents of which are incorporated herein by reference.

1. Field of the Invention

Apparatuses consistent with this invention relate to a reflection-type bandpass filter for use in ultra-wideband (UWB) wireless data communication.

2. Description of the Related Art

As technology of the related art, for example, the technology disclosed in the following references 1 through 12 is known.

Reference 1: Specification of U.S. Pat. No. 2,411,555

Reference 2: Japanese Unexamined Patent Application No. 56-64501

Reference 3: Japanese Unexamined Patent Application No. 9-172318

Reference 4: Japanese Unexamined Patent Application No. 9-232820

Reference 5: Japanese Unexamined Patent Application No. 10-65402

Reference 6: Japanese Unexamined Patent Application No. 10-242746

Reference 7: Japanese Unexamined Patent Application No. 2000-4108

Reference 8: Japanese Unexamined Patent Application No. 2000-101301

Reference 9: Japanese Unexamined Patent Application No. 2002-43810

Reference 10: K. W. Tan and S. Uysal, "Analysis and design of conductor-backed asymmetric coplanar waveguide lines using conformal mapping techniques and their application to end-coupled filters," IEICE Trans. Electron., vol. E82-C, no. 7, pp. 1098-1103, 1999.

Reference 11: A. V. Oppenheim and R. W. Schafer, "Discrete-time signal processing," pp. 465-478, Prentice Hall, 1998.

Reference 12: G-B. Xiao, K. Yashiro, N. Guan, and S. Ohokawa, "An effective method for designing nonuniformly coupled transmission-line filters," IEEE Trans. Microwave Theory Tech., vol. 49, pp. 1027-1031, June 2001.

However, some bandpass filters proposed in the related art do not satisfy the FCC specifications, due to manufacturing tolerances or other reasons.

Further, in a bandpass filter of the related art, surface waves arising from undesirable slot line modes are excited when the ground potentials on the two sides are different, and so the need arises to provide an air bridge between the grounds on the two sides, and the device becomes susceptible to external influences (see Reference 10).

Exemplary embodiments of this invention were devised in light of the above circumstances, and have, as an exemplary object, the provision of a high-performance UWB reflection-type bandpass filter which is not susceptible to external influences, and which satisfies FCC specifications.

SUMMARY OF THE INVENTION

By using a UWB reflection-type bandpass filter consistent with exemplary embodiments of this invention, U.S. Federal Communications Commission requirements for spectrum masks can be satisfied.

This invention provides a reflection-type bandpass filter for ultra-wideband wireless data communication, comprising a substrate. The substrate comprises a dielectric layer and a ground layer deposited on one surface of the dielectric layer. A center conductor and a side conductor are provided on a surface of the dielectric layer opposite the ground layer, and there is a prescribed distance between conductors with a non-conducting portion intervening therebetween. A center conductor width or a distance between conductors, or both, are distributed non-uniformly along a length direction of the center conductor.

According to one exemplary embodiment, a distance between conductors is constant, and that the center conductor width is distributed non-uniformly.

According to another exemplary embodiment, the center conductor width is constant, and the distance between conductors is distributed non-uniformly.

According to another exemplary embodiment, the center conductor width is distributed symmetrically with respect to the center line of the center conductor.

According to another exemplary embodiment, the width of the non-conducting portion is distributed symmetrically with respect to the center line of the non-conducting portion.

According to another exemplary embodiment, one or both of the opposing side edges of the two conductors are made a straight line.

According to another exemplary embodiment, there is a difference of 10 dB or higher between the reflectance in the ranges of frequencies f for which $f<3.1$ GHz and $f>10.6$ GHz, and the reflectance in the range of frequencies 3.7 GHz$\leqq f \leqq$10.0 GHz, and in the range 3.7 GHz$\leqq f \leqq$10.0 GHz the group delay variation is within ±0.05 ns.

According to another exemplary embodiment, there is a difference of 10 dB or higher between the reflectance in the ranges of frequencies f for which $f<3.1$ GHz and $f>10.6$ GHz, and the reflectance in the range of frequencies 3.9 GHz$\leqq f \leqq$9.8 GHz, and in the range 3.9 GHz$\leqq f \leqq$9.8 GHz the group delay variation is within ±0.07 ns.

According to another exemplary embodiment, there is a difference of 10 dB or higher between the reflectance in the ranges of frequencies f for which $f<3.1$ GHz and $f>10.6$ GHz, and the reflectance in the range of frequencies 4.5 GHz$\leqq f \leqq$9.4 GHz, and in the range 4.5 GHz$\leqq f \leqq$9.4 GHz the group delay variation is within ±0.07 ns.

According to another exemplary embodiment, there is a difference of 10 dB or higher between the reflectance in the ranges of frequencies f for which $f<3.1$ GHz and $f>10.6$ GHz, and the reflectance in the range of frequencies 3.7 GHz$\leqq f \leqq$10.0 GHz, and in the range 3.7 GHz$\leqq f \leqq$10.0 GHz the group delay variation is within ±0.1 ns.

According to another exemplary embodiment, there is a difference of 10 dB or higher between the reflectance in the ranges of frequencies f for which $f<3.1$ GHz and $f>10.6$ GHz, and the reflectance in the range of frequencies 4.4 GHz$\leqq f \leqq$9.2 GHz, and in the range 4.4 GHz$\leqq f \leqq$9.2 GHz the group delay variation is within ±0.05 ns.

According to another exemplary embodiment, the characteristic impedance Zc of the input terminal transmission line is in the range $10\Omega \leqq Zc \leqq 300\Omega$.

According to another exemplary embodiment, a resistance having the same impedance as the above characteristic impedance value, or a non-reflecting terminator, is provided on the terminating side.

According to another exemplary embodiment, the center conductor and the side conductor comprise metal plates of thickness equal to or greater than the skin depth at f=1 GHz.

According to another exemplary embodiment, the dielectric layer is of thickness h in the range 0.1 mm$\leqq h \leqq$10 mm, that the relative permittivity $\in_r$ be is the range $1 \leqq \in_r \leqq 100$, that the width W is in the range 2 mm≦W≦100 mm, and the length L be is the range 2 mm≦L≦500 mm.

According to another exemplary embodiment, the length-direction distributions of the center conductor width and of the distance between conductors are set using a design method based on the inverse problem of deriving the potential from spectral data in the Zakharov-Shabat equation.

According to another exemplary embodiment, a window function method is used to set the length-direction distributions of the center conductor width and of the distance between conductors.

According to another exemplary embodiment, a Kaiser window function method is used to set the length-direction distributions of the center conductor width and of the distance between conductors.

By means of a reflection-type bandpass filter of exemplary embodiments of this invention, by applying a window function method to design a reflection-type bandpass filter comprising a non-uniform microstrip line, an extremely wide pass band and extremely small variation of the group delay within the pass band compared with filters of the prior art can be achieved, even when manufacturing tolerances are large. As a result, a UWB bandpass filter which satisfies FCC specifications can be provided.

Further, by means of a reflection-type bandpass filter of exemplary embodiments of this invention, even when the ground potentials on the two sides are different, surface wave excitation due to slot line modes is minimal, so that there is no need to provide an air bridge, and stable filter characteristics which are not easily affected by external influences can be obtained.

DESCRIPTION OF EXEMPLARY EMBODIMENTS OF THE INVENTION

Figure 1:
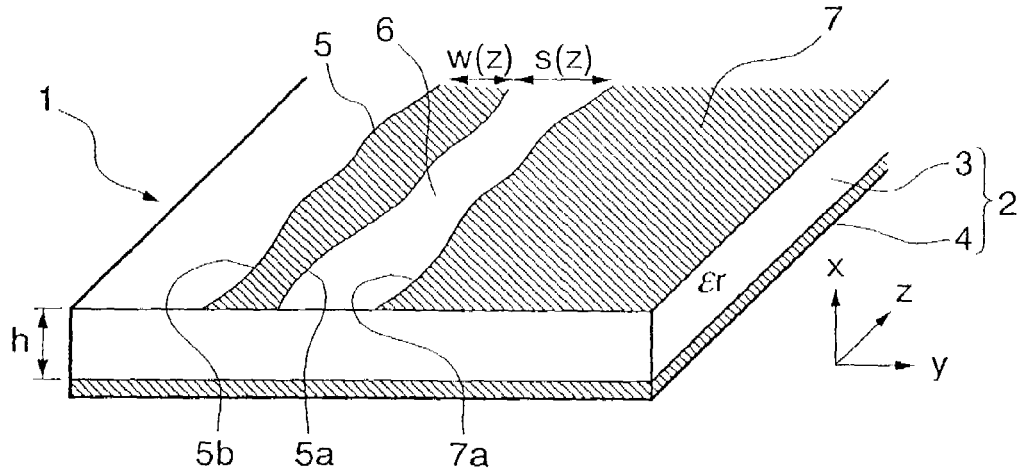
FIG. 1 is a perspective view showing an aspect of a reflection-type bandpass filter of an exemplary embodiment of this invention.

FIG. 1 is a perspective view showing in summary the configuration of a reflection-type bandpass filter of an exemplary embodiment of this invention. In the figure, the symbol 1 denotes the reflection-type bandpass filter, 2 is a substrate, 3 is a dielectric layer, 4 is a ground layer, 5 is a center conductor, 6 is a non-conducting portion, and 7 is a side conductor.

The reflection-type bandpass filter 1 of this aspect comprises a substrate 2 having a dielectric layer 3 and a ground layer 4 deposited on one surface thereof, a center conductor 5 provided on the surface of the substrate 2 on the side of the dielectric layer 3, and a side conductor 7 provided on one side of the center conductor 5 securing a prescribed distance between conductors with a non-conducting portion 6 intervening; the filter has a non-uniform micro-coplanar strip line, with the center conductor width or the distance between conductors, or both, distributed non-uniformly along the center conductor length direction.

As shown in FIG. 1, the z axis is taken along the length direction of the center conductor 5, the y axis is taken in the direction perpendicular to the z axis and parallel to the surface of the conductor 2, and the x axis is taken perpendicular to the y axis and z axis. The length extending in the z-axis direction from the end face on the input side is z. The side edge of the center conductor 5 on the side in the z-axis direction of the non-conducting portion 6 is 5*a*, and the side edge on the other side is 5*b*. The side edge of the side conductor 7 in the z-axis direction on the side of the non-conducting portion 6 is 7*a*.

A reflection-type bandpass filter of exemplary embodiments of this invention adopts a configuration in which stop band rejection (the difference between the reflectance in the pass band, and the reflectance in the stop band) may be increased, by using a window function method (see Reference 11 with respect to a window function) employed in digital filter design. By this means, instead of expansion of the transition frequency region (the region between the pass band boundary and the stop band boundary), the stop band rejection can be increased. As a result, manufacturing tolerances can be increased. Also, variation in the group delay within the pass band may be decreased.

Figure 37:
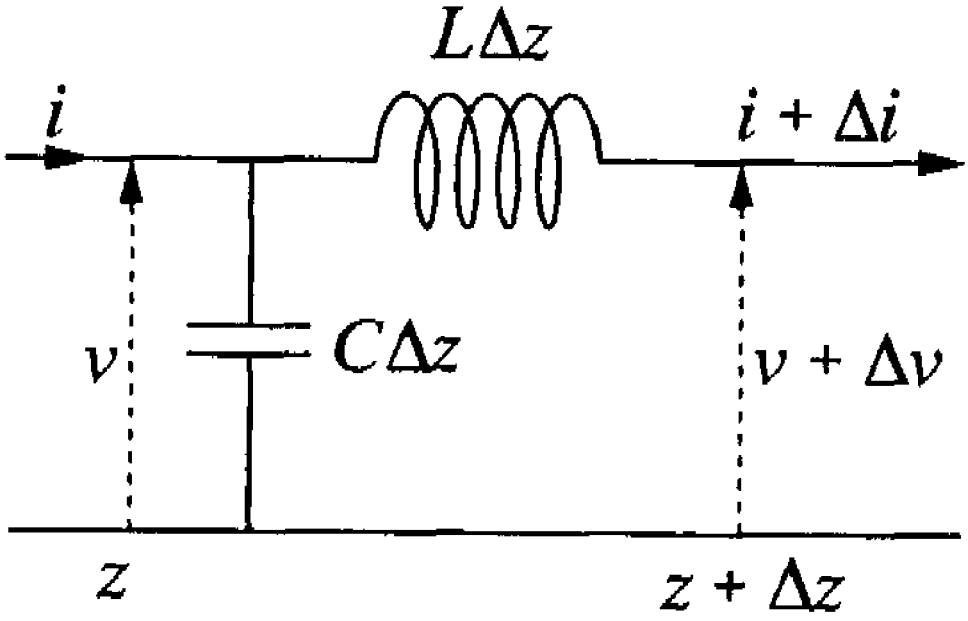

The transmission line of a reflection-type bandpass filter 1 of exemplary embodiments of this invention can be represented by a non-uniformly distributed constant circuit such as in FIG. 37.

From FIG. 37, the following equation (1) can be obtained for the line voltage v(z,t) and the line current i(z,t).

$$\begin{cases} -\dfrac{\partial v(z,t)}{\partial z} = L(z)\dfrac{\partial i(z,t)}{\partial t}, \\ -\dfrac{\partial i(z,t)}{\partial z} = C(z)\dfrac{\partial v(z,t)}{\partial t}. \end{cases} \quad \text{(equation 1)}$$

Here L(z) and C(z) are the inductance and capacitance respectively per unit length in the transmission line. Here, the function of equation (2) is introduced.

$$\begin{cases} \dfrac{\partial \phi_1(z,t)}{\partial z} = -\dfrac{1}{c(z)}\dfrac{\partial \phi_1(z,t)}{\partial t} - \dfrac{1}{2}\dfrac{d\ln Z(z)}{dz}\phi_2(z,t), \\ \dfrac{\partial \phi_2(z,t)}{\partial z} = \dfrac{1}{c(z)}\dfrac{\partial \phi_2(z,t)}{\partial t} - \dfrac{1}{2}\dfrac{d\ln Z(z)}{dz}\phi_1(z,t). \end{cases} \quad \text{(equation 2)}$$

Here $Z(z)=\sqrt{\{L(z)/C(z)\}}$ is the local characteristic impedance, and $\phi_1$, $\phi_2$ are the power wave amplitudes propagating in the +z and −z directions respectively.

Substitution into equation (1) yields equation (3).

$$\begin{cases} \dfrac{\partial \phi_1(z,t)}{\partial z} = -\dfrac{1}{c(z)}\dfrac{\partial \phi_1(z,t)}{\partial t} - \dfrac{1}{2}\dfrac{d\ln Z(z)}{dz}\phi_2(z,t), \\ \dfrac{\partial \phi_2(z,t)}{\partial z} = \dfrac{1}{c(z)}\dfrac{\partial \phi_2(z,t)}{\partial t} - \dfrac{1}{2}\dfrac{d\ln Z(z)}{dz}\phi_1(z,t). \end{cases} \quad \text{(equation 3)}$$

Here $c(z)=1/\sqrt{\{L(z)/C(z)\}}$. If the time factor is set to exp ($j\omega t$), and a variable transformation is performed as in equation (4) below, then the Zakharov-Shabat equation of equation (5) is obtained.

$$x(z) = \int_0^z \frac{ds}{c(s)} \quad \text{(equation 4)}$$

$$\begin{cases} \dfrac{\partial \phi_1(x)}{\partial x} + j\omega\phi_1(x) = -q(x)\phi_2(x), \\ \dfrac{\partial \phi_2(x)}{\partial x} - j\omega\phi_2(x) = -q(x)\phi_1(x). \end{cases} \quad \text{(equation 5)}$$

Here q(x) is as given by equation (6) below.

$$q(x) = \frac{1}{2}\frac{d\ln Z(x)}{dx}. \quad \text{(equation 6)}$$

The Zakharov-Shabat inverse problem involves synthesizing the potential q(x) from spectral data which is a solution satisfying the above equations (see Reference 12 with respect to the Zakharov-Shabat inverse problem). If the potential q(x) is found, the local characteristic impedance Z(x) is determined as in equation (7) below.

$$Z(x) = Z(0)\ \exp\left[2\int_0^x q(s)\,ds\right]. \quad \text{(equation 7)}$$

Here, normally in a process to determine the potential q(x), the reflectance coefficient r(x) in x space is calculated from the spectra data reflectance coefficient R(ω) using the following equation (8), and q(x) are obtained from r(x).

$$r(x) = \frac{1}{2\pi}\int_{-\infty}^{\infty} R(\omega)e^{-j\omega x}\,d\omega \qquad \text{(equation 8)}$$

In this invention, in place of obtaining r(x) from the R(ω) for ideal spectral data, a window function is applied as in equation (9) to determine r'(x).

$$r'(x)=w(x)r(x). \qquad \text{(equation 9)}$$

Here ω(x) is the window function. If the window function is selected appropriately, the stop band rejection level can be appropriately controlled. Here, a Kaiser window is used as an example. The Kaiser window is defined as in equation (10) below.

$$\omega[n] = \begin{cases} \dfrac{I_0\left[\beta(1-[(n-\alpha)/\alpha]^2)^{1/2}\right]}{I_0(\beta)}, & 0 \le n \le M, \\ 0, & \text{otherwise} \end{cases} \qquad \text{(equation 10)}$$

Here α=M/s, and β is determined empirically as in equation (11) below.

$$\beta = \begin{cases} 0.1102(A-8.7), & A > 50, \\ 0.5842(A-21)^{0.4} + 0.07886(A-21), & 21 \le A \le 50, \\ 0, & A < 21 \end{cases} \qquad \text{(equation 11)}$$

Here $A=-20\log_{10}\delta$. where δ is the peak approximation error in the pass band and in the stop band.

In this way q(x) is determined, and from equation (7) the local characteristic impedance Z(x) is determined.

Figure 2:
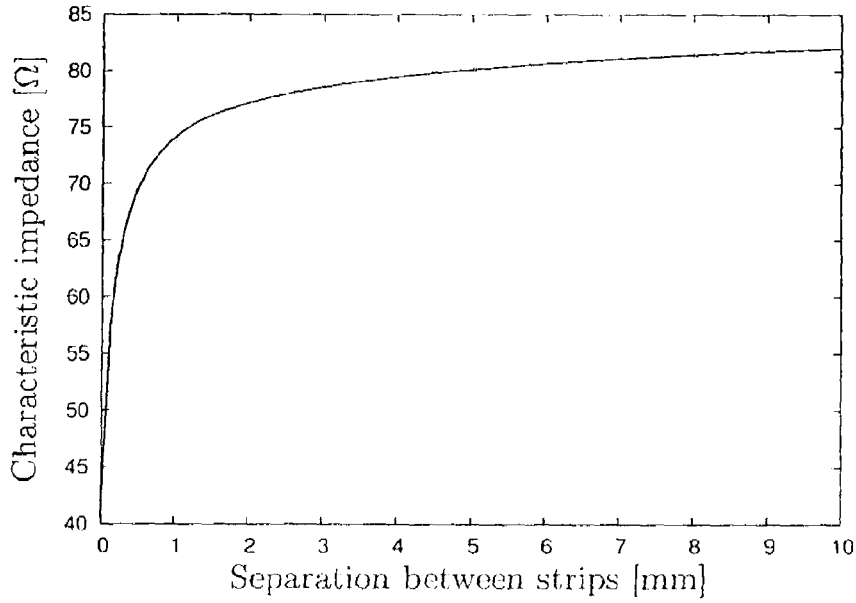
FIG. 2 is a graph showing the dependence on the distance between conductors of the characteristic impedance in micro-coplanar strip lines.
Figure 3:
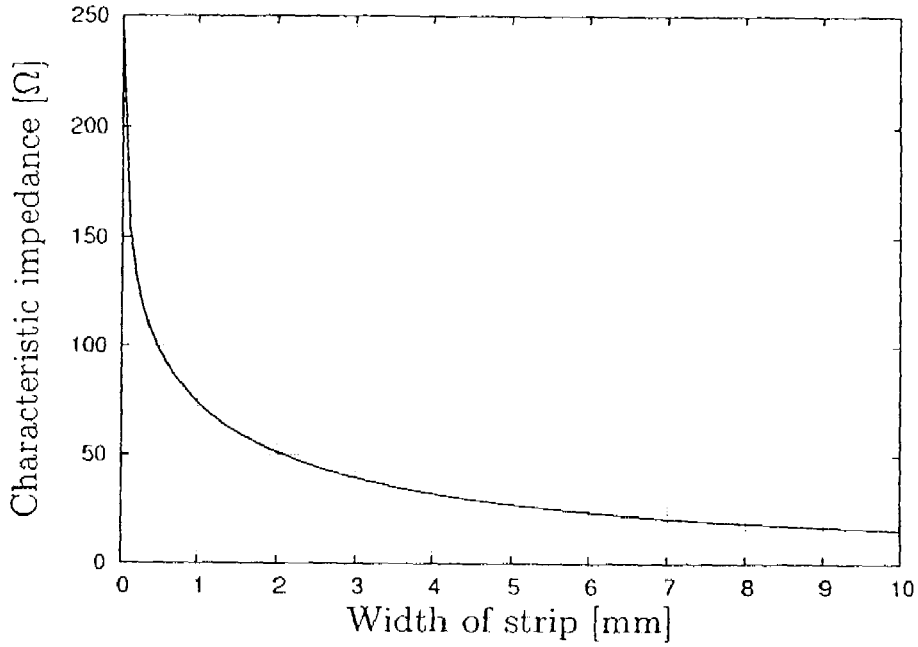
FIG. 3 is a graph showing the center conductor width dependence of the characteristic impedance in micro-coplanar strip lines.

Here, when either the width w of the center conductor 5 (hereafter the "center conductor width w") or the distance between the center conductor 5 and side conductor 7 (hereafter the "distance between conductors s"), or both, are changed in the micro-coplanar strip line of this invention, the local characteristic impedance can be changed (see Reference 10). FIG. 2 shows the dependence of the local characteristic impedance on the distance between conductors s, for a case in which the thickness h of the dielectric layer 3 is 1 mm, the relative permittivity Er of the dielectric layer 3 is 4.2, and the center conductor width w=1 mm. FIG. 3 shows the dependence of the local characteristic impedance on the center conductor width w for a case in which h=1 mm, $\in_r$=4.2, and the distance between conductors s=1 mm.

In this invention, the center conductor width w or distance between conductors s was calculated based on the local characteristic impedance obtained from equation (7), and bandpass filters 1 were fabricated so as to satisfy the calculated center conductor width w or distance between conductors s. By this means, reflection-type bandpass filters 1 having the desired pass band were obtained.

By applying the window function method to design reflection-type bandpass filters comprising a non-uniform microstrip, an extremely wide pass band and extremely small variation of group delay within the pass band compared with bandpass filters of the prior art can be achieved, even when manufacturing tolerances are large. As a result, a UWB bandpass filter which satisfies FCC specifications can be provided.

Further, by means of a reflection-type bandpass filter of exemplary embodiments of this invention, even when the ground potentials on the two sides are different, there is reduced excitation of surface waves due to slot line modes, susceptibility to external influences can be reduced, and stable filter characteristics can be obtained.

Moreover, by providing a ground layer in the substrate, the mechanical strength is reinforced and the power handling performance and ease of MMIC (Monolithic Microwave Integrated Circuits) circuit integration can be improved, and in addition coupling performance with other slot lines and microstrip lines can be improved.

Below, exemplary embodiments of the invention are explained in further detail. Each of the embodiments described below is merely illustrative of the invention, and the invention is not limited to the descriptions of these embodiments.

Embodiment 1

A Kaiser window was used for which the reflectance is 1 at frequencies f in the range 3.4 GHz≦f≦10.3 GHz, and is 0 elsewhere, and for which A=30. Design was performed using one wavelength of signals at frequency f=1 GHz propagating in the micro-coplanar strip as the waveguide length, and setting the system characteristic impedance to 50Ω. Here, the characteristic impedance may be set so as to match the impedance of the system being used. In general, in a circuit which handles high-frequency signals, a system impedance of 50 Ω, 75Ω, 300Ω, or similar is used. It is desirable that the characteristic impedance Zc be in the range 10Ω≦Zc≦300Ω. If the characteristic impedance is smaller than 10Ω, then losses due to the conductor and dielectric become comparatively large. If the characteristic impedance is higher than 300Ω, matching with the system impedance may not be possible.

Figure 4:
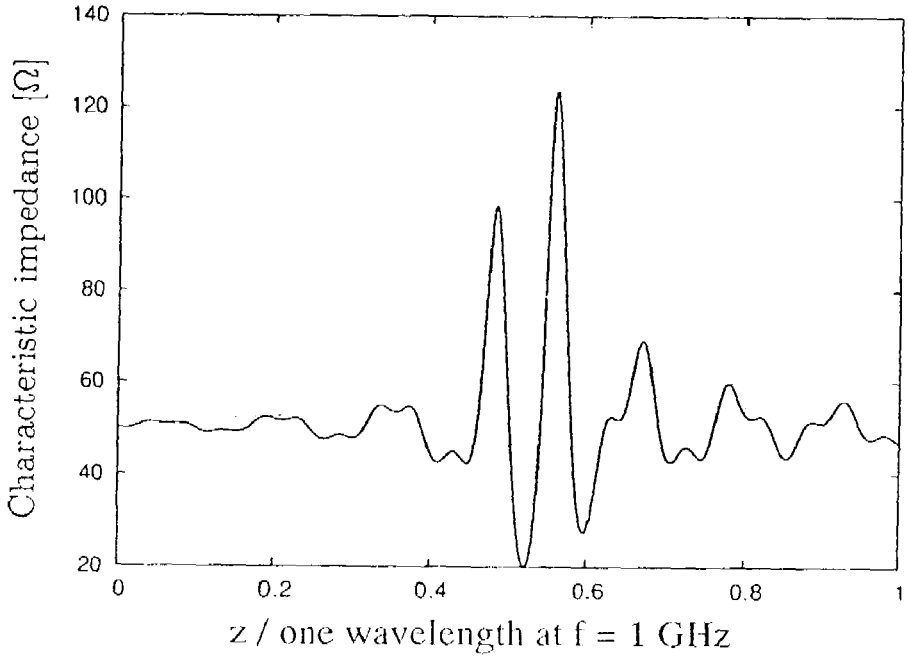
FIG. 4 is a graph showing the characteristic impedance distribution in the reflection-type bandpass filter fabricated in Embodiment 1.

FIG. 4 shows the distribution in the z-axis direction of the local characteristic impedance obtained in the inverse problem. The horizontal axis is z divided by one wavelength at f=1 GHz; similar axes are used in FIG. 10, FIG. 16, FIG. 22, and FIG. 28 below. "z" is the length extending in the z-axis direction from the end face on the input end. The horizontal axis indicates the value obtained by dividing z by one wavelength at f=1 GHz.

Figure 5:
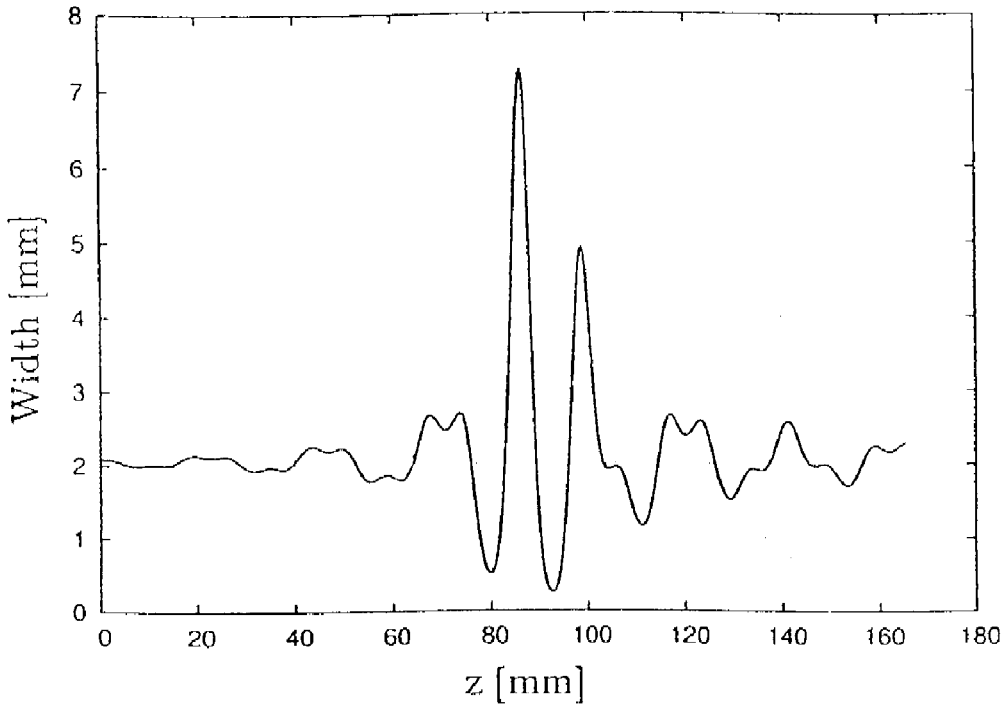
FIG. 5 is a graph showing the center conductor width distribution of micro-coplanar strip line in the reflection-type bandpass filter fabricated in Embodiment 1.

FIG. 5 shows the distribution in the z-axis direction of the center conductor width w, when using a dielectric layer 3 with a thickness h=1 mm and relative permittivity $\in_r$=4.2, and when the distance between conductors s=1 mm. Tables 1 through 3 list the center conductor widths w.

TABLE 1

Center conductor widths (1/3)

| | z[mm] | | | | | | | | | | | |
|---|---|---|---|---|---|---|---|---|---|---|---|---|
| | 0.00 | 0.17 | 0.33 | 0.50 | 0.66 | 0.83 | 0.99 | 1.16 | 1.32 | 1.49 | 1.65 | 1.82 |
| | w[mm] | | | | | | | | | | | |
| | 2.08 | 2.08 | 2.08 | 2.08 | 2.08 | 2.08 | 2.08 | 2.08 | 2.08 | 2.08 | 2.08 | 2.08 |
| #2 | 1.98 | 2.15 | 2.32 | 2.48 | 2.65 | 2.81 | 2.98 | 3.14 | 3.31 | 3.47 | 3.64 | 3.80 |
| — | 2.08 | 2.08 | 2.08 | 2.08 | 2.07 | 2.07 | 2.07 | 2.07 | 2.06 | 2.06 | 2.06 | 2.05 |
| #3 | 3.97 | 4.13 | 4.30 | 4.47 | 4.63 | 4.80 | 4.96 | 5.13 | 5.29 | 5.46 | 5.62 | 5.79 |
| — | 2.05 | 2.04 | 2.04 | 2.04 | 2.03 | 2.03 | 2.02 | 2.02 | 2.02 | 2.01 | 2.01 | 2.01 |
| #4 | 5.96 | 6.12 | 6.29 | 6.45 | 6.62 | 6.78 | 6.95 | 7.12 | 7.28 | 7.45 | 7.61 | 7.78 |
| — | 2.00 | 2.00 | 2.00 | 2.00 | 2.00 | 2.00 | 1.99 | 1.99 | 1.99 | 1.99 | 1.99 | 2.00 |
| #5 | 7.94 | 8.11 | 8.28 | 8.44 | 8.61 | 8.77 | 8.94 | 9.10 | 9.27 | 9.44 | 9.60 | 9.77 |
| — | 2.00 | 2.00 | 2.00 | 2.00 | 2.00 | 2.00 | 2.01 | 2.01 | 2.01 | 2.01 | 2.01 | 2.01 |
| #6 | 9.93 | 10.10 | 10.26 | 10.43 | 10.59 | 10.76 | 10.93 | 11.09 | 11.26 | 11.42 | 11.59 | 11.75 |
| — | 2.01 | 2.02 | 2.02 | 2.02 | 2.02 | 2.02 | 2.02 | 2.02 | 2.02 | 2.02 | 2.02 | 2.01 |
| #7 | 11.92 | 12.09 | 12.25 | 12.42 | 12.58 | 12.75 | 12.91 | 13.08 | 13.24 | 13.41 | 13.58 | 13.74 |
| — | 2.01 | 2.01 | 2.01 | 2.01 | 2.01 | 2.01 | 2.01 | 2.01 | 2.01 | 2.01 | 2.01 | 2.01 |
| #8 | 13.91 | 14.07 | 14.24 | 14.40 | 14.57 | 14.74 | 14.90 | 15.07 | 15.23 | 15.40 | 15.56 | 15.73 |
| — | 2.01 | 2.01 | 2.01 | 2.02 | 2.02 | 2.02 | 2.02 | 2.03 | 2.03 | 2.04 | 2.04 | 2.05 |
| #9 | 15.89 | 16.06 | 16.22 | 16.39 | 16.56 | 16.72 | 16.89 | 17.05 | 17.22 | 17.38 | 17.65 | 17.71 |
| — | 2.05 | 2.06 | 2.07 | 2.07 | 2.08 | 2.08 | 2.09 | 2.10 | 2.10 | 2.11 | 2.11 | 2.12 |
| #10 | 17.88 | 18.04 | 18.21 | 18.37 | 18.54 | 18.70 | 18.87 | 19.03 | 19.20 | 19.36 | 19.53 | 19.69 |
| — | 2.12 | 2.13 | 2.13 | 2.13 | 2.14 | 2.14 | 2.14 | 2.14 | 2.14 | 2.14 | 2.14 | 2.14 |
| #11 | 19.86 | 20.02 | 20.19 | 20.35 | 20.52 | 20.68 | 20.85 | 21.02 | 21.18 | 21.35 | 21.51 | 21.68 |
| — | 2.14 | 2.14 | 2.14 | 2.14 | 2.13 | 2.13 | 2.13 | 2.13 | 2.12 | 2.12 | 2.12 | 2.12 |
| #12 | 21.84 | 22.01 | 22.17 | 22.34 | 22.50 | 22.67 | 22.83 | 23.00 | 23.16 | 23.33 | 23.49 | 23.66 |
| — | 2.12 | 2.11 | 2.11 | 2.11 | 2.11 | 2.11 | 2.11 | 2.11 | 2.11 | 2.11 | 2.11 | 2.11 |
| #13 | 23.82 | 23.99 | 24.15 | 24.32 | 24.49 | 24.65 | 24.82 | 24.98 | 25.16 | 25.31 | 25.48 | 25.64 |
| — | 2.12 | 2.12 | 2.12 | 2.12 | 2.12 | 2.12 | 2.12 | 2.13 | 2.13 | 2.13 | 2.13 | 2.13 |
| #14 | 25.81 | 25.97 | 26.14 | 26.30 | 26.47 | 26.63 | 26.80 | 26.96 | 27.13 | 27.29 | 27.46 | 27.62 |
| — | 2.13 | 2.12 | 2.12 | 2.12 | 2.11 | 2.11 | 2.11 | 2.10 | 2.09 | 2.09 | 2.08 | 2.07 |
| #15 | 27.79 | 27.96 | 28.12 | 28.29 | 28.45 | 28.62 | 28.78 | 28.95 | 29.11 | 29.28 | 29.45 | 29.61 |
| — | 2.06 | 2.06 | 2.05 | 2.04 | 2.03 | 2.02 | 2.01 | 2.00 | 1.99 | 1.98 | 1.98 | 1.97 |
| #16 | 29.78 | 29.94 | 30.11 | 30.28 | 30.44 | 30.01 | 30.77 | 30.94 | 31.11 | 31.27 | 31.44 | 31.60 |
| — | 1.96 | 1.96 | 1.95 | 1.94 | 1.94 | 1.94 | 1.93 | 1.93 | 1.93 | 1.93 | 1.93 | 1.93 |
| #17 | 31.77 | 31.94 | 32.10 | 32.27 | 32.43 | 32.60 | 32.76 | 32.93 | 33.10 | 33.26 | 33.43 | 33.59 |
| — | 1.93 | 1.93 | 1.93 | 1.93 | 1.94 | 1.94 | 1.94 | 1.95 | 1.95 | 1.95 | 1.96 | 1.96 |
| #18 | 33.76 | 33.93 | 34.09 | 34.26 | 34.42 | 34.59 | 34.75 | 34.92 | 35.09 | 35.25 | 35.42 | 35.58 |
| — | 1.96 | 1.97 | 1.97 | 1.97 | 1.97 | 1.97 | 1.97 | 1.97 | 1.97 | 1.97 | 1.97 | 1.97 |
| #19 | 35.75 | 35.91 | 36.08 | 36.25 | 36.41 | 36.58 | 36.74 | 36.91 | 37.08 | 37.24 | 37.41 | 37.57 |
| — | 1.97 | 1.96 | 1.96 | 1.96 | 1.96 | 1.95 | 1.95 | 1.95 | 1.95 | 1.95 | 1.95 | 1.95 |
| #20 | 37.74 | 37.91 | 38.07 | 38.24 | 38.40 | 38.57 | 38.73 | 38.90 | 39.07 | 39.23 | 39.40 | 39.56 |
| — | 1.95 | 1.95 | 1.95 | 1.95 | 1.96 | 1.96 | 1.97 | 1.98 | 1.98 | 1.99 | 2.00 | 2.01 |
| #21 | 39.73 | 39.89 | 40.06 | 40.22 | 40.39 | 40.56 | 40.72 | 40.89 | 41.05 | 41.22 | 41.38 | 41.55 |
| — | 2.03 | 2.04 | 2.05 | 2.06 | 2.08 | 2.09 | 2.10 | 2.12 | 2.13 | 2.15 | 2.16 | 2.17 |
| #22 | 41.71 | 41.88 | 42.04 | 42.21 | 42.37 | 42.54 | 42.70 | 42.87 | 43.03 | 43.19 | 43.36 | 43.52 |
| — | 2.18 | 2.19 | 2.20 | 2.21 | 2.22 | 2.23 | 2.24 | 2.24 | 2.24 | 2.25 | 2.25 | 2.25 |
| #23 | 43.69 | 43.85 | 44.02 | 44.18 | 44.35 | 44.51 | 44.68 | 44.84 | 45.01 | 45.17 | 45.34 | 45.50 |
| — | 2.25 | 2.25 | 2.24 | 2.24 | 2.24 | 2.23 | 2.23 | 2.22 | 2.22 | 2.21 | 2.21 | 2.20 |
| #24 | 45.67 | 45.83 | 46.00 | 46.16 | 46.33 | 46.49 | 46.66 | 46.82 | 46.99 | 47.15 | 47.32 | 47.48 |
| — | 2.20 | 2.19 | 2.19 | 2.19 | 2.18 | 2.18 | 2.18 | 2.18 | 2.18 | 2.18 | 2.19 | 2.19 |
| #25 | 47.65 | 47.81 | 47.98 | 48.14 | 48.31 | 48.47 | 48.64 | 48.80 | 48.97 | 49.13 | 49.30 | 49.46 |
| — | 2.19 | 2.20 | 2.20 | 2.20 | 2.21 | 2.21 | 2.22 | 2.22 | 2.22 | 2.23 | 2.23 | 2.23 |
| #26 | 49.63 | 49.79 | 49.96 | 50.12 | 50.28 | 50.45 | 50.61 | 50.78 | 50.94 | 51.11 | 51.27 | 51.44 |
| — | 2.23 | 2.23 | 2.22 | 2.22 | 2.21 | 2.21 | 2.20 | 2.19 | 2.18 | 2.16 | 2.15 | 2.13 |
| #27 | 51.61 | 51.77 | 51.94 | 52.10 | 52.27 | 52.43 | 52.60 | 52.76 | 52.93 | 53.10 | 53.26 | 53.43 |
| — | 2.12 | 2.10 | 2.08 | 2.06 | 2.04 | 2.02 | 2.00 | 1.98 | 1.95 | 1.93 | 1.91 | 1.90 |
| #28 | 53.59 | 53.76 | 53.93 | 54.09 | 54.26 | 54.43 | 54.59 | 54.76 | 54.93 | 55.09 | 55.26 | 55.42 |
| — | 1.88 | 1.86 | 1.85 | 1.83 | 1.82 | 1.81 | 1.80 | 1.79 | 1.78 | 1.78 | 1.77 | 1.77 |
| #29 | 55.59 | 55.76 | 55.92 | 56.09 | 56.26 | 56.42 | 56.59 | 56.76 | 56.92 | 57.09 | 57.26 | 57.42 |
| — | 1.77 | 1.77 | 1.77 | 1.78 | 1.78 | 1.79 | 1.79 | 1.80 | 1.81 | 1.81 | 1.82 | 1.83 |
| #30 | 57.59 | 57.76 | 57.92 | 58.09 | 58.25 | 58.42 | 58.59 | 58.75 | 58.92 | 59.09 | 59.25 | 59.42 |
| — | 1.83 | 1.84 | 1.85 | 1.85 | 1.85 | 1.86 | 1.86 | 1.86 | 1.86 | 1.86 | 1.86 | 1.85 |

TABLE 2

Center conductor widths (2/3)

| | | | | | | | | | | | | |
|---|---|---|---|---|---|---|---|---|---|---|---|---|
| #31 | 59.58 | 59.75 | 59.92 | 60.08 | 60.25 | 60.42 | 60.58 | 60.75 | 60.92 | 61.08 | 61.25 | 61.42 |
| — | 1.85 | 1.84 | 1.84 | 1.83 | 1.82 | 1.82 | 1.81 | 1.80 | 1.80 | 1.79 | 1.79 | 1.79 |
| #32 | 61.58 | 61.75 | 61.91 | 62.08 | 62.25 | 62.41 | 62.58 | 62.75 | 62.91 | 63.08 | 63.25 | 63.41 |
| — | 1.78 | 1.78 | 1.79 | 1.79 | 1.80 | 1.81 | 1.82 | 1.83 | 1.85 | 1.87 | 1.89 | 1.91 |

TABLE 2-continued

| Center conductor widths (2/3) | | | | | | | | | | | | |
|---|---|---|---|---|---|---|---|---|---|---|---|---|
| #33 | 63.58 | 63.74 | 63.91 | 64.07 | 64.24 | 64.41 | 64.57 | 64.74 | 64.90 | 65.07 | 65.23 | 65.39 |
| — | 1.94 | 1.97 | 2.00 | 2.03 | 2.07 | 2.10 | 2.14 | 2.18 | 2.22 | 2.26 | 2.30 | 2.34 |
| #34 | 65.56 | 65.72 | 65.89 | 66.05 | 66.21 | 66.38 | 66.54 | 66.71 | 66.87 | 67.03 | 67.20 | 67.36 |
| — | 2.38 | 2.42 | 2.46 | 2.49 | 2.52 | 2.55 | 2.58 | 2.60 | 2.62 | 2.64 | 2.65 | 2.66 |
| #35 | 67.52 | 67.69 | 67.85 | 68.01 | 68.18 | 68.34 | 68.50 | 68.67 | 68.83 | 68.99 | 69.16 | 69.32 |
| — | 2.67 | 2.67 | 2.67 | 2.66 | 2.65 | 2.64 | 2.63 | 2.61 | 2.60 | 2.58 | 2.56 | 2.55 |
| #36 | 69.49 | 69.65 | 69.81 | 69.98 | 70.14 | 70.31 | 70.47 | 70.63 | 70.80 | 70.96 | 71.13 | 71.29 |
| — | 2.53 | 2.51 | 2.50 | 2.49 | 2.47 | 2.47 | 2.46 | 2.46 | 2.46 | 2.46 | 2.46 | 2.47 |
| #37 | 71.45 | 71.62 | 71.78 | 71.95 | 72.11 | 72.27 | 72.44 | 72.60 | 72.76 | 72.93 | 73.09 | 73.25 |
| — | 2.46 | 2.50 | 2.51 | 2.53 | 2.55 | 2.57 | 2.59 | 2.61 | 2.63 | 2.65 | 2.67 | 2.68 |
| #38 | 73.42 | 73.58 | 73.74 | 73.91 | 74.07 | 74.23 | 74.40 | 74.56 | 74.72 | 74.89 | 75.05 | 75.22 |
| — | 2.69 | 2.69 | 2.69 | 2.69 | 2.67 | 2.65 | 2.62 | 2.58 | 2.54 | 2.48 | 2.42 | 2.35 |
| #39 | 75.38 | 75.55 | 75.71 | 75.88 | 76.04 | 76.21 | 76.38 | 76.54 | 76.71 | 76.88 | 77.05 | 77.22 |
| — | 2.28 | 2.19 | 2.11 | 2.01 | 1.92 | 1.82 | 1.72 | 1.62 | 1.52 | 1.42 | 1.32 | 1.23 |
| #40 | 77.39 | 77.56 | 77.73 | 77.90 | 78.07 | 78.24 | 78.42 | 78.59 | 78.76 | 78.94 | 79.11 | 79.28 |
| — | 1.14 | 1.05 | 0.97 | 0.90 | 0.83 | 0.77 | 0.72 | 0.67 | 0.63 | 0.59 | 0.56 | 0.54 |
| #41 | 79.46 | 79.63 | 79.81 | 79.98 | 80.15 | 80.33 | 80.50 | 80.68 | 80.85 | 81.02 | 81.19 | 81.37 |
| — | 0.52 | 0.51 | 0.51 | 0.51 | 0.52 | 0.53 | 0.55 | 0.58 | 0.62 | 0.67 | 0.73 | 0.80 |
| #42 | 81.54 | 81.71 | 81.88 | 82.05 | 82.22 | 82.38 | 82.55 | 82.72 | 82.88 | 83.05 | 83.21 | 83.37 |
| — | 0.88 | 0.97 | 1.08 | 1.20 | 1.34 | 1.49 | 1.67 | 1.86 | 2.07 | 2.20 | 2.54 | 2.81 |
| #43 | 83.54 | 83.70 | 83.86 | 84.02 | 84.18 | 84.34 | 84.50 | 84.65 | 84.81 | 84.97 | 85.13 | 85.28 |
| — | 3.08 | 3.39 | 3.71 | 4.03 | 4.37 | 4.71 | 5.06 | 5.40 | 5.73 | 6.05 | 6.34 | 6.60 |
| #44 | 85.44 | 85.60 | 85.75 | 85.91 | 86.06 | 86.22 | 86.38 | 86.53 | 86.69 | 86.85 | 87.00 | 87.16 |
| — | 6.88 | 7.02 | 7.16 | 7.25 | 7.29 | 7.27 | 7.20 | 7.08 | 6.90 | 6.68 | 6.42 | 6.13 |
| #45 | 87.32 | 87.48 | 87.63 | 87.79 | 87.95 | 88.11 | 88.27 | 88.44 | 88.60 | 88.76 | 88.93 | 88.09 |
| — | 5.81 | 5.46 | 5.11 | 4.75 | 4.39 | 4.03 | 3.68 | 3.34 | 3.01 | 2.71 | 2.42 | 2.16 |
| #46 | 89.26 | 89.42 | 89.59 | 89.76 | 89.93 | 90.10 | 90.27 | 90.44 | 90.62 | 90.79 | 90.97 | 91.14 |
| — | 1.91 | 1.68 | 1.48 | 1.29 | 1.13 | 0.98 | 0.85 | 0.74 | 0.64 | 0.56 | 0.49 | 0.43 |
| #47 | 91.32 | 91.49 | 91.67 | 91.84 | 92.02 | 92.20 | 92.37 | 92.55 | 92.73 | 92.90 | 93.08 | 93.26 |
| — | 0.38 | 0.34 | 0.31 | 0.29 | 0.27 | 0.26 | 0.25 | 0.25 | 0.26 | 0.27 | 0.29 | 0.31 |
| #48 | 93.43 | 93.61 | 93.78 | 93.96 | 94.13 | 94.30 | 94.48 | 94.65 | 94.82 | 94.99 | 95.16 | 95.33 |
| — | 0.34 | 0.38 | 0.42 | 0.48 | 0.54 | 0.62 | 0.70 | 0.80 | 0.92 | 1.04 | 1.19 | 1.34 |
| #49 | 95.50 | 95.66 | 95.83 | 95.99 | 96.16 | 96.32 | 96.49 | 96.65 | 96.81 | 96.97 | 97.13 | 97.29 |
| — | 1.51 | 1.69 | 1.88 | 2.08 | 2.29 | 2.51 | 2.74 | 2.97 | 3.20 | 3.43 | 3.65 | 3.87 |
| #50 | 97.45 | 97.61 | 97.77 | 97.93 | 98.09 | 98.25 | 98.41 | 98.57 | 98.73 | 98.88 | 99.04 | 99.20 |
| — | 4.07 | 4.26 | 4.42 | 4.57 | 4.69 | 4.79 | 4.86 | 4.90 | 4.92 | 4.91 | 4.87 | 4.81 |
| #51 | 99.36 | 99.52 | 99.68 | 99.84 | 100.00 | 100.16 | 100.32 | 100.48 | 100.64 | 100.80 | 100.96 | 101.13 |
| — | 4.73 | 4.62 | 4.51 | 4.37 | 4.23 | 4.08 | 3.93 | 3.77 | 3.62 | 3.46 | 3.31 | 3.17 |
| #52 | 101.29 | 101.45 | 101.62 | 101.78 | 101.94 | 102.11 | 102.27 | 102.44 | 102.60 | 102.77 | 102.93 | 103.10 |
| — | 3.03 | 2.90 | 2.77 | 2.66 | 2.55 | 2.46 | 2.37 | 2.29 | 2.22 | 2.16 | 2.10 | 2.06 |
| #53 | 103.26 | 103.43 | 103.59 | 103.76 | 103.92 | 104.09 | 104.26 | 104.42 | 104.59 | 104.75 | 104.92 | 105.09 |
| — | 2.02 | 1.99 | 1.97 | 1.95 | 1.93 | 1.92 | 1.92 | 1.92 | 1.92 | 1.92 | 1.93 | 1.94 |
| #54 | 105.25 | 105.42 | 105.58 | 105.75 | 105.92 | 106.08 | 106.25 | 106.41 | 106.58 | 106.75 | 106.91 | 107.08 |
| — | 1.94 | 1.95 | 1.95 | 1.96 | 1.96 | 1.96 | 1.95 | 1.94 | 1.93 | 1.91 | 1.89 | 1.87 |
| #55 | 107.24 | 107.41 | 107.58 | 107.74 | 107.91 | 108.08 | 108.25 | 108.41 | 108.58 | 108.75 | 108.92 | 109.08 |
| — | 1.84 | 1.81 | 1.77 | 1.74 | 1.70 | 1.65 | 1.61 | 1.57 | 1.52 | 1.48 | 1.44 | 1.40 |
| #56 | 109.25 | 109.42 | 109.59 | 109.76 | 109.93 | 110.10 | 110.27 | 110.44 | 110.61 | 110.78 | 110.95 | 111.12 |
| — | 1.36 | 1.32 | 1.29 | 1.26 | 1.23 | 1.21 | 1.19 | 1.17 | 1.16 | 1.15 | 1.15 | 1.16 |
| #57 | 111.29 | 111.46 | 111.63 | 111.79 | 111.96 | 112.13 | 112.30 | 112.47 | 112.64 | 112.81 | 112.97 | 113.14 |
| — | 1.16 | 1.17 | 1.10 | 1.21 | 1.24 | 1.27 | 1.31 | 1.35 | 1.39 | 1.44 | 1.50 | 1.55 |
| #58 | 113.31 | 113.48 | 113.64 | 113.81 | 113.98 | 114.14 | 114.31 | 114.47 | 114.64 | 114.80 | 114.97 | 115.13 |
| — | 1.61 | 1.68 | 1.74 | 1.81 | 1.88 | 1.95 | 2.02 | 2.09 | 2.16 | 2.22 | 2.29 | 2.35 |
| #59 | 115.30 | 115.46 | 115.62 | 115.79 | 115.95 | 116.11 | 116.28 | 116.44 | 116.61 | 116.77 | 116.93 | 117.10 |
| — | 2.40 | 2.45 | 2.50 | 2.54 | 2.57 | 2.60 | 2.63 | 2.64 | 2.66 | 2.66 | 2.66 | 2.66 |
| #60 | 117.26 | 117.42 | 117.59 | 117.75 | 117.91 | 118.08 | 118.24 | 118.40 | 118.57 | 118.73 | 118.90 | 119.06 |
| — | 2.65 | 2.64 | 2.62 | 2.60 | 2.58 | 2.56 | 2.54 | 2.52 | 2.50 | 2.47 | 2.46 | 2.44 |

TABLE 3

| Center conductor widths (3/3) | | | | | | | | | | | | |
|---|---|---|---|---|---|---|---|---|---|---|---|---|
| #61 | 119.22 | 119.39 | 119.55 | 119.72 | 119.88 | 120.05 | 120.21 | 120.37 | 120.54 | 120.70 | 120.87 | 121.03 |
| — | 2.42 | 2.41 | 2.40 | 2.39 | 2.38 | 2.38 | 2.38 | 2.38 | 2.39 | 2.40 | 2.41 | 2.42 |
| #62 | 121.20 | 121.36 | 121.52 | 121.69 | 121.85 | 122.02 | 122.18 | 122.34 | 122.51 | 121.67 | 122.83 | 123.00 |
| — | 2.43 | 2.45 | 2.46 | 2.48 | 2.50 | 2.52 | 2.53 | 2.55 | 2.56 | 2.57 | 2.58 | 2.58 |
| #63 | 123.16 | 123.33 | 123.49 | 123.65 | 123.82 | 123.98 | 124.14 | 124.31 | 124.47 | 124.64 | 124.80 | 124.97 |
| — | 2.59 | 2.58 | 2.58 | 2.57 | 2.55 | 2.53 | 2.51 | 2.48 | 2.45 | 2.42 | 2.38 | 2.34 |
| #64 | 125.13 | 125.29 | 125.46 | 125.62 | 125.79 | 125.96 | 126.12 | 126.29 | 126.45 | 126.62 | 126.79 | 126.95 |
| — | 2.29 | 2.25 | 2.20 | 2.15 | 2.10 | 2.05 | 2.00 | 1.95 | 1.91 | 1.86 | 1.82 | 1.77 |
| #65 | 127.12 | 127.29 | 127.45 | 127.62 | 127.79 | 127.95 | 128.12 | 128.29 | 128.46 | 128.63 | 128.79 | 128.96 |
| — | 1.74 | 1.70 | 1.67 | 1.64 | 1.61 | 1.59 | 1.57 | 1.55 | 1.54 | 1.53 | 1.52 | 1.52 |
| #66 | 129.13 | 129.30 | 129.46 | 129.63 | 129.80 | 129.97 | 130.13 | 130.30 | 130.47 | 130.64 | 130.80 | 130.97 |
| — | 1.52 | 1.53 | 1.53 | 1.54 | 1.56 | 1.57 | 1.59 | 1.61 | 1.63 | 1.65 | 1.67 | 1.69 |

TABLE 3-continued

| Center conductor widths (3/3) | | | | | | | | | | | | |
|---|---|---|---|---|---|---|---|---|---|---|---|---|
| #67 | 131.14 | 131.30 | 131.47 | 131.54 | 131.80 | 131.97 | 132.14 | 132.30 | 132.47 | 132.63 | 132.80 | 132.97 |
| — | 1.72 | 1.74 | 1.76 | 1.78 | 1.81 | 1.83 | 1.85 | 1.86 | 1.88 | 1.89 | 1.91 | 1.92 |
| #68 | 133.13 | 133.30 | 133.46 | 133.63 | 133.80 | 133.96 | 134.13 | 134.29 | 134.46 | 134.63 | 134.79 | 134.96 |
| — | 1.93 | 1.93 | 1.94 | 1.94 | 1.94 | 1.94 | 1.94 | 1.93 | 1.93 | 1.93 | 1.92 | 1.92 |
| #69 | 135.12 | 135.29 | 135.46 | 135.62 | 135.79 | 135.95 | 136.12 | 136.29 | 136.45 | 136.62 | 136.78 | 136.95 |
| — | 1.92 | 1.91 | 1.91 | 1.91 | 1.91 | 1.91 | 1.92 | 1.92 | 1.93 | 1.94 | 1.96 | 1.97 |
| #70 | 137.11 | 137.28 | 137.45 | 137.61 | 137.78 | 137.94 | 138.11 | 138.27 | 138.44 | 138.60 | 138.77 | 138.93 |
| — | 1.99 | 2.01 | 2.03 | 2.05 | 2.08 | 2.10 | 2.13 | 2.16 | 2.20 | 2.23 | 2.26 | 2.29 |
| #71 | 139.10 | 139.26 | 139.42 | 139.59 | 139.75 | 139.92 | 140.08 | 140.24 | 140.41 | 140.57 | 140.74 | 140.90 |
| — | 2.33 | 2.36 | 2.39 | 2.42 | 2.45 | 2.48 | 2.50 | 2.52 | 2.54 | 2.56 | 2.57 | 2.58 |
| #72 | 141.06 | 141.23 | 141.39 | 141.55 | 141.72 | 141.86 | 142.05 | 142.21 | 142.37 | 142.54 | 142.70 | 142.87 |
| — | 2.58 | 2.58 | 2.58 | 2.57 | 2.56 | 2.55 | 2.53 | 2.51 | 2.49 | 2.47 | 2.44 | 2.41 |
| #73 | 143.03 | 143.19 | 143.36 | 143.52 | 143.69 | 143.85 | 144.02 | 144.18 | 144.35 | 144.51 | 144.68 | 144.84 |
| — | 2.38 | 2.35 | 2.32 | 2.29 | 2.26 | 2.23 | 2.20 | 2.18 | 2.15 | 2.13 | 2.10 | 2.08 |
| #74 | 145.01 | 145.17 | 145.34 | 145.51 | 145.67 | 145.84 | 146.00 | 146.17 | 146.33 | 146.50 | 146.67 | 146.83 |
| — | 2.06 | 2.04 | 2.03 | 2.01 | 2.00 | 1.90 | 1.99 | 1.98 | 1.98 | 1.97 | 1.97 | 1.97 |
| #75 | 147.00 | 147.16 | 147.33 | 147.49 | 147.66 | 147.83 | 147.99 | 148.16 | 148.32 | 148.49 | 148.65 | 148.82 |
| — | 1.97 | 1.98 | 1.98 | 1.98 | 1.99 | 1.99 | 1.99 | 1.99 | 2.00 | 2.00 | 2.00 | 2.00 |
| #76 | 148.99 | 149.15 | 149.32 | 149.48 | 149.65 | 149.81 | 149.98 | 150.15 | 150.31 | 150.48 | 150.64 | 150.81 |
| — | 1.99 | 1.99 | 1.99 | 1.98 | 1.97 | 1.96 | 1.95 | 1.94 | 1.93 | 1.91 | 1.90 | 1.88 |
| #77 | 150.98 | 151.14 | 151.31 | 151.48 | 151.64 | 151.81 | 151.98 | 152.14 | 152.31 | 152.48 | 152.64 | 152.81 |
| — | 1.87 | 1.85 | 1.83 | 1.82 | 1.80 | 1.79 | 1.77 | 1.76 | 1.75 | 1.74 | 1.73 | 1.72 |
| #78 | 152.98 | 153.14 | 153.31 | 153.48 | 153.64 | 153.81 | 153.98 | 154.14 | 154.31 | 154.48 | 154.64 | 154.81 |
| — | 1.71 | 1.71 | 1.71 | 1.71 | 1.71 | 1.72 | 1.72 | 1.73 | 1.74 | 1.76 | 1.77 | 1.79 |
| #79 | 154.98 | 155.14 | 155.31 | 155.48 | 155.64 | 155.81 | 155.97 | 156.14 | 156.30 | 156.47 | 156.64 | 156.80 |
| — | 1.81 | 1.83 | 1.85 | 1.87 | 1.89 | 1.92 | 1.94 | 1.97 | 2.00 | 2.02 | 2.05 | 2.07 |
| #80 | 156.97 | 157.13 | 157.30 | 157.46 | 157.63 | 157.79 | 157.96 | 158.12 | 158.29 | 158.45 | 158.62 | 158.78 |
| — | 2.09 | 2.12 | 2.14 | 2.16 | 2.17 | 2.19 | 2.20 | 2.22 | 2.23 | 2.23 | 2.24 | 2.25 |
| #81 | 158.95 | 159.11 | 159.28 | 159.44 | 159.61 | 159.77 | 159.93 | 160.10 | 160.26 | 160.43 | 160.59 | 160.76 |
| — | 2.25 | 2.25 | 2.25 | 2.25 | 2.24 | 2.24 | 2.23 | 2.23 | 2.22 | 2.21 | 2.21 | 2.20 |
| #82 | 160.92 | 161.09 | 161.25 | 161.42 | 161.58 | 161.75 | 161.91 | 162.08 | 162.24 | 162.41 | 162.57 | 162.74 |
| — | 2.19 | 2.19 | 2.18 | 2.18 | 2.17 | 2.17 | 2.17 | 2.17 | 2.17 | 2.17 | 2.18 | 2.18 |
| #83 | 162.90 | 163.07 | 163.23 | 163.40 | 163.56 | 163.73 | 163.89 | 164.06 | 164.22 | 164.39 | 164.55 | 164.72 |
| — | 2.19 | 2.19 | 2.20 | 2.21 | 2.22 | 2.22 | 2.23 | 2.24 | 2.25 | 2.26 | 2.27 | 2.27 |
| #84 | 164.88 | 165.05 | 165.21 | 165.38 | 165.54 | | | | | | | |
| — | 2.28 | 2.28 | 2.29 | 2.29 | 2.29 | | | | | | | |

Figure 6:
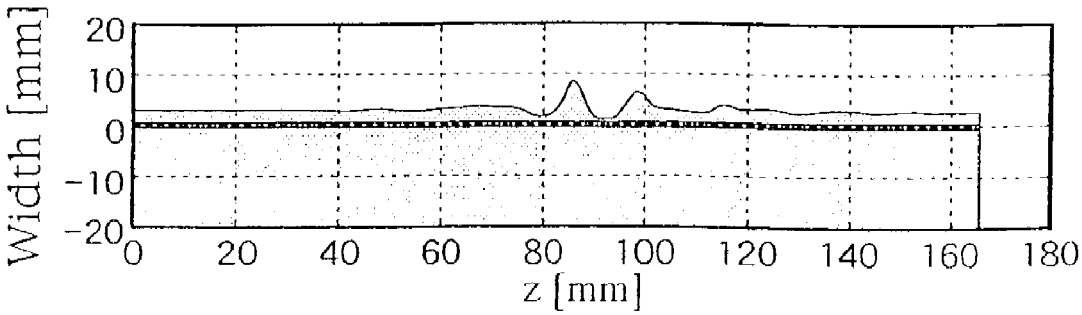
FIG. 6 is a graph showing a first shape for the micro-coplanar strip line in the reflection-type bandpass filter fabricated in Embodiment 1.
Figure 7:
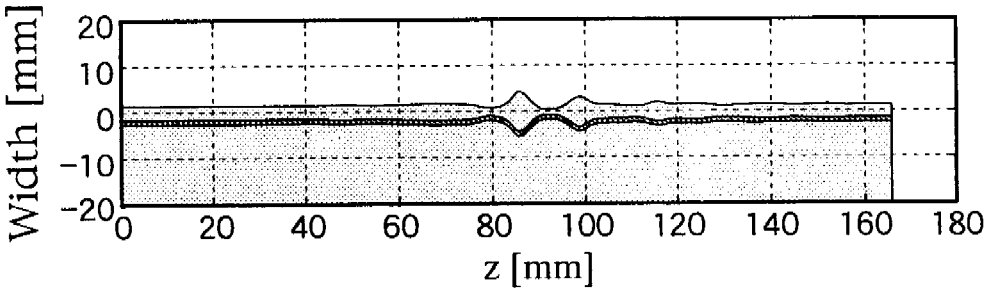
FIG. 7 is a graph showing a second shape for the micro-coplanar strip line in the reflection-type bandpass filter fabricated in Embodiment 1.

FIG. 6 and FIG. 7 show the shapes of two types of micro-coplanar strip lines in bandpass filters 1 fabricated in Embodiment 1. In FIG. 6, a micro-coplanar strip line is formed with the side edge 5*a* of the center conductor 5 and the side edge 7*a* of the side conductor 7 made straight lines, and with the side edge 5*b* of the center conductor 5 varied such that the center conductor width w takes on calculated values. In FIG. 7, a micro-coplanar strip line is formed with both side edges 5*a*, 5*b* of the center conductor 5 varied such that the center conductor width w takes on calculated values, and so as to change symmetrically with respect to the center line of the center conductor 5. In these figures, the lightly shaded portions represent the center conductor 5 and side conductor 7, and the darkly shaded lines represent the non-conducting portion 6. A non-reflecting terminator, or an R=50Ω resistance, is provided on the terminating side (the face at z=165.54 mm) of this reflection-type bandpass filter 1. The non-reflecting terminator or resistance may be connected directly to the terminating end of the reflection-type bandpass filter 1. The thicknesses of the metal films of the center conductor 5 and of the side conductor 7 may be thick compared with the skin depth at f=1 GHz, $\delta s=\sqrt{\{2/(\omega\mu_0\sigma)\}}$. Here ω, $\mu_0$, and σ are respectively the angular frequency, permittivity in vacuum, and the conductivity of the metal. For example, when using copper, the thickness of the center conductor 5 and of the side conductor 7 may be 2.1 μm or greater. The thickness of the ground layer 4 may be the same as or greater than the thicknesses of the center conductor 5 and side conductor 7. This bandpass filter 1 is used in a system with a characteristic impedance of 50Ω.

Figure 8:
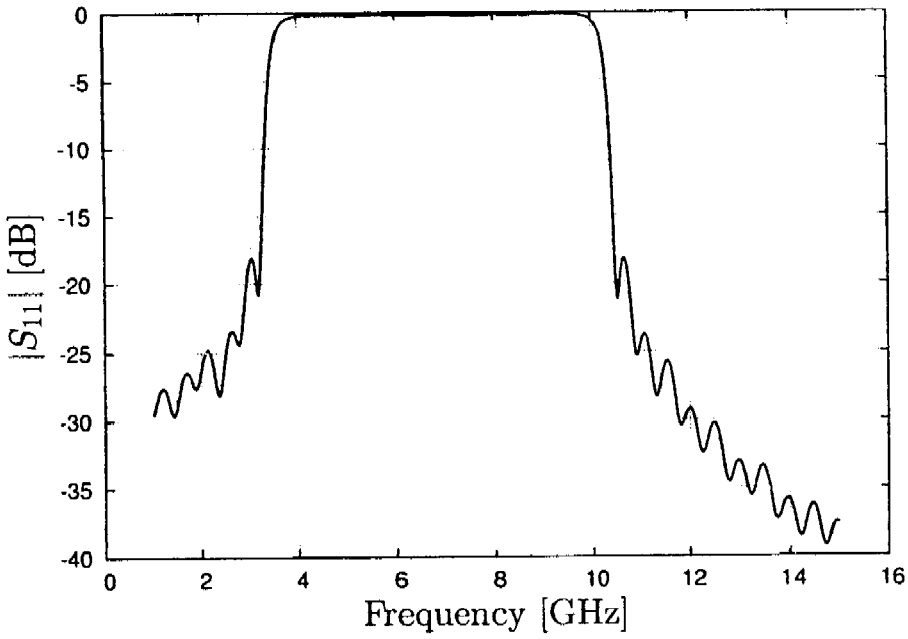
FIG. 8 is a graph showing the reflected wave amplitude characteristic in the reflection-type bandpass filter fabricated in Embodiment 1.
Figure 9:
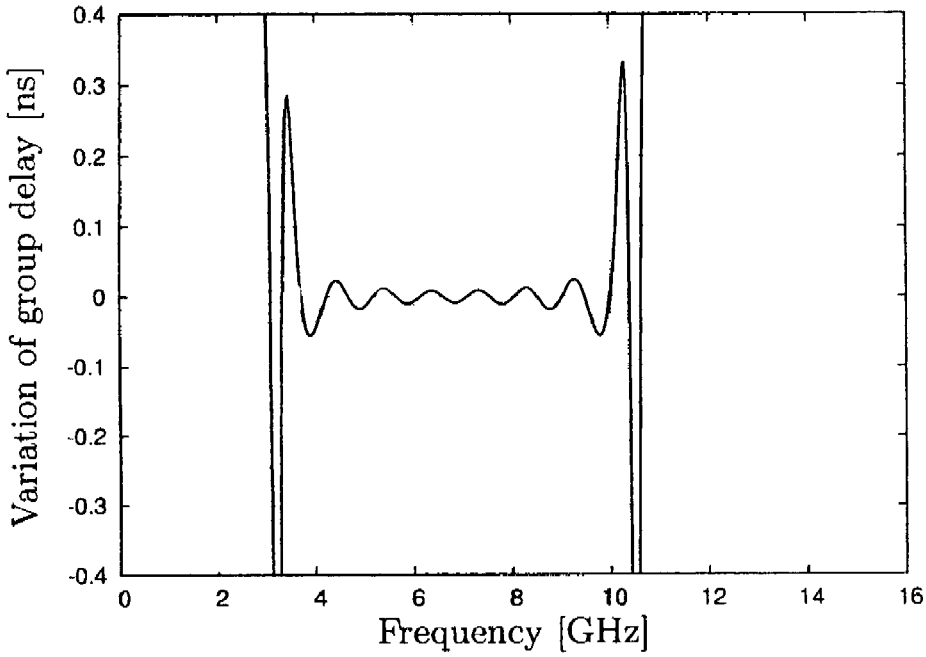
FIG. 9 is a graph showing the reflected wave group delay characteristic in the reflection-type bandpass filter fabricated in Embodiment 1.

FIG. 8 and FIG. 9 show the amplitude characteristic and group delay characteristic respectively of reflected waves ($S_{11}$) in bandpass filters of Embodiment 1. As shown in the figures, in the range of frequencies f for which 3.7 GHz≦f≦10.0 GHz, the reflectance is −1 dB or greater, and the group delay variation is within ±0.05 ns. In the region f<3.1 GHz or f>10.6 GHz, the reflectance is −17 dB or lower.

Embodiment 2

Figure 10:
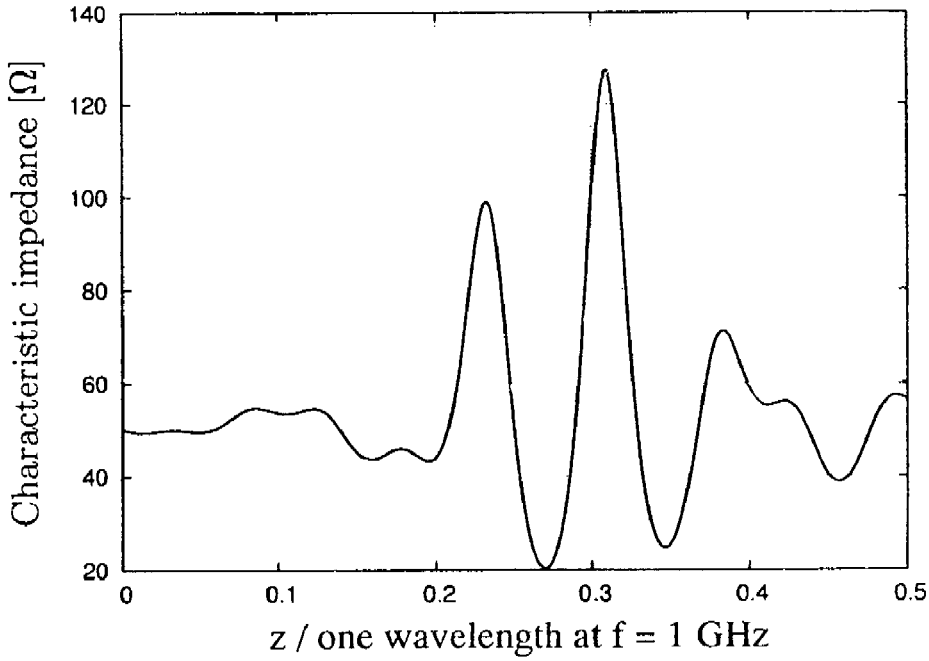
FIG. 10 is a graph showing the characteristic impedance distribution in the reflection-type bandpass filter fabricated in Embodiment 2.

A Kaiser window was used for which the reflectance is 1 at frequencies f in the range 3.4 GHz≦f≦10.3 GHz, and is 0 elsewhere, and for which A=30. Design was performed using 0.5 wavelength of signals at frequency f=1 GHz propagating in the micro-coplanar strip as the waveguide length, and setting the system characteristic impedance to 50Ω. FIG. 10 shows the distribution in the z-axis direction of the local characteristic impedance obtained in the inverse problem.

Figure 11:
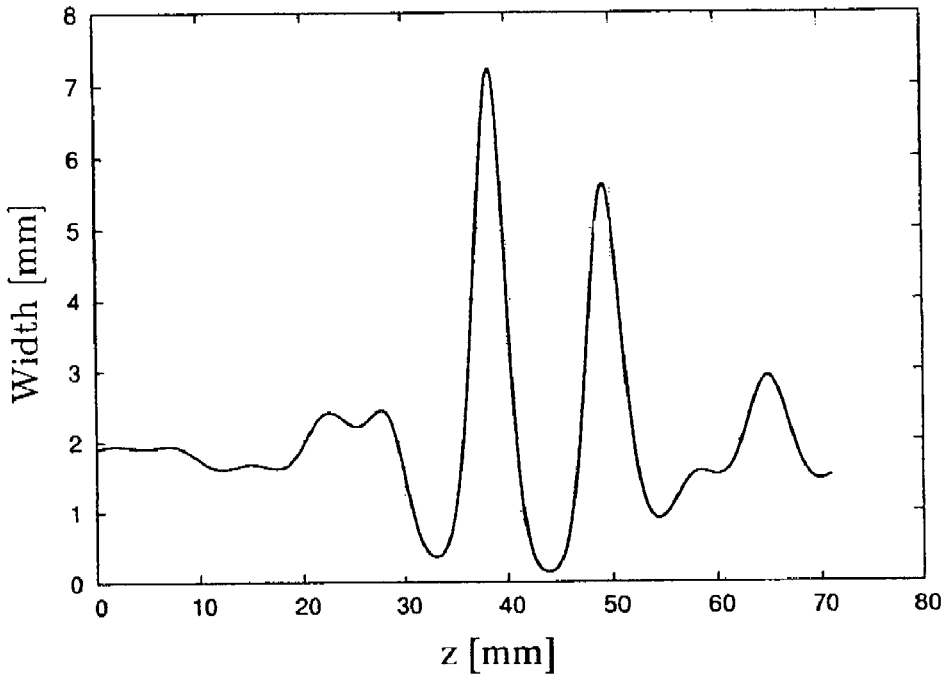
FIG. 11 is a graph showing the center conductor width distribution of micro-coplanar strip line in the reflection-type bandpass filter fabricated in Embodiment 2.

FIG. 11 shows the distribution in the z-axis direction of the center conductor width w, when using a dielectric layer 3 with a thickness h=1.27 mm and relative permittivity $\in_r$=6.15, and when the distance between conductors s=1 mm. Tables 4 through 6 list the center conductor widths w.

TABLE 4

Center conductor widths (1/3)

| | z[mm] | | | | | | | | | | | |
|---|---|---|---|---|---|---|---|---|---|---|---|---|
| | 0.00 | 0.07 | 0.14 | 0.21 | 0.28 | 0.35 | 0.43 | 0.50 | 0.57 | 0.64 | 0.71 | 0.78 |
| | w[mm] | | | | | | | | | | | |
| | 1.90 | 1.90 | 1.91 | 1.91 | 1.91 | 1.91 | 1.92 | 1.92 | 1.92 | 1.93 | 1.93 | 1.93 |
| #2 | 0.85 | 0.92 | 0.99 | 1.06 | 1.13 | 1.20 | 1.28 | 1.35 | 1.42 | 1.49 | 1.56 | 1.63 |
| — | 1.93 | 1.93 | 1.94 | 1.94 | 1.94 | 1.94 | 1.94 | 1.94 | 1.94 | 1.94 | 1.94 | 1.94 |
| #3 | 1.70 | 1.77 | 1.84 | 1.91 | 1.98 | 2.05 | 2.12 | 2.20 | 2.27 | 2.34 | 2.41 | 2.48 |
| — | 1.95 | 1.95 | 1.95 | 1.95 | 1.95 | 1.94 | 1.94 | 1.94 | 1.94 | 1.94 | 1.94 | 1.94 |
| #4 | 2.55 | 2.62 | 2.69 | 2.76 | 2.83 | 2.90 | 2.97 | 3.05 | 3.12 | 3.19 | 3.26 | 3.33 |
| — | 1.94 | 1.94 | 1.94 | 1.94 | 1.93 | 1.93 | 1.93 | 1.93 | 1.93 | 1.93 | 1.92 | 1.92 |
| #5 | 3.40 | 3.47 | 3.54 | 3.61 | 3.68 | 3.75 | 3.82 | 3.90 | 3.97 | 4.04 | 4.11 | 4.18 |
| — | 1.92 | 1.92 | 1.92 | 1.92 | 1.92 | 1.92 | 1.91 | 1.91 | 1.91 | 1.91 | 1.91 | 1.91 |
| #6 | 4.25 | 4.32 | 4.39 | 4.46 | 4.53 | 4.60 | 4.68 | 4.75 | 4.82 | 4.89 | 4.96 | 5.03 |
| — | 1.91 | 1.91 | 1.91 | 1.91 | 1.91 | 1.91 | 1.91 | 1.91 | 1.91 | 1.91 | 1.91 | 1.91 |
| #7 | 5.10 | 5.17 | 5.24 | 5.31 | 5.38 | 5.45 | 5.53 | 5.60 | 5.67 | 5.74 | 5.81 | 5.88 |
| — | 1.91 | 1.91 | 1.91 | 1.91 | 1.91 | 1.91 | 1.92 | 1.92 | 1.92 | 1.92 | 1.92 | 1.92 |
| #8 | 5.95 | 6.02 | 6.09 | 6.16 | 6.23 | 6.31 | 6.38 | 6.45 | 6.52 | 6.59 | 6.66 | 6.73 |
| — | 1.92 | 1.92 | 1.93 | 1.93 | 1.93 | 1.93 | 1.93 | 1.93 | 1.93 | 1.93 | 1.93 | 1.94 |
| #9 | 6.80 | 6.87 | 6.94 | 7.01 | 7.08 | 7.15 | 7.23 | 7.30 | 7.37 | 7.44 | 7.51 | 7.58 |
| — | 1.94 | 1.94 | 1.94 | 1.94 | 1.94 | 1.94 | 1.94 | 1.93 | 1.93 | 1.93 | 1.93 | 1.93 |
| #10 | 7.65 | 7.72 | 7.79 | 7.86 | 7.93 | 8.00 | 8.08 | 8.15 | 8.22 | 8.29 | 8.36 | 8.43 |
| — | 1.93 | 1.93 | 1.92 | 1.92 | 1.92 | 1.91 | 1.91 | 1.91 | 1.90 | 1.90 | 1.89 | 1.89 |
| #11 | 8.50 | 8.57 | 8.64 | 8.71 | 8.79 | 8.86 | 8.93 | 9.00 | 9.07 | 9.14 | 9.21 | 9.28 |
| — | 1.88 | 1.88 | 1.87 | 1.87 | 1.86 | 1.85 | 1.85 | 1.84 | 1.83 | 1.83 | 1.82 | 1.81 |
| #12 | 9.35 | 9.42 | 9.50 | 9.57 | 9.64 | 9.71 | 9.78 | 9.85 | 9.92 | 9.99 | 10.06 | 10.14 |
| — | 1.80 | 1.80 | 1.79 | 1.78 | 1.78 | 1.77 | 1.76 | 1.75 | 1.75 | 1.74 | 1.73 | 1.72 |
| #13 | 10.21 | 10.28 | 10.35 | 10.42 | 10.49 | 10.56 | 10.64 | 10.71 | 10.78 | 10.85 | 10.92 | 10.99 |
| — | 1.72 | 1.71 | 1.70 | 1.70 | 1.69 | 1.68 | 1.68 | 1.67 | 1.66 | 1.66 | 1.65 | 1.65 |
| #14 | 11.06 | 11.13 | 11.21 | 11.28 | 11.35 | 11.42 | 11.49 | 11.56 | 11.63 | 11.71 | 11.78 | 11.85 |
| — | 1.64 | 1.64 | 1.64 | 1.63 | 1.63 | 1.62 | 1.62 | 1.62 | 1.62 | 1.61 | 1.61 | 1.61 |
| #15 | 11.92 | 11.99 | 12.06 | 12.13 | 12.21 | 12.28 | 12.35 | 12.42 | 12.49 | 12.56 | 12.64 | 12.71 |
| — | 1.61 | 1.61 | 1.61 | 1.61 | 1.61 | 1.61 | 1.61 | 1.61 | 1.61 | 1.61 | 1.61 | 1.61 |
| #16 | 12.78 | 12.85 | 12.92 | 12.99 | 13.06 | 13.14 | 13.21 | 13.28 | 13.35 | 13.42 | 13.49 | 13.56 |
| — | 1.62 | 1.62 | 1.62 | 1.62 | 1.63 | 1.63 | 1.63 | 1.63 | 1.64 | 1.64 | 1.64 | 1.64 |
| #17 | 13.64 | 13.71 | 13.78 | 13.85 | 13.92 | 13.99 | 14.06 | 14.13 | 14.21 | 14.28 | 14.35 | 14.42 |
| — | 1.65 | 1.65 | 1.65 | 1.66 | 1.66 | 1.66 | 1.66 | 1.67 | 1.67 | 1.67 | 1.67 | 1.67 |
| #18 | 14.49 | 14.56 | 14.63 | 14.71 | 14.78 | 14.85 | 14.92 | 14.99 | 15.06 | 15.13 | 15.20 | 15.28 |
| — | 1.68 | 1.68 | 1.68 | 1.68 | 1.68 | 1.68 | 1.68 | 1.68 | 1.68 | 1.68 | 1.68 | 1.68 |
| #19 | 15.35 | 15.42 | 15.49 | 15.56 | 15.63 | 15.70 | 15.78 | 15.85 | 15.92 | 15.99 | 16.06 | 16.13 |
| — | 1.68 | 1.67 | 1.67 | 1.67 | 1.67 | 1.67 | 1.66 | 1.66 | 1.66 | 1.66 | 1.65 | 1.65 |
| #20 | 16.20 | 16.28 | 16.35 | 16.42 | 16.49 | 16.56 | 16.63 | 16.70 | 16.77 | 16.85 | 16.92 | 16.99 |
| — | 1.65 | 1.65 | 1.64 | 1.64 | 1.64 | 1.63 | 1.63 | 1.63 | 1.63 | 1.62 | 1.62 | 1.62 |
| #21 | 17.06 | 17.13 | 17.20 | 17.28 | 17.35 | 17.42 | 17.49 | 17.56 | 17.63 | 17.70 | 17.78 | 17.85 |
| — | 1.62 | 1.62 | 1.62 | 1.62 | 1.62 | 1.62 | 1.62 | 1.62 | 1.62 | 1.62 | 1.62 | 1.62 |
| #22 | 17.92 | 17.99 | 18.06 | 18.13 | 18.20 | 18.28 | 18.35 | 18.42 | 18.49 | 18.56 | 18.63 | 18.70 |
| — | 1.63 | 1.63 | 1.63 | 1.64 | 1.64 | 1.65 | 1.66 | 1.66 | 1.67 | 1.68 | 1.69 | 1.70 |
| #23 | 18.77 | 18.85 | 18.92 | 18.99 | 19.06 | 19.13 | 19.20 | 19.27 | 19.34 | 19.41 | 19.49 | 19.56 |
| — | 1.71 | 1.72 | 1.73 | 1.74 | 1.75 | 1.76 | 1.78 | 1.79 | 1.80 | 1.82 | 1.83 | 1.85 |
| #24 | 19.63 | 19.70 | 19.77 | 19.84 | 19.91 | 19.98 | 20.05 | 20.12 | 20.19 | 20.26 | 20.34 | 20.41 |
| — | 1.87 | 1.88 | 1.90 | 1.92 | 1.93 | 1.95 | 1.97 | 1.99 | 2.01 | 2.02 | 2.04 | 2.06 |
| #25 | 20.48 | 20.55 | 20.62 | 20.69 | 20.76 | 20.83 | 20.90 | 20.97 | 21.04 | 21.11 | 21.18 | 21.25 |
| — | 2.08 | 2.10 | 2.12 | 2.13 | 2.15 | 2.17 | 2.19 | 2.20 | 2.22 | 2.24 | 2.25 | 2.27 |
| #26 | 21.32 | 21.39 | 21.46 | 21.53 | 21.60 | 21.67 | 21.74 | 21.81 | 21.88 | 21.95 | 22.02 | 22.09 |
| — | 2.28 | 2.29 | 2.31 | 2.32 | 2.33 | 2.34 | 2.35 | 2.36 | 2.37 | 2.38 | 2.39 | 2.39 |
| #27 | 22.16 | 22.23 | 22.30 | 22.37 | 22.44 | 22.51 | 22.58 | 22.65 | 22.72 | 22.79 | 22.86 | 22.93 |
| — | 2.40 | 2.40 | 2.41 | 2.41 | 2.41 | 2.41 | 2.41 | 2.41 | 2.41 | 2.41 | 2.40 | 2.40 |
| #28 | 23.00 | 23.07 | 23.14 | 23.21 | 23.28 | 23.35 | 23.42 | 23.49 | 23.56 | 23.63 | 23.70 | 23.77 |
| — | 2.40 | 2.39 | 2.39 | 2.38 | 2.37 | 2.37 | 2.36 | 2.35 | 2.34 | 2.34 | 2.33 | 2.32 |
| #29 | 23.84 | 23.91 | 23.98 | 24.05 | 24.12 | 24.19 | 24.26 | 24.34 | 24.41 | 24.48 | 24.55 | 24.62 |
| — | 2.31 | 2.30 | 2.30 | 2.29 | 2.28 | 2.27 | 2.27 | 2.26 | 2.25 | 2.25 | 2.24 | 2.23 |
| #30 | 24.69 | 24.76 | 24.83 | 24.90 | 24.97 | 25.04 | 26.11 | 25.18 | 25.25 | 25.32 | 25.39 | 25.46 |
| — | 2.23 | 2.23 | 2.22 | 2.22 | 2.22 | 2.21 | 2.21 | 2.21 | 2.21 | 2.21 | 2.22 | 2.22 |

TABLE 5

Center conductor widths (2/3)

| | | | | | | | | | | | | |
|---|---|---|---|---|---|---|---|---|---|---|---|---|
| #31 | 25.53 | 25.60 | 25.67 | 25.74 | 25.81 | 25.88 | 25.95 | 26.02 | 26.09 | 26.16 | 26.23 | 26.30 |
| — | 2.22 | 2.22 | 2.23 | 2.23 | 2.24 | 2.26 | 2.26 | 2.26 | 2.27 | 2.28 | 2.29 | 2.29 |
| #32 | 26.37 | 26.44 | 26.51 | 26.58 | 26.65 | 26.72 | 26.79 | 26.86 | 26.93 | 27.00 | 27.07 | 27.14 |
| — | 2.30 | 2.31 | 2.32 | 2.33 | 2.34 | 2.35 | 2.36 | 2.37 | 2.38 | 2.39 | 2.40 | 2.41 |

TABLE 5-continued

| Center conductor widths (2/3) | | | | | | | | | | | | |
|---|---|---|---|---|---|---|---|---|---|---|---|---|
| #33 | 27.21 | 27.28 | 27.35 | 27.42 | 27.49 | 27.56 | 27.63 | 27.70 | 27.77 | 27.84 | 27.91 | 27.98 |
| — | 2.42 | 2.42 | 2.43 | 2.43 | 2.44 | 2.44 | 2.44 | 2.44 | 2.44 | 2.44 | 2.43 | 2.43 |
| #34 | 28.05 | 28.12 | 28.19 | 28.26 | 28.33 | 28.40 | 28.47 | 28.54 | 28.61 | 28.69 | 28.76 | 28.83 |
| — | 2.42 | 2.41 | 2.40 | 2.39 | 2.37 | 2.35 | 2.33 | 2.31 | 2.29 | 2.26 | 2.24 | 2.21 |
| #35 | 28.90 | 28.97 | 29.04 | 29.11 | 29.18 | 29.25 | 29.32 | 29.39 | 29.46 | 29.53 | 29.60 | 29.68 |
| — | 2.18 | 2.14 | 2.11 | 2.07 | 2.03 | 1.99 | 1.95 | 1.91 | 1.87 | 1.82 | 1.77 | 1.73 |
| #36 | 29.75 | 29.82 | 29.89 | 29.96 | 30.03 | 30.10 | 30.18 | 30.25 | 30.32 | 30.39 | 30.47 | 30.54 |
| — | 1.68 | 1.63 | 1.56 | 1.53 | 1.49 | 1.44 | 1.39 | 1.34 | 1.29 | 1.24 | 1.19 | 1.15 |
| #37 | 30.61 | 30.68 | 30.76 | 30.83 | 30.90 | 30.98 | 31.05 | 31.12 | 31.20 | 31.27 | 31.34 | 31.42 |
| — | 1.10 | 1.06 | 1.01 | 0.97 | 0.93 | 0.89 | 0.85 | 0.81 | 0.77 | 0.74 | 0.71 | 0.67 |
| #38 | 31.49 | 31.57 | 31.64 | 31.71 | 31.79 | 31.86 | 31.94 | 32.01 | 32.09 | 32.16 | 32.24 | 32.31 |
| — | 0.64 | 0.62 | 0.59 | 0.56 | 0.54 | 0.52 | 0.50 | 0.48 | 0.46 | 0.45 | 0.43 | 0.42 |
| #39 | 32.39 | 32.46 | 32.54 | 32.61 | 32.69 | 32.76 | 32.84 | 32.91 | 32.99 | 33.06 | 33.14 | 33.21 |
| — | 0.41 | 0.40 | 0.39 | 0.38 | 0.37 | 0.37 | 0.36 | 0.36 | 0.36 | 0.36 | 0.36 | 0.37 |
| #40 | 33.29 | 33.36 | 33.43 | 33.51 | 33.58 | 33.66 | 33.73 | 33.81 | 33.88 | 33.96 | 34.03 | 34.11 |
| — | 0.37 | 0.38 | 0.38 | 0.39 | 0.40 | 0.41 | 0.43 | 0.44 | 0.46 | 0.48 | 0.50 | 0.53 |
| #41 | 34.18 | 34.26 | 34.33 | 34.40 | 34.48 | 34.55 | 34.62 | 34.70 | 34.77 | 34.84 | 34.92 | 34.99 |
| — | 0.56 | 0.59 | 0.62 | 0.65 | 0.69 | 0.74 | 0.78 | 0.83 | 0.88 | 0.94 | 1.00 | 1.07 |
| #42 | 35.06 | 35.13 | 35.21 | 35.28 | 35.35 | 35.42 | 35.49 | 35.56 | 35.64 | 35.71 | 35.78 | 35.85 |
| — | 1.14 | 1.21 | 1.29 | 1.37 | 1.46 | 1.56 | 1.65 | 1.76 | 1.87 | 1.98 | 2.10 | 2.22 |
| #43 | 35.92 | 35.99 | 36.06 | 36.13 | 36.20 | 36.27 | 36.33 | 36.40 | 36.47 | 36.54 | 36.61 | 36.68 |
| — | 2.35 | 2.48 | 2.62 | 2.76 | 2.91 | 3.06 | 3.22 | 3.38 | 3.64 | 3.71 | 3.88 | 4.05 |
| #44 | 36.74 | 36.81 | 36.88 | 36.95 | 37.01 | 37.08 | 37.15 | 37.21 | 37.28 | 37.35 | 37.41 | 37.48 |
| — | 4.23 | 4.40 | 4.58 | 4.76 | 4.93 | 5.11 | 5.28 | 5.46 | 5.63 | 5.79 | 5.95 | 6.10 |
| #45 | 37.55 | 37.61 | 37.68 | 37.75 | 37.81 | 37.88 | 37.94 | 38.01 | 38.08 | 38.14 | 38.21 | 38.27 |
| — | 6.25 | 6.39 | 6.52 | 6.65 | 6.76 | 6.86 | 6.95 | 7.03 | 7.09 | 7.15 | 7.18 | 7.21 |
| #46 | 38.34 | 38.41 | 38.47 | 38.54 | 38.60 | 38.67 | 38.74 | 38.80 | 38.87 | 38.93 | 39.00 | 39.07 |
| — | 7.22 | 7.22 | 7.20 | 7.17 | 7.12 | 7.06 | 6.99 | 6.91 | 6.81 | 6.70 | 6.53 | 6.45 |
| #47 | 39.13 | 39.20 | 39.27 | 39.33 | 39.40 | 39.47 | 39.53 | 39.60 | 39.67 | 39.74 | 39.80 | 39.87 |
| — | 6.31 | 6.16 | 6.00 | 5.84 | 5.67 | 5.50 | 5.32 | 5.14 | 4.95 | 4.76 | 4.58 | 4.30 |
| #48 | 39.94 | 40.01 | 40.07 | 40.14 | 40.21 | 40.28 | 40.35 | 40.42 | 40.49 | 40.56 | 40.63 | 40.70 |
| — | 4.20 | 4.02 | 3.83 | 3.65 | 3.47 | 3.30 | 3.13 | 2.96 | 2.80 | 2.64 | 2.48 | 2.33 |
| #49 | 40.77 | 40.84 | 40.91 | 40.98 | 41.05 | 41.12 | 41.20 | 41.27 | 41.34 | 41.41 | 41.49 | 41.56 |
| — | 2.19 | 2.05 | 1.92 | 1.79 | 1.67 | 1.55 | 1.44 | 1.34 | 1.24 | 1.15 | 1.06 | 0.97 |
| #50 | 41.63 | 41.70 | 41.78 | 41.85 | 41.93 | 42.00 | 42.07 | 42.15 | 42.22 | 42.30 | 42.37 | 42.45 |
| — | 0.90 | 0.82 | 0.76 | 0.70 | 0.64 | 0.58 | 0.54 | 0.49 | 0.45 | 0.41 | 0.38 | 0.35 |
| #51 | 42.52 | 42.60 | 42.67 | 42.75 | 42.83 | 42.90 | 42.98 | 43.05 | 43.13 | 43.20 | 43.28 | 43.36 |
| — | 0.32 | 0.30 | 0.27 | 0.25 | 0.24 | 0.22 | 0.21 | 0.20 | 0.18 | 0.18 | 0.17 | 0.16 |
| #52 | 43.43 | 43.51 | 43.58 | 43.66 | 43.74 | 43.81 | 43.89 | 43.96 | 44.04 | 44.12 | 44.19 | 44.27 |
| — | 0.16 | 0.15 | 0.15 | 0.15 | 0.14 | 0.14 | 0.14 | 0.15 | 0.15 | 0.15 | 0.16 | 0.16 |
| #53 | 44.34 | 44.42 | 44.50 | 44.57 | 44.65 | 44.72 | 44.80 | 44.87 | 44.95 | 45.02 | 45.10 | 45.17 |
| — | 0.17 | 0.18 | 0.18 | 0.19 | 0.21 | 0.22 | 0.23 | 0.25 | 0.27 | 0.29 | 0.32 | 0.34 |
| #54 | 45.25 | 45.32 | 45.40 | 45.47 | 45.55 | 45.62 | 45.70 | 45.77 | 45.84 | 45.92 | 45.99 | 46.06 |
| — | 0.37 | 0.40 | 0.44 | 0.47 | 0.52 | 0.56 | 0.61 | 0.66 | 0.72 | 0.78 | 0.85 | 0.92 |
| #55 | 46.14 | 46.21 | 46.28 | 46.36 | 46.43 | 46.50 | 46.57 | 46.64 | 46.71 | 46.78 | 46.86 | 46.93 |
| — | 0.99 | 1.07 | 1.15 | 1.24 | 1.33 | 1.43 | 1.53 | 1.63 | 1.74 | 1.85 | 1.97 | 2.09 |
| #56 | 47.00 | 47.07 | 47.14 | 47.21 | 47.28 | 47.34 | 47.41 | 47.48 | 47.55 | 47.62 | 47.69 | 47.76 |
| — | 2.22 | 2.34 | 2.47 | 2.60 | 2.74 | 2.88 | 3.02 | 3.16 | 3.30 | 3.44 | 3.58 | 3.72 |
| #57 | 47.83 | 47.89 | 47.96 | 48.03 | 48.10 | 48.16 | 48.23 | 48.30 | 48.37 | 48.43 | 48.50 | 48.57 |
| — | 3.86 | 4.00 | 4.14 | 4.27 | 4.40 | 4.53 | 4.65 | 4.77 | 4.88 | 4.98 | 5.08 | 5.18 |
| #58 | 48.63 | 48.70 | 48.77 | 48.84 | 48.90 | 48.97 | 49.04 | 49.10 | 49.17 | 49.24 | 49.30 | 49.37 |
| — | 5.26 | 5.34 | 5.40 | 5.46 | 5.51 | 5.55 | 5.59 | 5.61 | 5.62 | 5.62 | 5.62 | 5.60 |
| #59 | 49.44 | 49.50 | 49.57 | 49.64 | 49.70 | 49.77 | 49.84 | 49.91 | 49.97 | 50.04 | 50.11 | 50.17 |
| — | 5.58 | 5.54 | 5.50 | 5.45 | 5.39 | 5.32 | 5.25 | 5.17 | 5.09 | 5.00 | 4.90 | 4.80 |
| #60 | 50.24 | 50.31 | 50.38 | 50.44 | 50.51 | 50.58 | 50.65 | 50.72 | 50.79 | 50.85 | 50.92 | 50.99 |
| — | 4.69 | 4.59 | 4.47 | 4.36 | 4.25 | 4.13 | 4.01 | 3.89 | 3.78 | 3.66 | 3.54 | 3.42 |

TABLE 6

| Center conductor widths (3/3) | | | | | | | | | | | | |
|---|---|---|---|---|---|---|---|---|---|---|---|---|
| #61 | 51.06 | 51.13 | 51.20 | 51.27 | 51.34 | 51.41 | 51.48 | 51.54 | 51.61 | 51.68 | 51.76 | 51.83 |
| — | 3.31 | 3.20 | 3.08 | 2.98 | 2.87 | 2.76 | 2.66 | 2.56 | 2.47 | 2.37 | 2.28 | 2.20 |
| #62 | 51.90 | 51.97 | 52.04 | 52.11 | 52.18 | 52.25 | 52.32 | 52.39 | 52.46 | 52.54 | 52.61 | 52.68 |
| — | 2.11 | 2.03 | 1.95 | 1.88 | 1.81 | 1.74 | 1.67 | 1.61 | 1.55 | 1.50 | 1.45 | 1.40 |
| #63 | 52.75 | 52.82 | 52.90 | 52.97 | 53.04 | 53.11 | 53.19 | 53.26 | 53.33 | 53.40 | 53.48 | 53.55 |
| — | 1.35 | 1.31 | 1.26 | 1.23 | 1.19 | 1.16 | 1.13 | 1.10 | 1.07 | 1.05 | 1.02 | 1.00 |
| #64 | 53.62 | 53.70 | 53.77 | 53.84 | 53.92 | 53.99 | 54.06 | 54.14 | 54.21 | 54.28 | 54.36 | 54.43 |
| — | 0.99 | 0.97 | 0.96 | 0.94 | 0.93 | 0.93 | 0.92 | 0.91 | 0.91 | 0.91 | 0.90 | 0.90 |
| #65 | 54.50 | 54.57 | 54.65 | 54.72 | 54.79 | 54.87 | 54.94 | 55.01 | 55.09 | 55.16 | 55.23 | 55.31 |
| — | 0.91 | 0.91 | 0.91 | 0.92 | 0.93 | 0.93 | 0.94 | 0.95 | 0.96 | 0.97 | 0.99 | 1.00 |

TABLE 6-continued

| Center conductor widths (3/3) | | | | | | | | | | | | |
|---|---|---|---|---|---|---|---|---|---|---|---|---|
| #66 | 55.38 | 55.45 | 55.52 | 55.60 | 55.67 | 55.74 | 55.81 | 55.89 | 55.96 | 56.03 | 56.10 | 56.18 |
| — | 1.01 | 1.03 | 1.05 | 1.06 | 1.08 | 1.10 | 1.11 | 1.13 | 1.15 | 1.17 | 1.19 | 1.21 |
| #67 | 56.25 | 56.32 | 56.39 | 56.47 | 56.54 | 56.61 | 56.68 | 56.75 | 56.83 | 56.90 | 56.97 | 57.04 |
| — | 1.23 | 1.25 | 1.27 | 1.29 | 1.30 | 1.32 | 1.34 | 1.36 | 1.38 | 1.39 | 1.41 | 1.43 |
| #68 | 57.11 | 57.19 | 57.26 | 57.33 | 57.40 | 57.47 | 57.54 | 57.62 | 57.69 | 57.76 | 57.83 | 57.90 |
| — | 1.44 | 1.46 | 1.47 | 1.48 | 1.49 | 1.51 | 1.52 | 1.53 | 1.53 | 1.54 | 1.55 | 1.56 |
| #69 | 57.97 | 58.05 | 58.12 | 58.19 | 58.26 | 58.33 | 58.40 | 58.47 | 58.55 | 58.62 | 58.69 | 58.76 |
| — | 1.56 | 1.57 | 1.57 | 1.57 | 1.57 | 1.58 | 1.58 | 1.58 | 1.58 | 1.58 | 1.57 | 1.57 |
| #70 | 58.83 | 58.90 | 58.98 | 59.05 | 59.12 | 59.19 | 59.26 | 59.33 | 59.41 | 59.48 | 59.55 | 59.62 |
| — | 1.57 | 1.57 | 1.56 | 1.56 | 1.56 | 1.55 | 1.55 | 1.55 | 1.54 | 1.54 | 1.54 | 1.54 |
| #71 | 59.69 | 59.76 | 59.84 | 59.91 | 59.98 | 60.05 | 60.12 | 60.19 | 60.26 | 60.34 | 60.41 | 69.48 |
| — | 1.53 | 1.53 | 1.53 | 1.53 | 1.53 | 1.53 | 1.53 | 1.53 | 1.53 | 1.54 | 1.54 | 1.54 |
| #72 | 60.55 | 60.62 | 60.69 | 60.77 | 60.84 | 60.91 | 60.98 | 61.05 | 61.12 | 61.19 | 61.27 | 61.34 |
| — | 1.55 | 1.55 | 1.56 | 1.57 | 1.58 | 1.59 | 1.60 | 1.61 | 1.62 | 1.64 | 1.65 | 1.67 |
| #73 | 61.41 | 61.48 | 61.56 | 61.62 | 61.69 | 61.76 | 61.84 | 61.91 | 61.98 | 62.05 | 62.12 | 62.19 |
| — | 1.68 | 1.70 | 1.72 | 1.74 | 1.76 | 1.78 | 1.81 | 1.83 | 1.86 | 1.88 | 1.91 | 1.94 |
| #74 | 62.26 | 62.33 | 62.40 | 62.47 | 62.54 | 62.61 | 62.68 | 62.76 | 62.83 | 62.90 | 62.97 | 63.04 |
| — | 1.97 | 2.00 | 2.03 | 2.06 | 2.09 | 2.12 | 2.15 | 2.19 | 2.22 | 2.25 | 2.29 | 2.32 |
| #75 | 63.11 | 63.18 | 63.25 | 63.32 | 63.39 | 63.46 | 63.53 | 63.60 | 63.67 | 63.73 | 63.80 | 63.87 |
| — | 2.30 | 2.39 | 2.42 | 2.46 | 2.49 | 2.52 | 2.56 | 2.58 | 2.62 | 2.64 | 2.67 | 2.70 |
| #76 | 63.94 | 64.01 | 64.08 | 64.15 | 64.22 | 64.29 | 64.36 | 64.43 | 64.50 | 64.57 | 64.64 | 64.71 |
| — | 2.73 | 2.75 | 2.78 | 2.80 | 2.82 | 2.84 | 2.85 | 2.87 | 2.88 | 2.89 | 2.96 | 2.91 |
| #77 | 64.78 | 64.85 | 64.91 | 64.98 | 65.05 | 65.12 | 65.19 | 65.26 | 65.33 | 65.40 | 65.47 | 65.54 |
| — | 2.92 | 2.92 | 2.92 | 2.92 | 2.92 | 2.91 | 2.91 | 2.90 | 2.89 | 2.87 | 2.86 | 2.84 |
| #78 | 65.61 | 65.68 | 65.75 | 65.82 | 65.89 | 65.96 | 66.02 | 66.09 | 66.16 | 66.23 | 66.30 | 66.37 |
| — | 2.82 | 2.80 | 2.78 | 2.76 | 2.73 | 2.71 | 2.68 | 2.65 | 2.62 | 2.59 | 2.56 | 2.53 |
| #79 | 66.44 | 66.51 | 66.58 | 66.65 | 66.72 | 66.79 | 66.86 | 66.93 | 67.00 | 67.07 | 67.15 | 67.22 |
| — | 2.49 | 2.46 | 2.48 | 2.39 | 2.36 | 2.32 | 2.29 | 2.25 | 2.22 | 2.18 | 2.15 | 2.12 |
| #80 | 67.29 | 67.36 | 67.43 | 67.50 | 67.57 | 67.64 | 67.71 | 67.78 | 67.85 | 67.92 | 67.90 | 68.07 |
| — | 2.08 | 2.05 | 2.02 | 1.99 | 1.95 | 1.92 | 1.90 | 1.87 | 1.84 | 1.81 | 1.79 | 1.76 |
| #81 | 68.14 | 68.21 | 68.28 | 68.35 | 68.42 | 68.49 | 68.57 | 68.64 | 68.71 | 68.78 | 68.85 | 68.92 |
| — | 1.74 | 1.71 | 1.69 | 1.67 | 1.65 | 1.63 | 1.61 | 1.60 | 1.58 | 1.57 | 1.55 | 1.54 |
| #82 | 68.99 | 69.07 | 69.14 | 69.21 | 69.28 | 69.35 | 69.43 | 69.50 | 69.57 | 69.64 | 69.71 | 69.78 |
| — | 1.53 | 1.52 | 1.51 | 1.50 | 1.49 | 1.48 | 1.48 | 1.47 | 1.47 | 1.47 | 1.46 | 1.46 |
| #83 | 69.86 | 69.93 | 70.00 | 70.07 | 70.14 | 70.21 | 70.29 | 70.36 | 70.43 | 70.50 | 70.57 | 70.05 |
| — | 1.46 | 1.46 | 1.46 | 1.46 | 1.46 | 1.47 | 1.47 | 1.47 | 1.47 | 1.48 | 1.48 | 1.49 |
| #84 | 70.72 | 70.79 | 70.86 | 70.93 | 71.00 | | | | | | | |
| — | 1.49 | 1.50 | 1.50 | 1.51 | 1.51 | | | | | | | |

Figure 12:
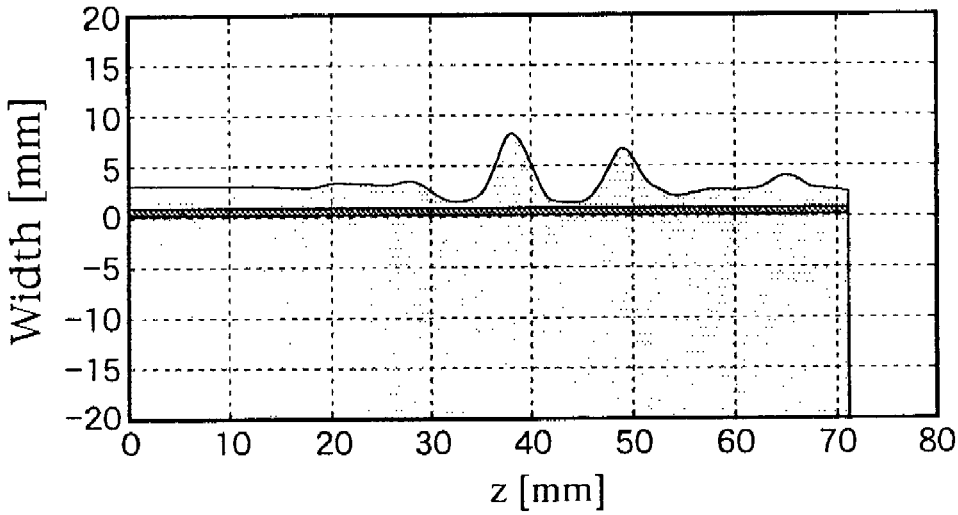
FIG. 12 is a graph showing a first shape for the micro-coplanar strip line in the reflection-type bandpass filter fabricated in Embodiment 2.
Figure 13:
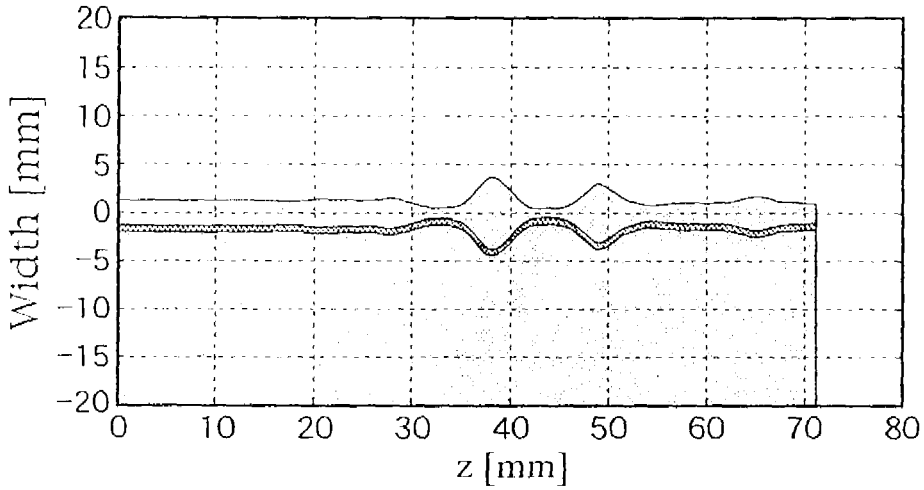
FIG. 13 is a graph showing a second shape for the micro-coplanar strip line in the reflection-type bandpass filter fabricated in Embodiment 2.

FIG. 12 and FIG. 13 show the shapes of two types of micro-coplanar strip lines in bandpass filters 1 fabricated in Embodiment 2. In FIG. 12, a micro-coplanar strip line is formed with the side edge 5*a* of the center conductor 5 and the side edge 7*a* of the side conductor 7 made straight lines, and with the side edge 5*b* of the center conductor 5 varied such that the center conductor width w takes on calculated values. In FIG. 13, a micro-coplanar strip line is formed with both side edges 5*a*, 5*b* of the center conductor 5 varied such that the center conductor width w takes on calculated values, and so as to change symmetrically with respect to the center line of the center conductor 5. In these figures, the lightly shaded portions represent the center conductor 5 and side conductor 7, and the darkly shaded lines represent the non-conducting portion 6. A non-reflecting terminator, or an R=50Ω resistance, is provided on the terminating side (the face at z=71 mm) of this reflection-type bandpass filter 1. The thicknesses of the metal films of the center conductor 5 and of the side conductor 7 are to be thick compared with the skin depth at f=1 GHz. For example, when using copper, the thickness of the center conductor 5 and of the side conductor 7 should be 2.1 μm or greater. The thickness of the ground layer 4 may be the same as or greater than the thicknesses of the center conductor 5 and side conductor 7. This bandpass filter 1 is used in a system with a characteristic impedance of 50Ω.

Figure 14:
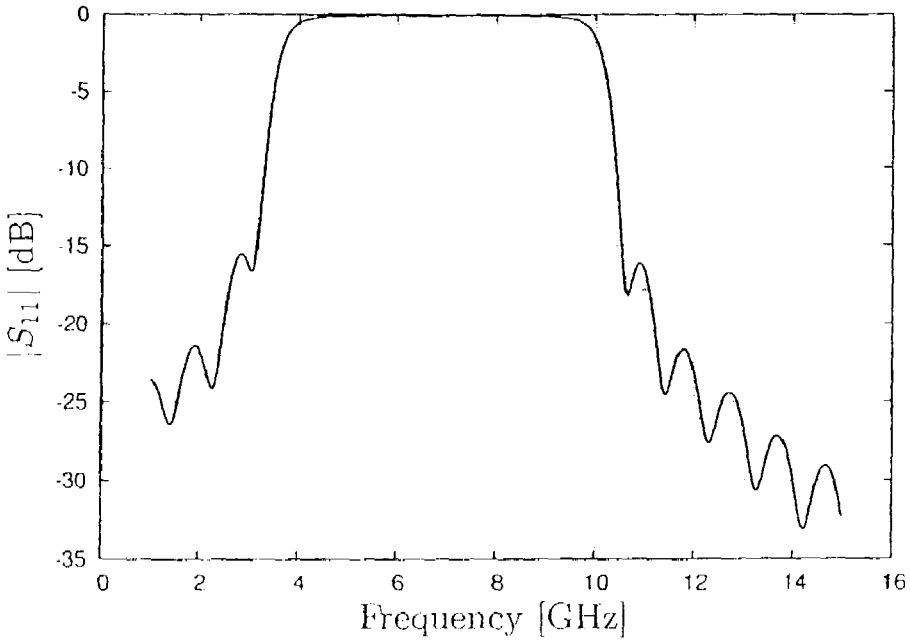
FIG. 14 is a graph showing the reflected wave amplitude characteristic in the reflection-type bandpass filter fabricated in Embodiment 2.
Figure 15:
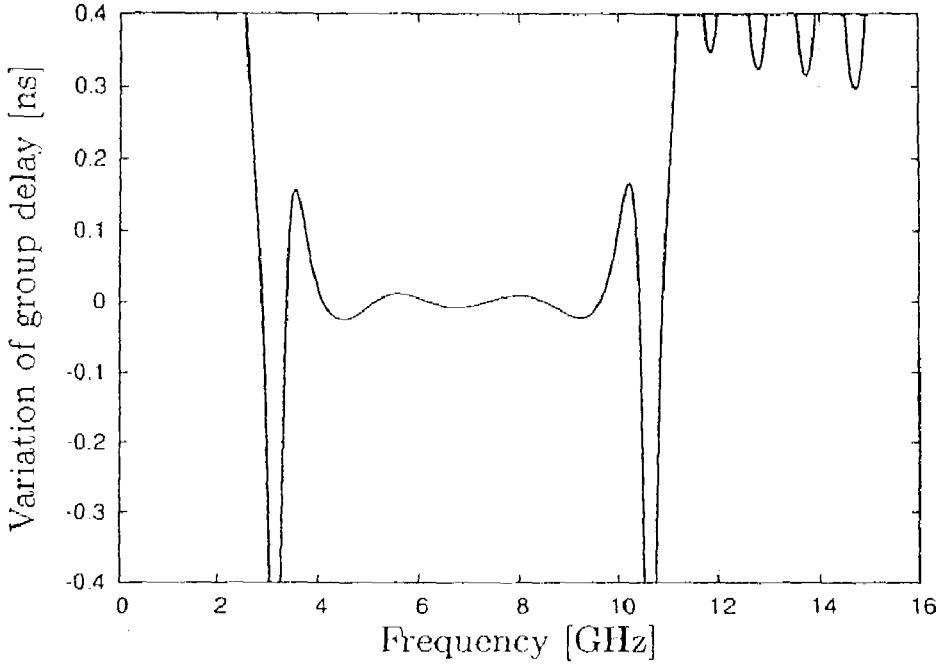
FIG. 15 is a graph showing the reflected wave group delay characteristic in the reflection-type bandpass filter fabricated in Embodiment 2.

FIG. 14 and FIG. 15 show the amplitude characteristic and group delay characteristic respectively of reflected waves ($S_{11}$) in bandpass filters of Embodiment 2. As shown in the figures, in the range of frequencies f for which 3.9 GHz≦f≦9.8 GHz, the reflectance is −1 dB or greater, and the group delay variation is within ±0.07 ns. In the region f<3.1 GHz or f>10.6 GHz, the reflectance is −15 dB or lower.

Embodiment 3

Figure 16:
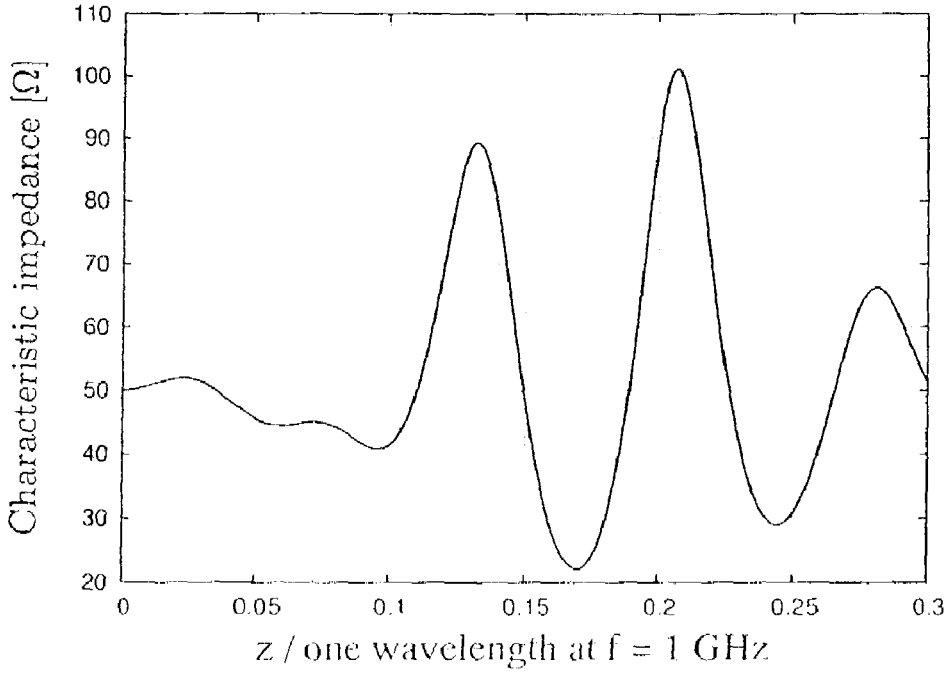
FIG. 16 is a graph showing the characteristic impedance distribution in the reflection-type bandpass filter fabricated in Embodiment 3.

A Kaiser window was used for which the reflectance is 1 at frequencies f in the range 3.7 GHz≦f≦10.1 GHz, and is 0 elsewhere, and for which A=30. Design was performed using 0.3 wavelength of signals at frequency f=1 GHz propagating in the micro-coplanar strip as the waveguide length, and setting the system characteristic impedance to 50Ω. FIG. 16 shows the distribution in the z-axis direction of the local characteristic impedance obtained in the inverse problem.

Figure 17:
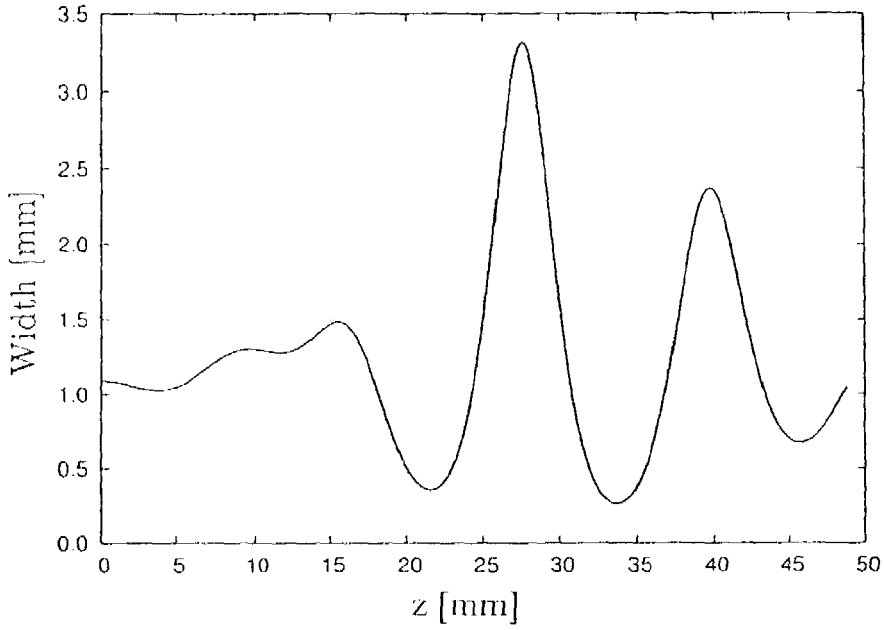
FIG. 17 is a graph showing the center conductor width distribution of micro-coplanar strip line in the reflection-type bandpass filter fabricated in Embodiment 3.

FIG. 17 shows the distribution in the z-axis direction of the center conductor width w, when using a dielectric layer 3 with a thickness h=0.5 mm and relative permittivity $\in_r$=4.2, and when the distance between conductors s=1 mm. Tables 7 and 8 list the center conductor widths w.

TABLE 7

Center conductor widths (1/2)

| | z[mm] | | | | | | | | | | | |
|---|---|---|---|---|---|---|---|---|---|---|---|---|
| | 0.00 | 0.10 | 0.20 | 0.29 | 0.39 | 0.49 | 0.59 | 0.68 | 0.78 | 0.88 | 0.98 | 1.07 |
| | w[mm] | | | | | | | | | | | |
| | 1.09 | 1.09 | 1.09 | 1.09 | 1.09 | 1.09 | 1.09 | 1.08 | 1.08 | 1.08 | 1.08 | 1.08 |
| #2 | 1.17 | 1.27 | 1.37 | 1.46 | 1.56 | 1.66 | 1.76 | 1.86 | 1.95 | 2.05 | 2.15 | 2.25 |
| — | 1.08 | 1.07 | 1.07 | 1.07 | 1.07 | 1.07 | 1.06 | 1.06 | 1.06 | 1.06 | 1.05 | 1.05 |
| #3 | 2.34 | 2.44 | 2.54 | 2.64 | 2.74 | 2.83 | 2.93 | 3.03 | 3.13 | 3.22 | 3.32 | 3.42 |
| — | 1.05 | 1.05 | 1.04 | 1.04 | 1.04 | 1.04 | 1.04 | 1.03 | 1.03 | 1.03 | 1.03 | 1.03 |
| #4 | 3.52 | 3.62 | 3.71 | 3.81 | 3.91 | 4.01 | 4.11 | 4.20 | 4.30 | 4.40 | 4.50 | 4.59 |
| — | 1.03 | 1.03 | 1.03 | 1.03 | 1.03 | 1.03 | 1.03 | 1.03 | 1.03 | 1.03 | 1.04 | 1.04 |
| #5 | 4.69 | 4.79 | 4.89 | 4.99 | 5.08 | 5.18 | 5.28 | 5.38 | 5.47 | 5.57 | 5.67 | 5.77 |
| — | 1.04 | 1.04 | 1.05 | 1.05 | 1.05 | 1.06 | 1.06 | 1.07 | 1.07 | 1.08 | 1.08 | 1.09 |
| #6 | 5.86 | 5.96 | 6.06 | 6.16 | 6.25 | 6.35 | 6.45 | 6.55 | 6.64 | 6.74 | 6.84 | 6.94 |
| — | 1.10 | 1.10 | 1.11 | 1.12 | 1.12 | 1.13 | 1.14 | 1.14 | 1.15 | 1.16 | 1.17 | 1.17 |
| #7 | 7.03 | 7.13 | 7.23 | 7.33 | 7.42 | 7.52 | 7.62 | 7.71 | 7.81 | 7.91 | 8.00 | 8.10 |
| — | 1.18 | 1.19 | 1.20 | 1.21 | 1.21 | 1.22 | 1.23 | 1.23 | 1.24 | 1.25 | 1.25 | 1.26 |
| #8 | 8.20 | 8.30 | 8.39 | 8.49 | 8.59 | 8.68 | 8.78 | 8.88 | 8.97 | 9.07 | 9.17 | 9.26 |
| — | 1.27 | 1.27 | 1.28 | 1.28 | 1.28 | 1.29 | 1.29 | 1.29 | 1.30 | 1.30 | 1.30 | 1.30 |
| #9 | 9.36 | 9.46 | 9.56 | 9.65 | 9.75 | 9.85 | 9.94 | 10.04 | 10.14 | 10.23 | 10.33 | 10.43 |
| — | 1.30 | 1.31 | 1.31 | 1.31 | 1.31 | 1.31 | 1.31 | 1.30 | 1.30 | 1.30 | 1.30 | 1.30 |
| #10 | 10.52 | 10.62 | 10.72 | 10.81 | 10.91 | 11.01 | 11.11 | 11.20 | 11.30 | 11.40 | 11.49 | 11.59 |
| — | 1.30 | 1.30 | 1.29 | 1.29 | 1.29 | 1.29 | 1.29 | 1.29 | 1.28 | 1.28 | 1.28 | 1.28 |
| #11 | 11.69 | 11.78 | 11.88 | 11.98 | 12.07 | 12.17 | 12.27 | 12.37 | 12.46 | 12.56 | 12.66 | 12.75 |
| — | 1.28 | 1.28 | 1.28 | 1.28 | 1.28 | 1.29 | 1.29 | 1.29 | 1.29 | 1.30 | 1.30 | 1.31 |
| #12 | 12.85 | 12.95 | 13.04 | 13.14 | 13.24 | 13.33 | 13.43 | 13.53 | 13.62 | 13.72 | 13.82 | 13.91 |
| — | 1.31 | 1.32 | 1.32 | 1.33 | 1.33 | 1.34 | 1.35 | 1.35 | 1.36 | 1.37 | 1.38 | 1.39 |
| #13 | 14.01 | 14.11 | 14.20 | 14.30 | 14.40 | 14.49 | 14.59 | 14.69 | 14.78 | 14.88 | 14.97 | 15.07 |
| — | 1.39 | 1.40 | 1.41 | 1.42 | 1.43 | 1.44 | 1.44 | 1.45 | 1.46 | 1.46 | 1.47 | 1.47 |
| #14 | 15.17 | 15.26 | 15.36 | 15.46 | 15.55 | 15.65 | 15.75 | 15.84 | 15.94 | 16.03 | 16.13 | 16.23 |
| — | 1.48 | 1.48 | 1.48 | 1.48 | 1.48 | 1.48 | 1.48 | 1.48 | 1.47 | 1.46 | 1.46 | 1.45 |
| #15 | 16.32 | 16.42 | 16.52 | 16.61 | 16.71 | 16.81 | 16.90 | 17.00 | 17.10 | 17.19 | 17.29 | 17.39 |
| — | 1.44 | 1.42 | 1.41 | 1.39 | 1.38 | 1.36 | 1.34 | 1.32 | 1.30 | 1.27 | 1.25 | 1.22 |
| #16 | 17.49 | 17.58 | 17.68 | 17.78 | 17.88 | 17.97 | 18.07 | 18.17 | 18.27 | 18.37 | 18.46 | 18.56 |
| — | 1.19 | 1.17 | 1.14 | 1.11 | 1.08 | 1.05 | 1.02 | 0.99 | 0.96 | 0.93 | 0.90 | 0.87 |
| #17 | 18.66 | 18.76 | 18.86 | 18.96 | 19.06 | 19.16 | 19.26 | 19.36 | 19.46 | 19.56 | 19.66 | 19.76 |
| — | 0.84 | 0.81 | 0.78 | 0.75 | 0.72 | 0.69 | 0.67 | 0.64 | 0.62 | 0.59 | 0.57 | 0.55 |
| #18 | 19.86 | 19.96 | 20.06 | 20.16 | 20.26 | 20.36 | 20.46 | 20.56 | 20.67 | 20.77 | 20.87 | 20.97 |
| — | 0.53 | 0.51 | 0.49 | 0.47 | 0.46 | 0.44 | 0.43 | 0.42 | 0.41 | 0.40 | 0.39 | 0.38 |
| #19 | 21.07 | 21.17 | 21.27 | 21.38 | 21.48 | 21.58 | 21.68 | 21.78 | 21.88 | 21.99 | 22.09 | 22.19 |
| — | 0.37 | 0.37 | 0.37 | 0.36 | 0.36 | 0.36 | 0.36 | 0.37 | 0.37 | 0.38 | 0.38 | 0.39 |
| #20 | 22.29 | 22.39 | 22.49 | 22.59 | 22.69 | 22.80 | 22.90 | 23.00 | 23.10 | 23.20 | 23.30 | 23.40 |
| — | 0.40 | 0.41 | 0.43 | 0.44 | 0.46 | 0.48 | 0.50 | 0.52 | 0.54 | 0.57 | 0.60 | 0.63 |
| #21 | 23.50 | 23.60 | 23.70 | 23.79 | 23.89 | 23.99 | 24.09 | 24.19 | 24.29 | 24.38 | 24.48 | 24.58 |
| — | 0.66 | 0.70 | 0.74 | 0.78 | 0.82 | 0.87 | 0.92 | 0.97 | 1.03 | 1.00 | 1.15 | 1.21 |
| #22 | 24.68 | 24.77 | 24.87 | 24.96 | 25.06 | 25.16 | 25.25 | 25.35 | 25.44 | 25.54 | 25.63 | 25.73 |
| — | 1.28 | 1.35 | 1.42 | 1.49 | 1.57 | 1.65 | 1.73 | 1.81 | 1.89 | 1.98 | 2.07 | 2.16 |
| #23 | 25.82 | 25.92 | 26.01 | 26.11 | 26.20 | 26.29 | 26.39 | 26.48 | 26.58 | 26.67 | 26.76 | 25.86 |
| — | 2.24 | 2.33 | 2.42 | 2.50 | 2.59 | 2.67 | 2.75 | 2.83 | 2.90 | 2.97 | 3.03 | 3.09 |
| #24 | 26.95 | 27.04 | 27.14 | 27.23 | 27.32 | 27.42 | 27.51 | 27.60 | 27.70 | 27.79 | 27.88 | 27.98 |
| — | 3.14 | 3.19 | 3.23 | 3.26 | 3.29 | 3.31 | 3.32 | 3.32 | 3.31 | 3.30 | 3.27 | 3.24 |
| #25 | 28.07 | 28.16 | 28.26 | 28.35 | 28.44 | 28.54 | 28.63 | 28.72 | 28.82 | 28.91 | 29.01 | 29.10 |
| — | 3.21 | 3.16 | 3.11 | 3.05 | 2.99 | 2.92 | 2.85 | 2.77 | 2.69 | 2.61 | 2.52 | 2.43 |
| #26 | 29.20 | 29.29 | 29.39 | 29.48 | 29.58 | 29.67 | 29.77 | 29.86 | 29.96 | 30.05 | 30.15 | 30.25 |
| — | 2.34 | 2.25 | 2.16 | 2.07 | 1.98 | 1.89 | 1.80 | 1.71 | 1.63 | 1.55 | 1.47 | 1.30 |
| #27 | 30.34 | 30.44 | 30.54 | 30.64 | 30.73 | 30.83 | 30.93 | 32.03 | 32.13 | 31.23 | 31.33 | 31.43 |
| — | 1.31 | 1.24 | 1.17 | 1.10 | 1.04 | 0.98 | 0.92 | 0.86 | 0.81 | 0.76 | 0.72 | 0.67 |
| #28 | 31.53 | 31.63 | 31.73 | 31.83 | 31.93 | 31.03 | 31.13 | 32.23 | 32.33 | 32.43 | 32.53 | 32.64 |
| — | 0.63 | 0.59 | 0.56 | 0.52 | 0.49 | 0.46 | 0.44 | 0.41 | 0.39 | 0.37 | 0.35 | 0.34 |
| #29 | 32.74 | 32.84 | 32.94 | 33.05 | 33.15 | 33.25 | 33.35 | 33.46 | 33.56 | 33.66 | 33.76 | 33.87 |
| — | 0.32 | 0.31 | 0.30 | 0.29 | 0.28 | 0.28 | 0.27 | 0.27 | 0.27 | 0.27 | 0.27 | 0.27 |
| #30 | 33.97 | 34.07 | 34.17 | 34.28 | 34.38 | 34.48 | 34.58 | 34.68 | 34.79 | 34.89 | 34.99 | 35.09 |
| — | 0.27 | 0.27 | 0.28 | 0.29 | 0.30 | 0.31 | 0.32 | 0.33 | 0.34 | 0.36 | 0.38 | 0.40 |

TABLE 8

Center conductor widths(2/2)

| | | | | | | | | | | | | |
|---|---|---|---|---|---|---|---|---|---|---|---|---|
| #31 | 35.19 | 35.29 | 35.39 | 35.49 | 35.60 | 35.70 | 35.80 | 35.90 | 36.00 | 36.09 | 36.19 | 36.29 |
| — | 0.42 | 0.44 | 0.46 | 0.49 | 0.52 | 0.55 | 0.58 | 0.62 | 0.65 | 0.69 | 0.73 | 0.77 |
| #32 | 36.39 | 36.49 | 36.59 | 36.69 | 36.78 | 36.88 | 36.98 | 37.08 | 37.17 | 37.27 | 37.37 | 37.46 |
| — | 0.82 | 0.86 | 0.91 | 0.95 | 1.01 | 1.06 | 1.12 | 1.17 | 1.23 | 1.29 | 1.34 | 1.40 |

TABLE 8-continued

| Center conductor widths(2/2) | | | | | | | | | | | | |
|---|---|---|---|---|---|---|---|---|---|---|---|---|
| #33 | 37.56 | 37.06 | 37.75 | 37.85 | 37.94 | 38.04 | 38.14 | 38.23 | 38.33 | 38.42 | 38.52 | 38.01 |
| — | 1.46 | 1.52 | 1.58 | 1.64 | 1.70 | 1.76 | 1.81 | 1.87 | 1.92 | 1.98 | 2.03 | 2.07 |
| #34 | 38.71 | 38.80 | 38.90 | 38.99 | 39.09 | 39.18 | 39.27 | 39.37 | 39.40 | 39.50 | 39.65 | 39.75 |
| — | 2.12 | 2.16 | 2.20 | 2.23 | 2.26 | 2.29 | 2.31 | 2.33 | 2.35 | 2.36 | 2.36 | 2.36 |
| #35 | 39.84 | 39.94 | 40.03 | 40.13 | 40.22 | 40.31 | 40.41 | 40.50 | 40.60 | 40.69 | 40.79 | 40.88 |
| — | 2.36 | 2.36 | 2.35 | 2.33 | 2.31 | 2.20 | 2.27 | 2.24 | 2.20 | 2.17 | 2.13 | 2.09 |
| #36 | 40.98 | 41.07 | 41.17 | 41.26 | 41.36 | 41.45 | 41.55 | 41.65 | 41.74 | 41.84 | 41.93 | 42.03 |
| — | 2.05 | 2.01 | 1.97 | 1.92 | 1.88 | 1.83 | 1.78 | 1.73 | 1.68 | 1.64 | 1.59 | 1.54 |
| #37 | 42.13 | 42.22 | 42.32 | 42.42 | 42.51 | 42.61 | 42.71 | 42.80 | 42.90 | 43.00 | 43.10 | 43.19 |
| — | 1.50 | 1.45 | 1.41 | 1.35 | 1.32 | 1.28 | 1.24 | 1.20 | 1.16 | 1.12 | 1.00 | 1.06 |
| #38 | 43.29 | 43.39 | 43.49 | 43.59 | 43.63 | 43.78 | 43.88 | 43.98 | 44.08 | 44.18 | 44.28 | 44.38 |
| — | 1.02 | 0.99 | 0.96 | 0.94 | 0.91 | 0.89 | 0.86 | 0.84 | 0.82 | 0.80 | 0.79 | 0.77 |
| #39 | 44.47 | 44.57 | 44.67 | 44.77 | 44.87 | 44.97 | 45.07 | 45.17 | 45.27 | 45.37 | 45.47 | 45.57 |
| — | 0.75 | 0.74 | 0.73 | 0.72 | 0.71 | 0.70 | 0.69 | 0.69 | 0.68 | 0.68 | 0.68 | 0.68 |
| #40 | 45.67 | 45.77 | 45.87 | 45.97 | 45.07 | 46.17 | 46.26 | 46.36 | 46.46 | 46.56 | 46.66 | 46.76 |
| — | 0.68 | 0.68 | 0.68 | 0.68 | 0.68 | 0.69 | 0.69 | 0.70 | 0.71 | 0.71 | 0.72 | 0.73 |
| #41 | 46.80 | 46.96 | 47.06 | 47.10 | 47.26 | 47.36 | 47.45 | 47.55 | 47.65 | 47.75 | 47.85 | 47.95 |
| — | 0.74 | 0.75 | 0.77 | 0.78 | 0.79 | 0.80 | 0.82 | 0.83 | 0.85 | 0.89 | 0.88 | 0.90 |
| #42 | 48.05 | 48.14 | 48.24 | 48.34 | 48.44 | 48.54 | 48.63 | 48.73 | 48.83 | | | |
| — | 0.91 | 0.93 | 0.95 | 0.96 | 0.98 | 1.00 | 1.01 | 1.03 | 1.05 | | | |

Figure 18:
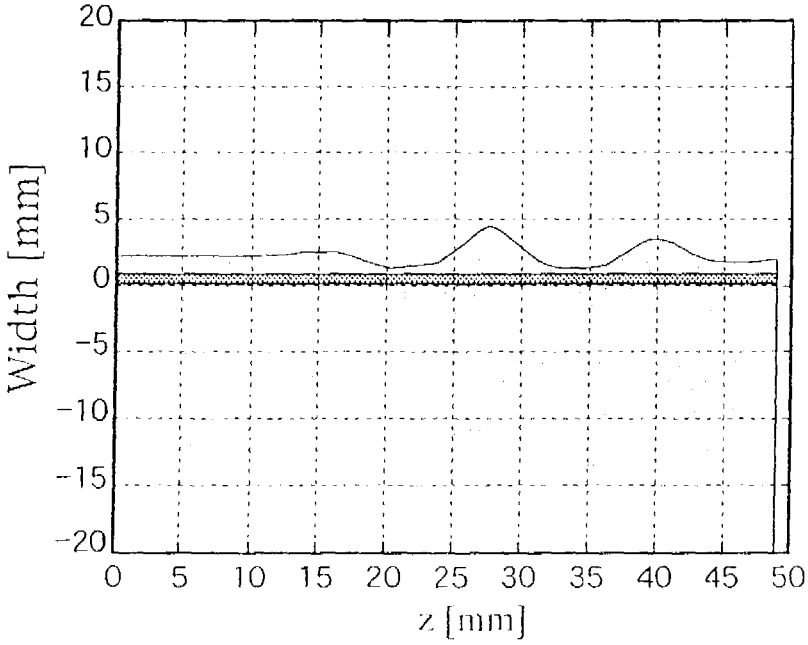
FIG. 18 is a graph showing a first shape for the micro-coplanar strip line in the reflection-type bandpass filter fabricated in Embodiment 3.
Figure 19:
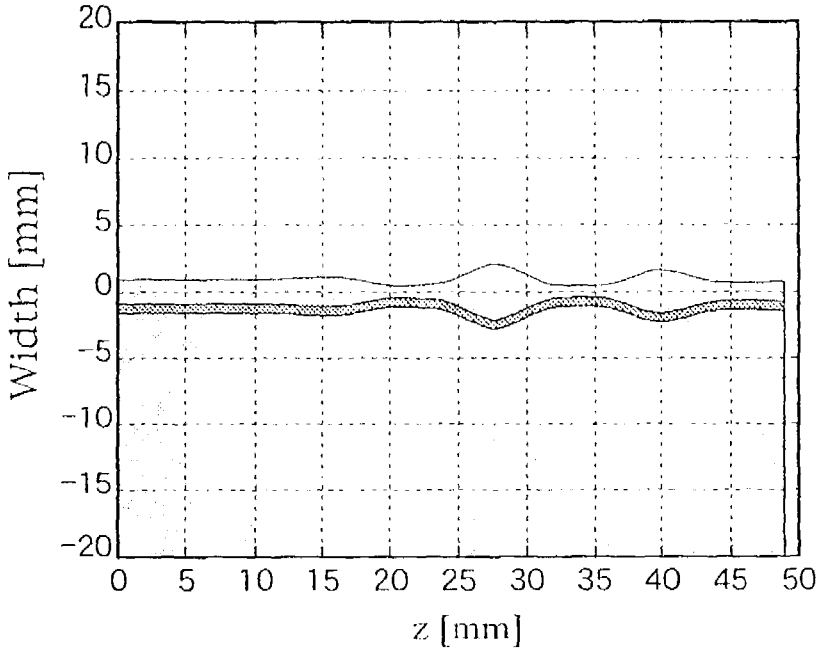
FIG. 19 is a graph showing a second shape for the micro-coplanar strip line in the reflection-type bandpass filter fabricated in Embodiment 3.

FIG. 18 and FIG. 19 show the shapes of two types of micro-coplanar strip lines in bandpass filters 1 fabricated in Embodiment 3. In FIG. 18, a micro-coplanar strip line is formed with the side edge 5*a* of the center conductor 5 and the side edge 7*a* of the side conductor 7 made straight lines, and with the side edge 5*b* of the center conductor 5 varied such that the center conductor width w takes on calculated values. In FIG. 19, a micro-coplanar strip line is formed with both side edges 5*a*, 5*b* of the center conductor 5 varied such that the center conductor width w takes on calculated values, and so as to change symmetrically with respect to the center line of the center conductor 5. In these figures, the lightly shaded portions represent the center conductor 5 and side conductor 7, and the darkly shaded lines represent the non-conducting portion 6. A non-reflecting terminator, or an R=50Ω resistance, is provided on the terminating side (the face at z=48.83 mm) of this reflection-type bandpass filter 1. The thicknesses of the metal films of the center conductor 5 and of the side conductor 7 may be thick compared with the skin depth at f=1 GHz. For example, when using copper, the thickness of the center conductor 5 and of the side conductor 7 may be 2.1 μm or greater. The thickness of the ground layer 4 may be the same as or greater than the thicknesses of the center conductor 5 and side conductor 7. This bandpass filter 1 is used in a system with a characteristic impedance of 50Ω.

Figure 20:
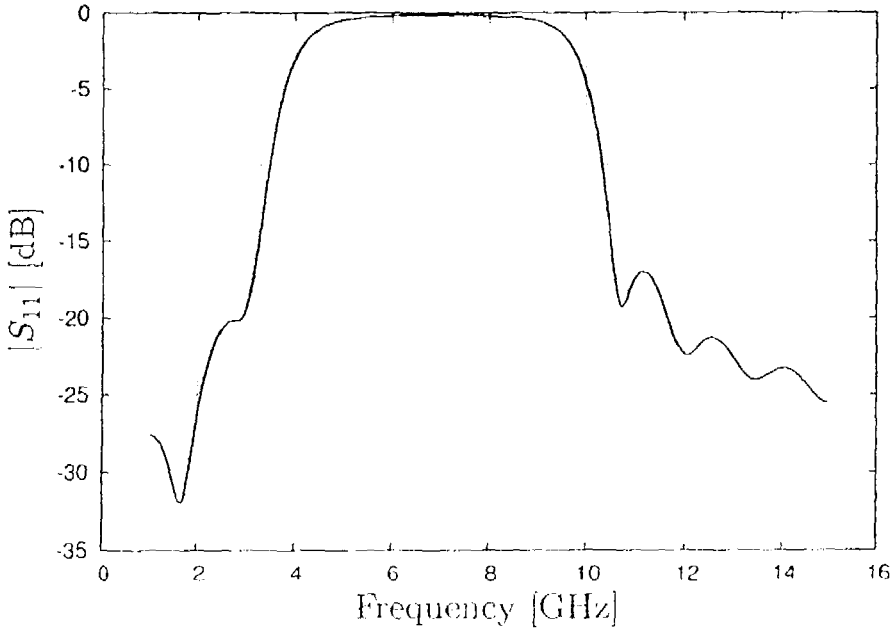
FIG. 20 is a graph showing the reflected wave amplitude characteristic in the reflection-type bandpass filter fabricated in Embodiment 3.
Figure 21:
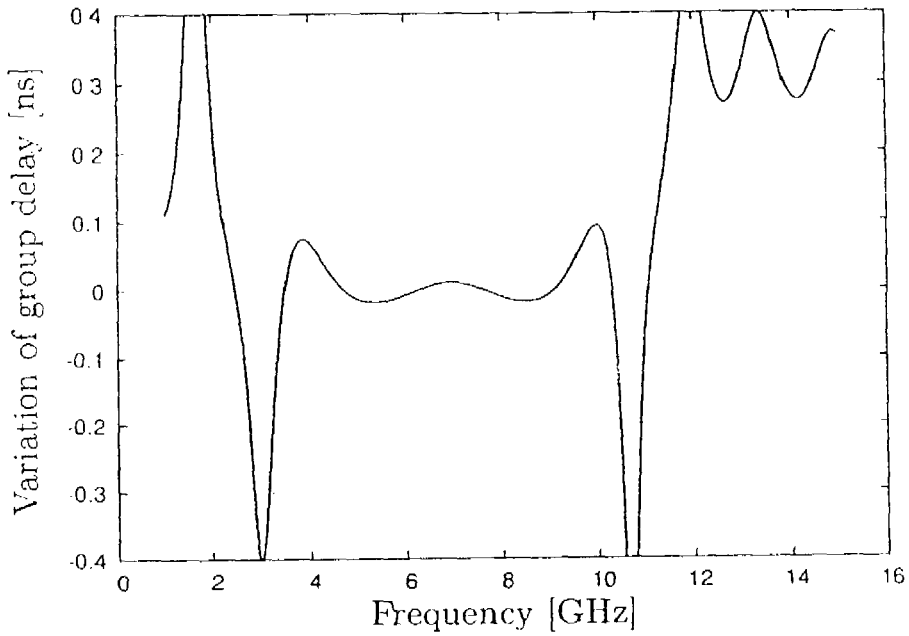
FIG. 21 is a graph showing the reflected wave group delay characteristic in the reflection-type bandpass filter fabricated in Embodiment 3.

FIG. 20 and FIG. 21 show the amplitude characteristic and group delay characteristic respectively of reflected waves ($S_{11}$) in bandpass filters of Embodiment 3. As shown in the figures, in the range of frequencies f for which 4.5 GHz≦f≦9.4 GHz, the reflectance is −2 dB or greater, and the group delay variation is within ±0.07 ns. In the region f<3.1 GHz or f>10.6 GHz, the reflectance is −15 dB or lower.

Embodiment 4

Figure 22:
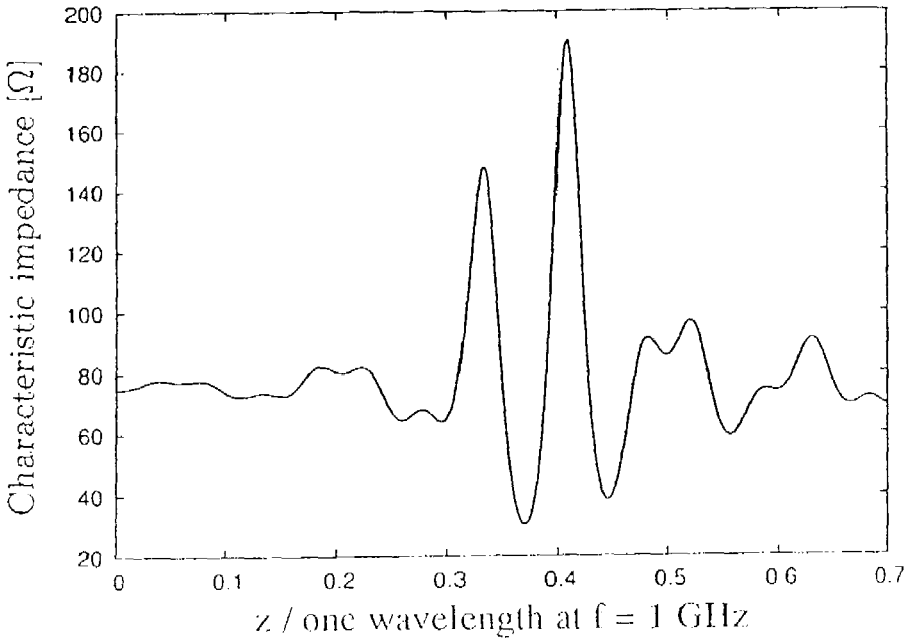
FIG. 22 is a graph showing the characteristic impedance distribution in the reflection-type bandpass filter fabricated in Embodiment 4.

A Kaiser window was used for which the reflectance is 1 at frequencies f in the range 3.4 GHz≦f≦10.3 GHz, and is 0 elsewhere, and for which A=30. Design was performed using 0.7 wavelength of signals at frequency f=1 GHz propagating in the micro-coplanar strip as the waveguide length, and setting the system characteristic impedance to 75Ω. FIG. 22 shows the distribution in the z-axis direction of the local characteristic impedance obtained in the inverse problem.

Figure 23:
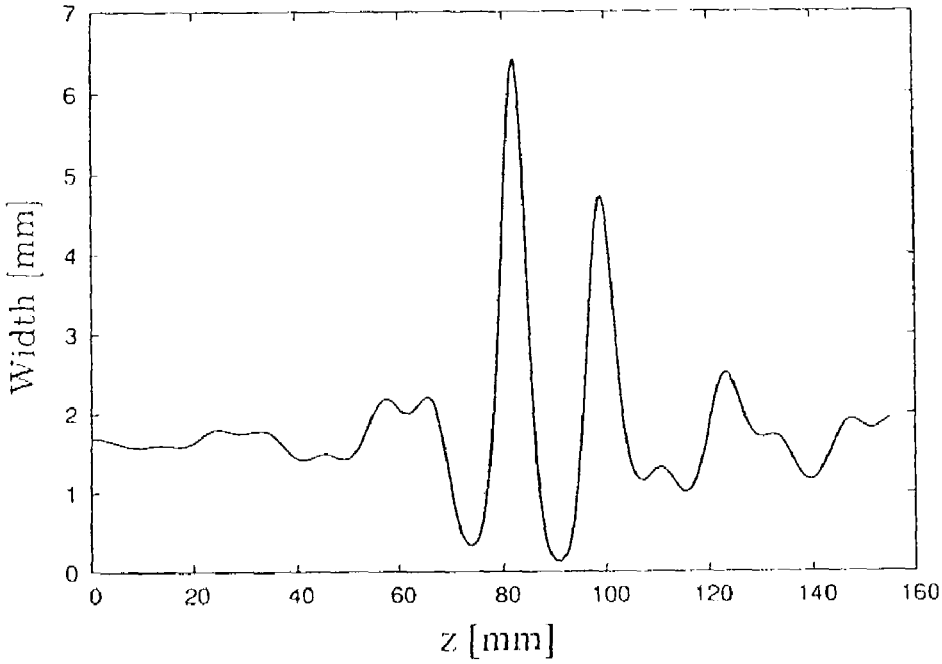
FIG. 23 is a graph showing the center conductor width distribution of micro-coplanar strip line in the reflection-type bandpass filter fabricated in Embodiment 4.

FIG. 23 shows the distribution in the z-axis direction of the center conductor width w, when using a dielectric layer 3 with a thickness h=1 mm and relative permittivity $\in_r$=2.2, and when the distance between conductors s=1 mm. Tables 9 through 11 list the center conductor widths w.

TABLE 9

| Center conductor widths (1/3) | | | | | | | | | | | | |
|---|---|---|---|---|---|---|---|---|---|---|---|---|
| | z[mm] | | | | | | | | | | | |
| | 0.00 | 0.15 | 0.31 | 0.46 | 0.62 | 0.77 | 0.93 | 1.08 | 1.24 | 1.39 | 1.55 | 1.70 |
| | w[mm] | | | | | | | | | | | |
| | 1.69 | 1.69 | 1.69 | 1.69 | 1.69 | 1.69 | 1.69 | 1.69 | 1.69 | 1.69 | 1.69 | 1.69 |
| #2 | 1.86 | 2.01 | 2.17 | 2.33 | 2.48 | 2.64 | 2.70 | 2.95 | 3.10 | 3.26 | 3.41 | 3.57 |
| — | 1.69 | 1.68 | 1.68 | 1.68 | 1.68 | 1.68 | 1.68 | 1.67 | 1.67 | 1.67 | 1.67 | 1.66 |
| #3 | 3.72 | 3.88 | 4.03 | 4.19 | 4.34 | 4.50 | 4.65 | 4.81 | 4.96 | 5.12 | 5.27 | 5.43 |
| — | 1.66 | 1.66 | 1.65 | 1.65 | 1.65 | 1.64 | 1.64 | 1.63 | 1.63 | 1.63 | 1.62 | 1.62 |
| #4 | 5.58 | 5.74 | 5.89 | 6.05 | 6.20 | 6.36 | 6.51 | 6.67 | 6.82 | 6.98 | 7.13 | 7.29 |
| — | 1.62 | 1.61 | 1.61 | 1.61 | 1.60 | 1.60 | 1.60 | 1.59 | 1.59 | 1.59 | 1.59 | 1.58 |
| #5 | 7.45 | 7.60 | 7.76 | 7.91 | 8.07 | 8.22 | 8.38 | 8.53 | 8.69 | 8.84 | 9.00 | 9.15 |
| — | 1.58 | 1.58 | 1.58 | 1.58 | 1.58 | 1.57 | 1.57 | 1.57 | 1.57 | 1.57 | 1.57 | 1.57 |
| #6 | 9.31 | 9.46 | 9.62 | 9.77 | 9.93 | 10.09 | 10.24 | 10.40 | 10.55 | 10.71 | 10.86 | 11.02 |
| — | 1.57 | 1.57 | 1.58 | 1.58 | 1.58 | 1.58 | 1.58 | 1.58 | 1.58 | 1.58 | 1.59 | 1.59 |

TABLE 9-continued

| | Center conductor widths (1/3) z[mm] | | | | | | | | | | | |
|---|---|---|---|---|---|---|---|---|---|---|---|---|
| | 0.00 | 0.15 | 0.31 | 0.46 | 0.62 | 0.77 | 0.93 | 1.08 | 1.24 | 1.39 | 1.55 | 1.70 |
| | w[mm] | | | | | | | | | | | |
| | 1.69 | 1.69 | 1.69 | 1.69 | 1.69 | 1.69 | 1.69 | 1.69 | 1.69 | 1.69 | 1.69 | 1.69 |
| #7 | 11.17 | 11.33 | 11.48 | 11.64 | 11.79 | 11.95 | 12.10 | 12.26 | 12.41 | 12.57 | 12.72 | 12.88 |
| — | 1.59 | 1.59 | 1.59 | 1.59 | 1.59 | 1.60 | 1.60 | 1.60 | 1.60 | 1.60 | 1.60 | 1.60 |
| #8 | 13.04 | 13.19 | 13.35 | 13.50 | 13.66 | 13.81 | 13.97 | 14.12 | 14.28 | 14.48 | 14.59 | 14.74 |
| — | 1.60 | 1.60 | 1.60 | 1.60 | 1.60 | 1.60 | 1.60 | 1.63 | 1.60 | 1.60 | 1.60 | 1.60 |
| #9 | 14.90 | 15.05 | 15.21 | 15.36 | 15.52 | 15.67 | 15.83 | 15.99 | 16.14 | 16.30 | 16.45 | 16.61 |
| — | 1.59 | 1.59 | 1.59 | 1.59 | 1.50 | 1.59 | 1.59 | 1.59 | 1.59 | 1.59 | 1.58 | 1.58 |
| #10 | 16.76 | 16.92 | 17.07 | 17.23 | 17.38 | 17.54 | 17.69 | 17.85 | 18.00 | 18.16 | 18.31 | 18.47 |
| — | 1.58 | 1.58 | 1.58 | 1.58 | 1.58 | 1.59 | 1.59 | 1.59 | 1.59 | 1.50 | 1.59 | 1.60 |
| #11 | 18.62 | 18.78 | 18.94 | 19.09 | 19.26 | 19.40 | 19.56 | 19.71 | 19.87 | 20.02 | 20.18 | 20.33 |
| — | 1.60 | 1.60 | 1.61 | 1.61 | 1.62 | 1.62 | 1.62 | 1.63 | 1.64 | 1.64 | 1.65 | 1.65 |
| #12 | 20.40 | 20.64 | 20.80 | 20.95 | 21.11 | 21.20 | 21.42 | 21.57 | 21.73 | 21.88 | 22.04 | 22.19 |
| — | 1.65 | 1.67 | 1.67 | 1.68 | 1.60 | 1.69 | 1.70 | 1.71 | 1.71 | 1.72 | 1.73 | 1.73 |
| #13 | 22.35 | 22.50 | 22.66 | 22.81 | 22.97 | 23.12 | 23.28 | 23.43 | 23.58 | 23.74 | 23.89 | 24.05 |
| — | 1.74 | 1.75 | 1.75 | 1.75 | 1.76 | 1.77 | 1.77 | 1.78 | 1.78 | 1.78 | 1.79 | 1.79 |
| #14 | 24.20 | 24.36 | 24.51 | 24.67 | 24.82 | 24.98 | 25.13 | 25.29 | 25.44 | 25.60 | 25.75 | 25.91 |
| — | 1.79 | 1.79 | 1.80 | 1.80 | 1.80 | 1.80 | 1.80 | 1.80 | 1.80 | 1.80 | 1.79 | 1.79 |
| #15 | 26.06 | 26.21 | 26.37 | 26.52 | 26.68 | 26.83 | 26.99 | 27.14 | 27.30 | 27.45 | 27.61 | 27.76 |
| — | 1.79 | 1.79 | 1.79 | 1.78 | 1.78 | 1.78 | 1.78 | 1.77 | 1.77 | 1.77 | 1.76 | 1.76 |
| #16 | 27.92 | 28.07 | 28.23 | 28.38 | 28.54 | 28.69 | 28.85 | 29.00 | 29.16 | 29.31 | 29.47 | 29.62 |
| — | 1.76 | 1.76 | 1.76 | 1.75 | 1.75 | 1.75 | 1.75 | 1.75 | 1.75 | 1.75 | 1.75 | 1.75 |
| #17 | 29.78 | 29.93 | 30.08 | 30.24 | 30.39 | 30.56 | 30.70 | 30.86 | 31.01 | 31.17 | 31.32 | 31.48 |
| — | 1.75 | 1.75 | 1.75 | 1.75 | 1.75 | 1.75 | 1.76 | 1.75 | 1.76 | 1.76 | 1.77 | 1.77 |
| #18 | 31.63 | 31.79 | 31.94 | 32.10 | 32.25 | 32.41 | 32.56 | 32.72 | 32.87 | 33.03 | 33.18 | 33.34 |
| — | 1.77 | 1.77 | 1.77 | 1.78 | 1.78 | 1.78 | 1.78 | 1.78 | 1.78 | 1.78 | 1.78 | 1.78 |
| #19 | 33.49 | 33.64 | 33.80 | 33.95 | 34.11 | 34.26 | 34.42 | 34.57 | 34.73 | 34.88 | 35.04 | 35.19 |
| — | 1.78 | 1.78 | 1.78 | 1.78 | 1.77 | 1.77 | 1.76 | 1.76 | 1.75 | 1.75 | 1.74 | 1.73 |
| #20 | 35.35 | 35.50 | 35.66 | 35.81 | 35.97 | 36.12 | 36.28 | 36.43 | 36.59 | 36.74 | 36.90 | 37.05 |
| — | 1.73 | 1.72 | 1.71 | 1.70 | 1.69 | 1.68 | 1.67 | 1.66 | 1.65 | 1.64 | 1.62 | 1.61 |
| #21 | 37.21 | 37.36 | 37.52 | 37.67 | 37.83 | 37.99 | 38.14 | 38.36 | 38.45 | 38.61 | 38.76 | 38.92 |
| — | 1.60 | 1.59 | 1.58 | 1.57 | 1.55 | 1.54 | 1.53 | 1.52 | 1.51 | 1.50 | 1.49 | 1.48 |
| #22 | 39.07 | 39.23 | 39.39 | 39.84 | 38.70 | 39.85 | 40.01 | 40.16 | 40.32 | 40.48 | 40.63 | 40.79 |
| — | 1.48 | 1.47 | 1.46 | 1.45 | 1.45 | 1.44 | 1.44 | 1.43 | 1.43 | 1.43 | 1.42 | 1.42 |
| #23 | 40.94 | 41.10 | 41.25 | 41.41 | 41.57 | 41.72 | 41.88 | 42.03 | 42.19 | 42.34 | 42.50 | 42.66 |
| — | 1.42 | 1.42 | 1.42 | 1.42 | 1.42 | 1.42 | 1.43 | 1.43 | 1.43 | 1.43 | 1.44 | 1.44 |
| #24 | 42.81 | 42.97 | 43.12 | 43.28 | 43.43 | 43.59 | 43.75 | 43.90 | 44.06 | 44.21 | 44.37 | 44.52 |
| — | 1.44 | 1.45 | 1.45 | 1.46 | 1.46 | 1.47 | 1.47 | 1.47 | 1.48 | 1.48 | 1.48 | 1.49 |
| #25 | 44.68 | 44.83 | 44.99 | 45.15 | 45.30 | 45.46 | 45.61 | 45.77 | 45.92 | 46.08 | 46.23 | 46.39 |
| — | 1.49 | 1.49 | 1.49 | 1.49 | 1.49 | 1.49 | 1.49 | 1.49 | 1.49 | 1.49 | 1.49 | 1.49 |
| #26 | 46.55 | 46.70 | 46.86 | 47.01 | 47.17 | 47.32 | 47.48 | 47.63 | 47.79 | 47.95 | 48.10 | 48.26 |
| — | 1.48 | 1.48 | 1.48 | 1.47 | 1.47 | 1.47 | 1.46 | 1.46 | 1.45 | 1.45 | 1.45 | 1.44 |
| #27 | 48.41 | 48.57 | 48.72 | 48.88 | 49.04 | 49.19 | 49.35 | 49.50 | 49.66 | 49.81 | 49.97 | 50.13 |
| — | 1.44 | 1.44 | 1.43 | 1.43 | 1.43 | 1.43 | 1.43 | 1.43 | 1.43 | 1.43 | 1.44 | 1.44 |
| #28 | 50.28 | 50.44 | 50.59 | 50.75 | 50.90 | 51.06 | 51.22 | 51.37 | 51.53 | 51.68 | 51.84 | 51.99 |
| — | 1.45 | 1.45 | 1.46 | 1.47 | 1.48 | 1.49 | 1.50 | 1.51 | 1.52 | 1.54 | 1.58 | 1.57 |
| #29 | 52.15 | 52.30 | 52.46 | 52.61 | 52.77 | 52.92 | 53.08 | 53.23 | 53.39 | 53.54 | 53.70 | 53.85 |
| — | 1.59 | 1.61 | 1.63 | 1.65 | 1.67 | 1.69 | 1.71 | 1.74 | 1.76 | 1.78 | 1.81 | 1.83 |
| #30 | 54.01 | 54.16 | 54.32 | 54.47 | 54.62 | 54.78 | 54.93 | 55.09 | 55.24 | 55.40 | 55.55 | 55.70 |
| — | 1.86 | 1.88 | 1.91 | 1.93 | 1.95 | 1.98 | 2.00 | 2.02 | 2.04 | 2.06 | 2.08 | 2.10 |

TABLE 10

| Center conductor widths (2/3) | | | | | | | | | | | | |
|---|---|---|---|---|---|---|---|---|---|---|---|---|
| #31 | 55.86 | 56.01 | 56.16 | 56.32 | 56.47 | 56.63 | 56.78 | 56.93 | 57.09 | 57.24 | 57.40 | 57.55 |
| — | 2.11 | 2.13 | 2.14 | 2.15 | 2.16 | 2.17 | 2.18 | 2.18 | 2.18 | 2.19 | 2.19 | 2.19 |
| #32 | 57.70 | 57.86 | 58.01 | 58.16 | 58.32 | 58.47 | 58.63 | 58.78 | 58.93 | 59.09 | 59.24 | 59.40 |
| — | 2.18 | 2.18 | 2.17 | 2.17 | 2.16 | 2.15 | 2.14 | 2.14 | 2.13 | 2.11 | 2.10 | 2.09 |
| #33 | 59.55 | 59.70 | 59.86 | 60.01 | 60.17 | 60.32 | 60.47 | 60.63 | 60.78 | 60.94 | 61.09 | 61.24 |
| — | 2.08 | 2.07 | 2.06 | 2.05 | 2.04 | 2.04 | 2.03 | 2.02 | 2.02 | 2.01 | 2.01 | 2.00 |
| #34 | 61.40 | 61.55 | 61.71 | 61.86 | 62.02 | 62.17 | 62.32 | 62.48 | 62.63 | 62.79 | 62.94 | 63.09 |
| — | 2.00 | 2.00 | 2.00 | 2.01 | 2.01 | 2.01 | 2.02 | 2.03 | 2.04 | 2.05 | 2.06 | 2.07 |
| #35 | 63.25 | 63.40 | 63.56 | 63.71 | 63.86 | 64.02 | 64.17 | 64.33 | 64.48 | 64.63 | 64.79 | 64.94 |
| — | 2.08 | 2.09 | 2.10 | 2.12 | 2.13 | 2.14 | 2.15 | 2.17 | 2.18 | 2.19 | 2.20 | 2.20 |
| #36 | 65.09 | 65.25 | 65.40 | 65.56 | 65.71 | 65.86 | 66.02 | 66.17 | 66.32 | 66.48 | 66.63 | 66.79 |
| — | 2.21 | 2.21 | 2.21 | 2.21 | 2.21 | 2.20 | 2.19 | 2.18 | 2.16 | 2.14 | 2.11 | 2.09 |
| #37 | 66.94 | 67.00 | 67.25 | 67.40 | 67.56 | 67.71 | 67.87 | 68.02 | 68.18 | 68.93 | 68.49 | 68.64 |
| — | 2.06 | 2.02 | 1.98 | 1.94 | 1.90 | 1.85 | 1.80 | 1.75 | 1.69 | 1.64 | 1.58 | 1.52 |

TABLE 10-continued

| Center conductor widths (2/3) | | | | | | | | | | | | |
|---|---|---|---|---|---|---|---|---|---|---|---|---|
| #38 | 68.80 | 68.95 | 69.11 | 69.27 | 69.42 | 69.58 | 69.74 | 69.89 | 70.05 | 70.21 | 70.37 | 70.52 |
| — | 1.46 | 1.40 | 1.33 | 1.27 | 1.21 | 1.15 | 1.09 | 1.03 | 0.97 | 0.92 | 0.86 | 0.81 |
| #39 | 70.68 | 70.84 | 71.00 | 71.16 | 71.32 | 71.48 | 71.63 | 71.79 | 71.95 | 72.11 | 72.27 | 72.43 |
| — | 0.76 | 0.72 | 0.67 | 0.63 | 0.59 | 0.56 | 0.53 | 0.50 | 0.47 | 0.44 | 0.42 | 0.40 |
| #40 | 72.59 | 72.75 | 72.91 | 73.07 | 73.23 | 73.39 | 73.55 | 73.71 | 73.87 | 74.03 | 74.19 | 74.35 |
| — | 0.39 | 0.37 | 0.36 | 0.35 | 0.34 | 0.34 | 0.33 | 0.33 | 0.34 | 0.34 | 0.35 | 0.36 |
| #41 | 74.51 | 74.67 | 74.83 | 74.90 | 75.15 | 75.31 | 75.47 | 75.63 | 75.79 | 75.95 | 76.11 | 76.27 |
| — | 0.37 | 0.39 | 0.41 | 0.43 | 0.46 | 0.49 | 0.52 | 0.56 | 0.61 | 0.66 | 0.71 | 0.77 |
| #42 | 76.42 | 76.58 | 76.74 | 76.89 | 77.05 | 77.21 | 77.36 | 77.52 | 77.67 | 77.83 | 77.98 | 78.14 |
| — | 0.84 | 0.92 | 1.00 | 1.09 | 1.19 | 1.30 | 1.42 | 1.54 | 1.67 | 1.81 | 1.96 | 2.12 |
| #43 | 78.29 | 78.44 | 78.60 | 78.75 | 78.90 | 79.05 | 79.20 | 79.36 | 79.51 | 79.66 | 79.81 | 79.96 |
| — | 2.29 | 2.46 | 2.65 | 2.84 | 3.04 | 3.24 | 3.45 | 3.66 | 3.88 | 4.10 | 4.32 | 4.54 |
| #44 | 80.11 | 80.26 | 80.41 | 80.56 | 80.71 | 80.85 | 81.00 | 81.15 | 81.30 | 81.45 | 81.80 | 81.75 |
| — | 4.76 | 4.97 | 5.17 | 5.37 | 5.55 | 5.72 | 5.88 | 6.02 | 6.14 | 6.25 | 6.32 | 6.38 |
| #45 | 81.90 | 82.04 | 82.19 | 82.34 | 82.49 | 82.64 | 82.79 | 82.94 | 83.09 | 88.24 | 83.39 | 83.53 |
| — | 6.41 | 6.42 | 6.40 | 6.36 | 6.30 | 6.21 | 6.10 | 5.97 | 5.81 | 5.65 | 5.46 | 5.20 |
| #46 | 83.68 | 83.83 | 83.98 | 84.13 | 84.29 | 84.44 | 84.59 | 84.74 | 84.89 | 85.04 | 85.20 | 85.35 |
| — | 5.06 | 4.84 | 4.61 | 4.39 | 4.15 | 3.92 | 3.69 | 3.46 | 3.24 | 3.02 | 2.80 | 2.59 |
| #47 | 85.50 | 85.66 | 85.81 | 85.96 | 86.12 | 86.27 | 86.43 | 86.59 | 86.74 | 86.90 | 87.06 | 87.22 |
| — | 2.40 | 2.20 | 2.02 | 1.85 | 1.69 | 1.53 | 1.39 | 1.25 | 1.13 | 1.01 | 0.91 | 0.81 |
| #48 | 87.37 | 87.53 | 87.69 | 87.85 | 88.01 | 88.17 | 88.33 | 88.49 | 88.65 | 88.81 | 88.97 | 89.13 |
| — | 0.72 | 0.64 | 0.57 | 0.51 | 0.45 | 0.40 | 0.35 | 0.32 | 0.28 | 0.25 | 0.23 | 0.21 |
| #49 | 89.30 | 89.45 | 89.62 | 89.78 | 89.94 | 90.10 | 90.26 | 90.43 | 90.59 | 90.75 | 90.91 | 91.07 |
| — | 0.19 | 0.18 | 0.16 | 0.15 | 0.15 | 0.14 | 0.14 | 0.14 | 0.14 | 0.14 | 0.14 | 0.15 |
| #50 | 91.23 | 91.40 | 91.56 | 91.72 | 91.88 | 92.04 | 92.20 | 92.36 | 92.52 | 92.68 | 92.84 | 93.00 |
| — | 0.15 | 0.16 | 0.17 | 0.19 | 0.20 | 0.22 | 0.24 | 0.27 | 0.30 | 0.34 | 0.38 | 0.42 |
| #51 | 09.16 | 93.32 | 93.48 | 93.64 | 93.80 | 93.96 | 94.11 | 94.27 | 94.43 | 94.58 | 94.74 | 94.89 |
| — | 0.47 | 0.53 | 0.59 | 0.66 | 0.74 | 0.82 | 0.91 | 1.01 | 1.12 | 1.23 | 1.35 | 1.48 |
| #52 | 95.05 | 95.20 | 95.33 | 95.51 | 95.67 | 95.82 | 95.97 | 96.13 | 96.28 | 96.43 | 96.68 | 90.73 |
| — | 1.61 | 1.75 | 1.89 | 2.04 | 2.20 | 2.35 | 2.51 | 2.68 | 2.84 | 3.01 | 3.17 | 3.33 |
| #53 | 96.89 | 97.04 | 97.19 | 97.34 | 97.49 | 97.64 | 97.79 | 97.94 | 98.09 | 98.24 | 98.39 | 98.54 |
| — | 3.49 | 3.64 | 3.79 | 3.93 | 4.07 | 4.19 | 4.30 | 4.40 | 4.49 | 4.57 | 4.63 | 4.67 |
| #54 | 98.69 | 98.84 | 98.99 | 99.14 | 99.29 | 99.44 | 99.59 | 99.74 | 99.89 | 100.04 | 100.19 | 100.34 |
| — | 4.79 | 4.72 | 4.72 | 4.71 | 4.68 | 4.64 | 4.59 | 4.52 | 4.44 | 4.36 | 4.26 | 4.16 |
| #55 | 100.49 | 100.65 | 100.80 | 100.95 | 101.10 | 101.25 | 101.40 | 101.55 | 101.71 | 101.86 | 102.01 | 102.16 |
| — | 4.05 | 3.93 | 3.82 | 3.69 | 3.57 | 3.44 | 3.31 | 3.19 | 3.06 | 2.94 | 2.82 | 2.70 |
| #56 | 102.32 | 102.47 | 102.62 | 102.78 | 102.93 | 103.08 | 103.24 | 103.39 | 103.55 | 103.70 | 103.86 | 104.01 |
| — | 2.59 | 2.48 | 2.37 | 2.27 | 2.17 | 2.08 | 1.99 | 1.91 | 1.83 | 1.76 | 1.69 | 1.63 |
| #57 | 104.17 | 104.32 | 104.48 | 104.63 | 104.79 | 104.95 | 105.10 | 105.26 | 105.42 | 105.57 | 105.73 | 105.85 |
| — | 1.57 | 1.52 | 1.47 | 1.42 | 1.38 | 1.34 | 1.31 | 1.28 | 1.26 | 1.23 | 1.21 | 1.20 |
| #58 | 106.04 | 106.20 | 106.35 | 106.51 | 106.67 | 106.82 | 106.98 | 107.14 | 107.29 | 107.45 | 107.61 | 107.76 |
| — | 1.18 | 1.17 | 1.17 | 1.16 | 1.16 | 1.16 | 1.16 | 1.16 | 1.16 | 1.17 | 1.17 | 1.18 |
| #59 | 107.92 | 108.08 | 108.23 | 108.39 | 108.55 | 108.70 | 108.86 | 109.01 | 109.17 | 109.33 | 109.48 | 109.64 |
| — | 1.19 | 1.20 | 1.21 | 1.22 | 1.23 | 1.24 | 1.26 | 1.26 | 1.27 | 1.28 | 1.29 | 1.30 |
| #60 | 109.80 | 109.95 | 110.11 | 110.26 | 110.42 | 110.58 | 110.73 | 110.89 | 111.04 | 111.20 | 111.36 | 111.51 |
| — | 1.30 | 1.31 | 1.31 | 1.32 | 1.32 | 1.32 | 1.32 | 1.31 | 1.31 | 1.30 | 1.30 | 1.29 |

TABLE 11

| Center conductor widths (3/3) | | | | | | | | | | | | |
|---|---|---|---|---|---|---|---|---|---|---|---|---|
| #61 | 111.67 | 111.83 | 111.98 | 112.14 | 112.29 | 112.45 | 112.61 | 112.76 | 112.92 | 113.08 | 113.23 | 113.39 |
| — | 1.28 | 1.27 | 1.25 | 1.24 | 1.23 | 1.21 | 1.20 | 1.19 | 1.17 | 1.16 | 1.14 | 1.13 |
| #62 | 113.55 | 113.70 | 113.86 | 114.02 | 114.18 | 114.33 | 114.49 | 114.65 | 114.80 | 114.96 | 115.12 | 115.27 |
| — | 1.11 | 1.10 | 1.08 | 1.07 | 1.06 | 1.05 | 1.04 | 1.03 | 1.03 | 1.02 | 1.02 | 1.02 |
| #63 | 115.43 | 115.59 | 115.75 | 115.90 | 116.06 | 116.22 | 116.37 | 116.53 | 116.69 | 116.85 | 117.00 | 117.16 |
| — | 1.02 | 1.02 | 1.02 | 1.02 | 1.03 | 1.04 | 1.05 | 1.06 | 1.08 | 1.09 | 1.11 | 1.13 |
| #64 | 117.32 | 117.47 | 117.63 | 117.78 | 117.94 | 118.10 | 118.25 | 118.41 | 118.56 | 118.72 | 118.88 | 119.03 |
| — | 1.16 | 1.18 | 1.21 | 1.24 | 1.27 | 1.30 | 1.34 | 1.38 | 1.42 | 1.46 | 1.50 | 1.54 |
| #65 | 119.19 | 119.34 | 119.50 | 119.65 | 119.81 | 119.96 | 120.12 | 120.27 | 120.42 | 120.58 | 120.73 | 120.89 |
| — | 1.59 | 1.63 | 1.68 | 1.73 | 1.78 | 1.83 | 1.87 | 1.92 | 1.97 | 2.02 | 2.07 | 2.11 |
| #66 | 121.04 | 121.19 | 121.35 | 121.50 | 121.65 | 121.81 | 121.96 | 122.11 | 122.27 | 122.42 | 122.57 | 122.73 |
| — | 2.16 | 2.20 | 2.24 | 2.28 | 2.32 | 2.35 | 2.38 | 2.41 | 2.43 | 2.46 | 2.47 | 2.49 |
| #67 | 122.88 | 123.03 | 123.19 | 123.34 | 123.49 | 123.65 | 123.80 | 123.95 | 124.11 | 124.26 | 124.41 | 124.57 |
| — | 2.50 | 2.51 | 2.51 | 2.52 | 2.51 | 2.51 | 2.50 | 2.49 | 2.47 | 2.46 | 2.44 | 2.42 |
| #68 | 124.72 | 124.87 | 125.03 | 125.18 | 125.33 | 125.49 | 125.64 | 125.79 | 125.96 | 126.10 | 126.25 | 126.41 |
| — | 2.40 | 2.37 | 2.34 | 2.32 | 2.29 | 2.26 | 2.23 | 2.20 | 2.17 | 2.14 | 2.11 | 2.08 |
| #69 | 126.56 | 126.72 | 126.87 | 127.03 | 127.18 | 127.33 | 127.49 | 127.64 | 127.80 | 127.95 | 128.11 | 128.26 |
| — | 2.05 | 2.02 | 1.99 | 1.96 | 1.94 | 1.91 | 1.89 | 1.87 | 1.85 | 1.83 | 1.81 | 1.79 |
| #70 | 128.42 | 128.57 | 128.73 | 128.88 | 129.04 | 129.19 | 129.35 | 129.50 | 129.66 | 129.81 | 129.97 | 130.12 |
| — | 1.78 | 1.76 | 1.75 | 1.74 | 1.73 | 1.72 | 1.72 | 1.71 | 1.71 | 1.70 | 1.70 | 1.70 |
| #71 | 130.28 | 130.43 | 130.59 | 130.74 | 130.90 | 131.05 | 131.21 | 131.36 | 131.52 | 131.67 | 131.83 | 131.98 |
| — | 1.70 | 1.70 | 1.70 | 1.70 | 1.70 | 1.71 | 1.71 | 1.71 | 1.71 | 1.72 | 1.72 | 1.72 |

TABLE 11-continued

| Center conductor widths (3/3) | | | | | | | | | | | | |
|---|---|---|---|---|---|---|---|---|---|---|---|---|
| #72 | 132.13 | 132.29 | 132.44 | 132.60 | 132.75 | 132.91 | 133.06 | 133.22 | 133.37 | 133.53 | 133.68 | 133.84 |
| — | 1.72 | 1.72 | 1.72 | 1.72 | 1.72 | 1.72 | 1.71 | 1.71 | 1.70 | 1.70 | 1.69 | 1.68 |
| #73 | 133.99 | 134.15 | 134.30 | 134.46 | 134.61 | 134.77 | 134.93 | 135.08 | 135.24 | 135.39 | 135.55 | 135.70 |
| — | 1.67 | 1.66 | 1.65 | 1.64 | 1.62 | 1.61 | 1.59 | 1.57 | 1.56 | 1.54 | 1.52 | 1.50 |
| #74 | 135.86 | 136.01 | 136.17 | 136.33 | 136.48 | 136.64 | 136.79 | 136.95 | 137.10 | 137.26 | 137.42 | 137.57 |
| — | 1.48 | 1.46 | 1.44 | 1.42 | 1.40 | 1.38 | 1.36 | 1.34 | 1.32 | 1.31 | 1.20 | 1.27 |
| #75 | 137.73 | 137.89 | 138.04 | 138.20 | 138.36 | 138.51 | 138.67 | 138.82 | 138.98 | 139.14 | 139.29 | 139.45 |
| — | 1.26 | 1.24 | 1.23 | 1.22 | 1.21 | 1.19 | 1.19 | 1.18 | 1.17 | 1.17 | 1.16 | 1.16 |
| #76 | 139.61 | 139.76 | 139.92 | 140.08 | 140.23 | 140.39 | 140.55 | 140.70 | 140.86 | 141.02 | 141.17 | 141.83 |
| — | 1.16 | 1.16 | 1.16 | 1.17 | 1.17 | 1.18 | 1.18 | 1.19 | 1.20 | 1.21 | 1.23 | 1.24 |
| #77 | 141.49 | 141.64 | 141.80 | 141.95 | 142.11 | 142.27 | 142.42 | 142.58 | 142.73 | 142.89 | 143.05 | 143.20 |
| — | 1.26 | 1.27 | 1.29 | 1.31 | 1.33 | 1.35 | 1.37 | 1.40 | 1.42 | 1.44 | 1.47 | 1.49 |
| #78 | 143.36 | 143.51 | 143.67 | 143.82 | 143.98 | 144.13 | 144.29 | 144.44 | 144.60 | 144.75 | 144.91 | 145.06 |
| — | 1.52 | 1.54 | 1.57 | 1.59 | 1.61 | 1.64 | 1.66 | 1.69 | 1.71 | 1.73 | 1.75 | 1.77 |
| #79 | 145.22 | 145.37 | 145.53 | 145.68 | 145.84 | 145.99 | 146.14 | 146.30 | 146.45 | 146.61 | 146.76 | 146.92 |
| — | 1.79 | 1.81 | 1.83 | 1.84 | 1.85 | 1.87 | 1.88 | 1.80 | 1.90 | 1.91 | 1.91 | 1.92 |
| #80 | 147.07 | 147.23 | 147.38 | 147.53 | 147.69 | 147.84 | 148.00 | 148.15 | 148.31 | 148.46 | 148.62 | 148.77 |
| — | 1.92 | 1.92 | 1.92 | 1.92 | 1.92 | 1.92 | 1.92 | 1.91 | 1.91 | 1.90 | 1.90 | 1.89 |
| #81 | 148.92 | 149.08 | 149.23 | 149.39 | 149.54 | 149.70 | 149.85 | 150.01 | 150.16 | 150.32 | 150.47 | 150.62 |
| — | 1.88 | 1.88 | 1.87 | 1.86 | 1.86 | 1.85 | 1.85 | 1.84 | 1.84 | 1.83 | 1.83 | 1.82 |
| #82 | 150.78 | 150.93 | 151.09 | 151.24 | 151.40 | 151.55 | 151.71 | 151.86 | 152.02 | 152.17 | 152.33 | 152.48 |
| — | 1.82 | 1.82 | 1.81 | 1.81 | 1.81 | 1.81 | 1.81 | 1.82 | 1.82 | 1.82 | 1.83 | 1.83 |
| #83 | 152.63 | 152.79 | 152.94 | 153.10 | 153.25 | 153.41 | 153.56 | 153.72 | 153.87 | 154.03 | 154.18 | 154.33 |
| — | 1.84 | 1.84 | 1.85 | 1.85 | 1.86 | 1.87 | 1.88 | 1.88 | 1.89 | 1.90 | 1.91 | 1.91 |
| #84 | 154.49 | 154.64 | 154.80 | 154.95 | 155.11 | | | | | | | |
| — | 1.92 | 1.93 | 1.93 | 1.94 | 1.94 | | | | | | | |

Figure 24:
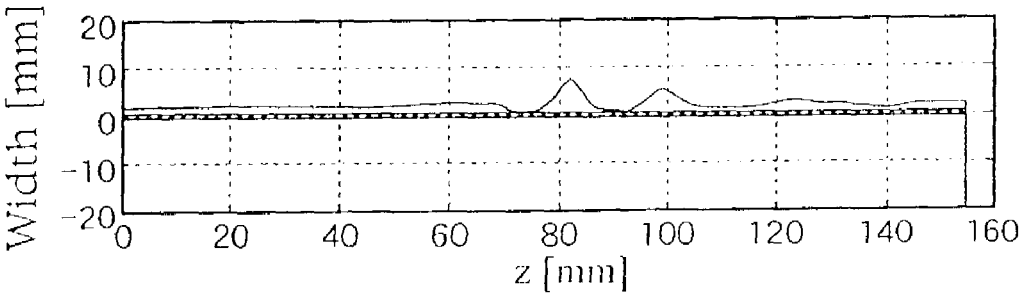
FIG. 24 is a graph showing a first shape for the micro-coplanar strip line in the reflection-type bandpass filter fabricated in Embodiment 4.
Figure 25:
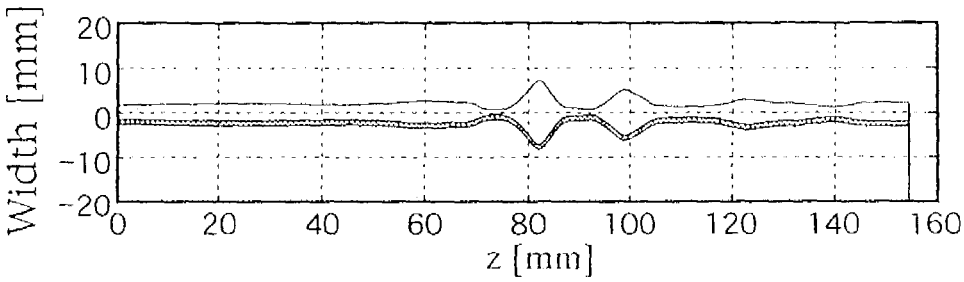
FIG. 25 is a graph showing a second shape for the micro-coplanar strip line in the reflection-type bandpass filter fabricated in Embodiment 4.

FIG. 24 and FIG. 25 show the shapes of two types of micro-coplanar strip lines in bandpass filters 1 fabricated in Embodiment 4. In FIG. 24, a micro-coplanar strip line is formed with the side edge 5*a* of the center conductor 5 and the side edge 7*a* of the side conductor 7 made straight lines, and with the side edge 5*b* of the center conductor 5 varied such that the center conductor width w takes on calculated values. In FIG. 25, a micro-coplanar strip line is formed with both side edges 5*a*, 5*b* of the center conductor 5 varied such that the center conductor width w takes on calculated values, and so as to change symmetrically with respect to the center line of the center conductor 5. In these figures, the lightly shaded portions represent the center conductor 5 and side conductor 7, and the darkly shaded lines represent the non-conducting portion 6. A non-reflecting terminator, or an R=75Ωresistance, is provided on the terminating side (the face at z=155.11 mm) of this reflection-type bandpass filter 1. The thicknesses of the metal films of the center conductor 5 and of the side conductor 7 are to be thick compared with the skin depth at f=1 GHz. For example, when using copper, the thickness of the center conductor 5 and of the side conductor 7 should be 2.1 μm or greater. The thickness of the ground layer 4 may be the same as or greater than the thicknesses of the center conductor 5 and side conductor 7. This bandpass filter 1 is used in a system with a characteristic impedance of 75Ω.

Figure 26:
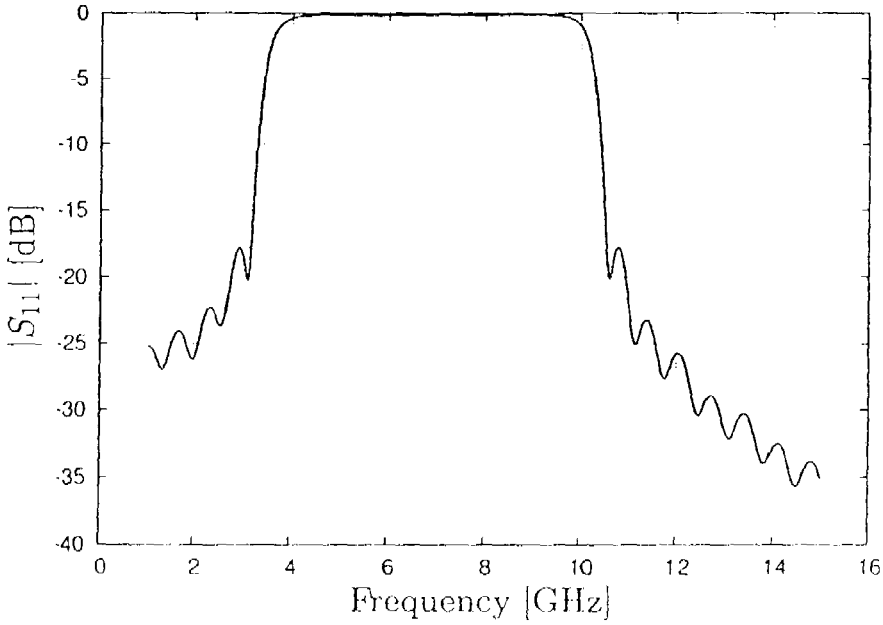
FIG. 26 is a graph showing the reflected wave amplitude characteristic in the reflection-type bandpass filter fabricated in Embodiment 4.
Figure 27:
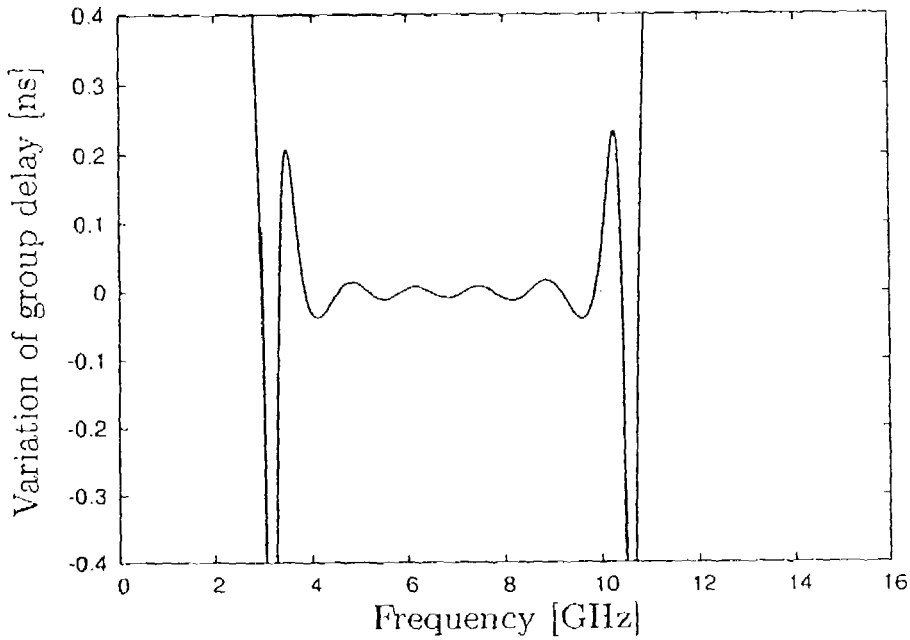
FIG. 27 is a graph showing the reflected wave group delay characteristic in the reflection-type bandpass filter fabricated in Embodiment 4.

FIG. 26 and FIG. 27 show the amplitude characteristic and group delay characteristic respectively of reflected waves ($S_{11}$) in bandpass filters of Embodiment 4. As shown in the figures, in the range of frequencies f for which 3.7 GHz≦f≦10.0 GHz, the reflectance is −2 dB or greater, and the group delay variation is within ±0.1 ns. In the region f<3.1 GHz or f>10.6 GHz, the reflectance is −15 dB or lower.

Embodiment 5

Figure 28:
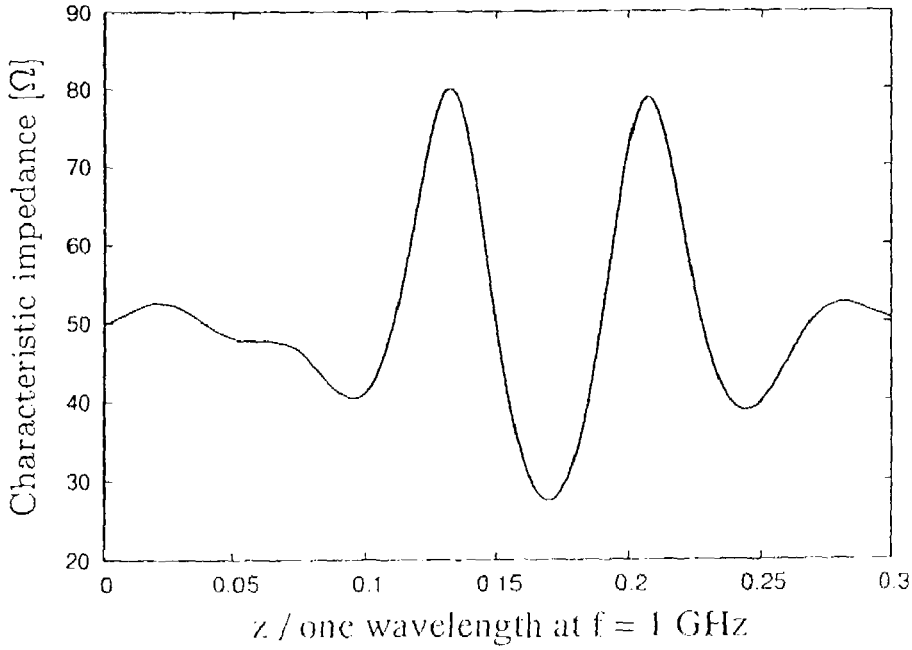
FIG. 28 is a graph showing the characteristic impedance distribution of the reflection-type bandpass filter fabricated in Embodiment 5.

A Kaiser window was used for which the reflectance is 0.9 at frequencies f in the range 4.0 GHz≦f≦9.6 GHz, and is 0 elsewhere, and for which A=30. Design was performed using 0.3 wavelength of signals at frequency f=1 GHz propagating in the micro-coplanar strip as the waveguide length, and setting the system characteristic impedance to 50Ω. FIG. 28 shows the distribution in the z-axis direction of the local characteristic impedance obtained in the inverse problem.

Figure 29:
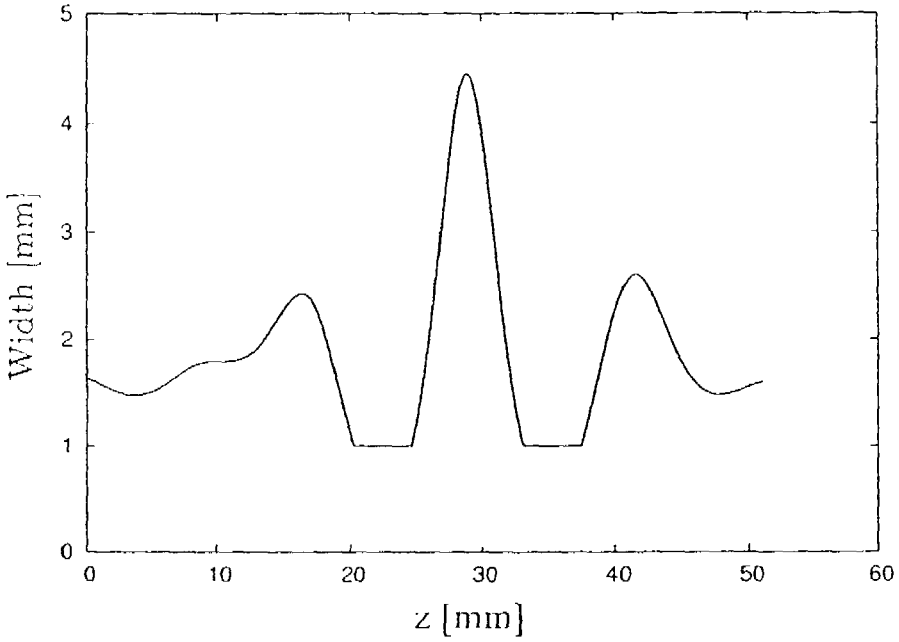
FIG. 29 is a graph showing the conductor width distribution of the micro-coplanar strip line in the reflection-type bandpass filter fabricated in Embodiment 5.
Figure 30:
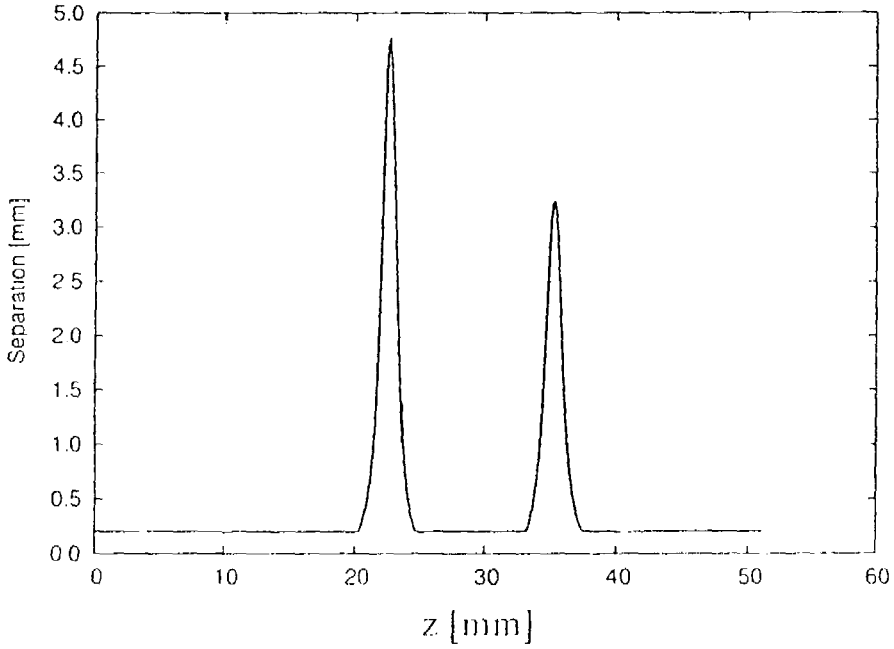
FIG. 30 is a graph showing the distribution of the distance between conductors of the micro-coplanar strip line in the reflection-type bandpass filter fabricated in Embodiment 5.

FIG. 29 and FIG. 30 show the distributions in the z-axis direction of the center conductor width w and distance between conductors s, when using a dielectric layer 3 with height h=1 mm and relative permittivity $\in_r$=4.2. In Embodiment 5, both w and s are made non-uniform. Tables 12 and 13 list the center conductor widths w, and Tables 14 and 15 list the distances between conductors s.

TABLE 12

| Center conductor widths (1/2) | | | | | | | | | | | | |
|---|---|---|---|---|---|---|---|---|---|---|---|---|
| | z[mm] | | | | | | | | | | | |
| | 0.00 | 0.10 | 0.21 | 0.31 | 0.41 | 0.52 | 0.62 | 0.72 | 0.83 | 0.93 | 1.03 | 1.14 |
| | w[mm] | | | | | | | | | | | |
| | 1.64 | 1.63 | 1.63 | 1.62 | 1.62 | 1.61 | 1.61 | 1.60 | 1.59 | 1.59 | 1.58 | 1.58 |
| #2 | 1.24 | 1.34 | 1.45 | 1.55 | 1.65 | 1.76 | 1.86 | 1.96 | 2.07 | 2.17 | 2.28 | 2.38 |
| — | 1.57 | 1.56 | 1.56 | 1.55 | 1.55 | 1.54 | 1.53 | 1.53 | 1.52 | 1.52 | 1.51 | 1.51 |

TABLE 12-continued

| Center conductor widths (1/2) | | | | | | | | | | | | |
|---|---|---|---|---|---|---|---|---|---|---|---|---|
| | z[mm] | | | | | | | | | | | |
| | 0.00 | 0.10 | 0.21 | 0.31 | 0.41 | 0.52 | 0.62 | 0.72 | 0.83 | 0.93 | 1.03 | 1.14 |
| | w[mm] | | | | | | | | | | | |
| | 1.64 | 1.63 | 1.63 | 1.62 | 1.62 | 1.61 | 1.61 | 1.60 | 1.59 | 1.59 | 1.58 | 1.58 |
| #3 | 2.48 | 2.59 | 2.69 | 2.79 | 2.90 | 3.00 | 3.10 | 3.21 | 3.31 | 3.42 | 3.52 | 3.02 |
| — | 1.50 | 1.50 | 1.50 | 1.49 | 1.49 | 1.49 | 1.48 | 1.48 | 1.48 | 1.48 | 1.48 | 1.48 |
| #4 | 3.73 | 3.83 | 3.93 | 4.04 | 4.14 | 4.25 | 4.35 | 4.45 | 4.56 | 4.66 | 4.76 | 4.87 |
| — | 1.48 | 1.48 | 1.48 | 1.48 | 1.48 | 1.48 | 1.49 | 1.49 | 1.49 | 1.50 | 1.50 | 1.51 |
| #5 | 4.97 | 5.07 | 5.18 | 5.28 | 5.39 | 5.49 | 5.59 | 5.70 | 5.80 | 5.90 | 6.01 | 6.11 |
| — | 1.51 | 1.52 | 1.52 | 1.53 | 1.54 | 1.54 | 1.55 | 1.56 | 1.57 | 1.57 | 1.58 | 1.59 |
| #6 | 6.21 | 6.32 | 6.42 | 6.52 | 6.63 | 6.73 | 6.83 | 6.94 | 7.04 | 7.14 | 7.24 | 7.35 |
| — | 1.60 | 1.61 | 1.62 | 1.63 | 1.64 | 1.64 | 1.65 | 1.66 | 1.67 | 1.68 | 1.69 | 1.70 |
| #7 | 7.45 | 7.55 | 7.66 | 7.76 | 7.86 | 7.97 | 8.07 | 8.17 | 8.27 | 8.38 | 8.45 | 8.58 |
| — | 1.70 | 1.71 | 1.72 | 1.73 | 1.73 | 1.74 | 1.75 | 1.75 | 1.76 | 1.76 | 1.77 | 1.77 |
| #8 | 8.69 | 8.79 | 8.89 | 8.99 | 9.10 | 9.20 | 9.30 | 9.41 | 9.51 | 9.61 | 9.71 | 9.82 |
| — | 1.78 | 1.78 | 1.78 | 1.78 | 1.79 | 1.79 | 1.79 | 1.79 | 1.79 | 1.79 | 1.79 | 1.79 |
| #9 | 9.92 | 10.02 | 10.12 | 10.23 | 10.33 | 10.43 | 10.54 | 10.64 | 10.74 | 10.84 | 10.95 | 11.06 |
| — | 1.79 | 1.79 | 1.79 | 1.79 | 1.79 | 1.79 | 1.79 | 1.79 | 1.80 | 1.80 | 1.80 | 1.80 |
| #10 | 11.15 | 11.25 | 11.36 | 11.46 | 11.56 | 11.67 | 11.77 | 11.87 | 11.97 | 12.08 | 12.18 | 12.28 |
| — | 1.80 | 1.80 | 1.80 | 1.81 | 1.81 | 1.81 | 1.82 | 1.82 | 1.83 | 1.84 | 1.84 | 1.85 |
| #11 | 12.38 | 12.49 | 12.59 | 12.69 | 12.79 | 12.90 | 13.00 | 13.10 | 13.20 | 13.31 | 13.41 | 13.51 |
| — | 1.86 | 1.87 | 1.88 | 1.89 | 1.90 | 1.91 | 1.93 | 1.94 | 1.96 | 1.97 | 1.99 | 2.01 |
| #12 | 13.61 | 13.71 | 13.82 | 13.92 | 14.02 | 14.12 | 14.22 | 14.33 | 14.43 | 14.53 | 14.63 | 14.73 |
| — | 2.02 | 2.04 | 2.06 | 2.08 | 2.10 | 2.12 | 2.14 | 2.16 | 2.18 | 2.20 | 2.22 | 2.24 |
| #13 | 14.83 | 14.93 | 15.04 | 15.14 | 15.24 | 15.34 | 15.44 | 15.54 | 15.64 | 15.74 | 15.85 | 15.95 |
| — | 2.26 | 2.28 | 2.30 | 2.32 | 2.34 | 2.35 | 2.37 | 2.38 | 2.39 | 2.41 | 2.41 | 2.42 |
| #14 | 16.05 | 16.15 | 16.25 | 16.35 | 16.45 | 16.55 | 16.65 | 16.76 | 16.86 | 16.96 | 17.06 | 17.16 |
| — | 2.43 | 2.43 | 2.43 | 2.43 | 2.43 | 2.42 | 2.42 | 2.40 | 2.39 | 2.38 | 2.36 | 2.34 |
| #15 | 17.26 | 17.36 | 17.47 | 17.57 | 17.67 | 17.77 | 17.87 | 17.97 | 18.08 | 18.18 | 18.28 | 18.38 |
| — | 2.31 | 2.29 | 2.26 | 2.23 | 2.19 | 2.16 | 2.12 | 2.08 | 2.03 | 1.99 | 1.94 | 1.90 |
| #16 | 18.49 | 18.59 | 18.69 | 18.79 | 18.90 | 19.00 | 19.10 | 19.21 | 19.31 | 19.42 | 19.52 | 19.62 |
| — | 1.85 | 1.80 | 1.75 | 1.70 | 1.65 | 1.59 | 1.54 | 1.49 | 1.44 | 1.38 | 1.33 | 1.28 |
| #17 | 19.73 | 19.83 | 19.94 | 20.04 | 20.15 | 20.25 | 20.36 | 20.47 | 20.57 | 20.67 | 20.78 | 20.88 |
| — | 1.23 | 1.18 | 1.14 | 1.09 | 1.04 | 1.00 | 1.00 | 1.00 | 1.00 | 1.00 | 1.00 | 1.00 |
| #18 | 20.99 | 21.09 | 21.19 | 21.30 | 21.40 | 21.50 | 21.60 | 21.70 | 21.80 | 21.90 | 22.00 | 22.10 |
| — | 1.00 | 1.00 | 1.00 | 1.00 | 1.00 | 1.00 | 1.00 | 1.00 | 1.00 | 1.00 | 1.00 | 1.00 |
| #19 | 22.20 | 22.30 | 22.40 | 22.50 | 22.60 | 22.70 | 22.80 | 22.90 | 22.99 | 23.09 | 23.19 | 23.29 |
| — | 1.00 | 1.00 | 1.00 | 1.00 | 1.00 | 1.00 | 1.00 | 1.00 | 1.00 | 1.00 | 1.00 | 1.00 |
| #20 | 23.40 | 23.50 | 23.60 | 23.70 | 23.80 | 23.91 | 24.01 | 24.11 | 24.22 | 24.32 | 24.43 | 24.53 |
| — | 1.00 | 1.00 | 1.00 | 1.00 | 1.00 | 1.00 | 1.00 | 1.00 | 1.00 | 1.00 | 1.00 | 1.00 |
| #21 | 24.64 | 24.74 | 24.85 | 24.95 | 25.06 | 25.16 | 25.27 | 25.37 | 25.47 | 25.58 | 25.68 | 25.78 |
| — | 1.00 | 1.04 | 1.09 | 1.16 | 1.22 | 1.29 | 1.37 | 1.44 | 1.53 | 1.61 | 1.70 | 1.79 |
| #22 | 25.89 | 25.99 | 26.09 | 26.19 | 26.29 | 26.39 | 26.50 | 26.60 | 26.70 | 26.80 | 26.90 | 27.00 |
| — | 1.89 | 1.98 | 2.09 | 2.19 | 2.30 | 2.41 | 2.52 | 2.63 | 2.74 | 2.85 | 2.97 | 3.08 |
| #23 | 27.10 | 27.20 | 27.29 | 27.39 | 27.49 | 27.59 | 27.69 | 27.79 | 27.89 | 27.98 | 28.08 | 28.18 |
| — | 3.19 | 3.31 | 3.41 | 3.52 | 3.63 | 3.73 | 3.82 | 3.91 | 4.00 | 4.08 | 4.15 | 4.22 |
| #24 | 28.28 | 28.38 | 28.47 | 28.57 | 28.67 | 28.77 | 28.86 | 28.96 | 29.06 | 29.16 | 29.26 | 29.35 |
| — | 4.28 | 4.33 | 4.37 | 4.40 | 4.43 | 4.45 | 4.45 | 4.45 | 4.44 | 4.42 | 4.39 | 4.35 |
| #25 | 29.45 | 29.55 | 29.65 | 29.75 | 29.84 | 29.94 | 30.04 | 30.14 | 30.24 | 30.34 | 30.44 | 30.54 |
| — | 4.30 | 4.25 | 4.19 | 4.12 | 4.04 | 3.96 | 3.87 | 3.78 | 3.68 | 3.58 | 3.47 | 3.36 |
| #26 | 30.63 | 30.73 | 30.83 | 30.93 | 31.03 | 31.13 | 31.24 | 31.34 | 31.44 | 31.54 | 31.64 | 31.74 |
| — | 3.25 | 3.14 | 3.03 | 2.92 | 2.80 | 2.69 | 2.58 | 2.47 | 2.36 | 2.25 | 2.15 | 2.05 |
| #27 | 31.85 | 31.95 | 32.05 | 32.15 | 32.26 | 32.36 | 32.47 | 32.57 | 32.67 | 32.78 | 32.88 | 32.99 |
| — | 1.95 | 1.85 | 1.76 | 1.67 | 1.59 | 1.50 | 1.42 | 1.35 | 1.28 | 1.21 | 1.15 | 1.09 |
| #28 | 33.09 | 33.20 | 33.30 | 33.41 | 33.51 | 33.62 | 33.72 | 33.83 | 33.93 | 34.03 | 34.13 | 34.24 |
| — | 1.03 | 1.00 | 1.00 | 1.00 | 1.00 | 1.00 | 1.00 | 1.00 | 1.00 | 1.00 | 1.00 | 1.00 |
| #29 | 34.34 | 34.44 | 34.54 | 34.64 | 34.74 | 34.84 | 34.94 | 35.04 | 35.14 | 35.24 | 35.34 | 35.44 |
| — | 1.00 | 1.00 | 1.00 | 1.00 | 1.00 | 1.00 | 1.00 | 1.00 | 1.00 | 1.00 | 1.00 | 1.00 |
| #30 | 35.54 | 35.64 | 35.74 | 35.84 | 35.94 | 36.04 | 36.14 | 36.25 | 36.35 | 36.45 | 36.56 | 36.66 |
| — | 1.00 | 1.00 | 1.00 | 1.00 | 1.00 | 1.00 | 1.00 | 1.00 | 1.00 | 1.00 | 1.00 | 1.00 |

TABLE 13

| Center conductor widths (2/2) | | | | | | | | | | | | |
|---|---|---|---|---|---|---|---|---|---|---|---|---|
| #31 | 36.76 | 36.87 | 36.97 | 37.08 | 37.18 | 37.29 | 37.39 | 37.50 | 37.60 | 37.71 | 37.81 | 37.92 |
| — | 1.00 | 1.00 | 1.00 | 1.00 | 1.00 | 1.00 | 1.00 | 1.02 | 1.06 | 1.11 | 1.16 | 1.21 |
| #32 | 38.02 | 38.13 | 38.23 | 38.33 | 38.44 | 38.54 | 38.65 | 38.75 | 38.85 | 38.95 | 39.06 | 39.16 |
| — | 1.26 | 1.31 | 1.36 | 1.41 | 1.47 | 1.52 | 1.58 | 1.64 | 1.69 | 1.75 | 1.80 | 1.86 |
| #33 | 39.26 | 39.36 | 39.47 | 39.57 | 39.67 | 39.77 | 39.87 | 39.98 | 40.08 | 40.18 | 40.28 | 40.38 |
| — | 1.91 | 1.97 | 2.02 | 2.07 | 2.12 | 2.17 | 2.21 | 2.26 | 2.30 | 2.34 | 2.38 | 2.41 |

TABLE 13-continued

| Center conductor widths (2/2) | | | | | | | | | | | | |
|---|---|---|---|---|---|---|---|---|---|---|---|---|
| #34 | 40.48 | 40.58 | 40.68 | 40.78 | 40.89 | 40.99 | 41.09 | 41.19 | 41.29 | 41.39 | 41.49 | 41.59 |
| — | 2.44 | 2.47 | 2.50 | 2.52 | 2.54 | 2.56 | 2.57 | 2.59 | 2.59 | 2.60 | 2.60 | 2.60 |
| #35 | 41.69 | 41.79 | 41.89 | 41.99 | 42.09 | 42.20 | 42.30 | 42.40 | 42.50 | 42.60 | 42.70 | 42.80 |
| — | 2.60 | 2.59 | 2.58 | 2.57 | 2.56 | 2.54 | 2.53 | 2.51 | 2.49 | 2.46 | 2.44 | 2.41 |
| #36 | 42.90 | 43.00 | 43.11 | 43.21 | 43.31 | 43.41 | 43.51 | 43.61 | 43.71 | 43.82 | 43.92 | 44.02 |
| — | 2.39 | 2.36 | 2.33 | 2.30 | 2.27 | 2.24 | 2.21 | 2.18 | 2.15 | 2.12 | 2.09 | 2.06 |
| #37 | 44.12 | 44.22 | 44.33 | 44.43 | 44.53 | 44.63 | 44.74 | 44.84 | 44.94 | 45.04 | 45.15 | 45.25 |
| — | 2.03 | 2.00 | 1.97 | 1.94 | 1.91 | 1.88 | 1.86 | 1.83 | 1.80 | 1.78 | 1.76 | 1.73 |
| #38 | 45.35 | 45.46 | 45.56 | 45.66 | 45.77 | 45.87 | 45.97 | 46.08 | 46.18 | 46.28 | 46.39 | 46.49 |
| — | 1.71 | 1.69 | 1.67 | 1.66 | 1.64 | 1.62 | 1.61 | 1.59 | 1.58 | 1.57 | 1.55 | 1.54 |
| #39 | 46.59 | 46.70 | 46.80 | 46.90 | 47.01 | 47.11 | 47.22 | 47.32 | 47.42 | 47.53 | 47.63 | 47.73 |
| — | 1.53 | 1.52 | 1.52 | 1.51 | 1.50 | 1.50 | 1.49 | 1.49 | 1.49 | 1.48 | 1.48 | 1.48 |
| #40 | 47.84 | 47.94 | 48.05 | 48.15 | 48.25 | 48.36 | 48.46 | 48.56 | 48.67 | 48.77 | 48.87 | 48.98 |
| — | 1.48 | 1.48 | 1.48 | 1.48 | 1.49 | 1.49 | 1.49 | 1.49 | 1.50 | 1.50 | 1.50 | 1.51 |
| #41 | 49.08 | 49.19 | 49.29 | 49.39 | 49.50 | 49.60 | 49.70 | 49.81 | 49.91 | 50.01 | 50.12 | 50.22 |
| — | 1.51 | 1.52 | 1.52 | 1.53 | 1.53 | 1.54 | 1.54 | 1.55 | 1.55 | 1.56 | 1.56 | 1.57 |
| #42 | 50.32 | 50.43 | 50.53 | 50.63 | 50.74 | 50.84 | 50.94 | 51.05 | 51.15 | | | |
| — | 1.57 | 1.58 | 1.58 | 1.58 | 1.59 | 1.59 | 1.60 | 1.60 | 1.61 | | | |

TABLE 14

| Distances between conductors (1/2) | | | | | | | | | | | | |
|---|---|---|---|---|---|---|---|---|---|---|---|---|
| | z[mm] | | | | | | | | | | | |
| | 0.00 | 0.10 | 0.21 | 0.31 | 0.41 | 0.52 | 0.62 | 0.72 | 0.83 | 0.93 | 1.03 | 1.14 |
| | w[mm] | | | | | | | | | | | |
| | 0.20 | 0.20 | 0.20 | 0.20 | 0.20 | 0.20 | 0.20 | 0.20 | 0.20 | 0.20 | 0.20 | 0.20 |
| #2 | 1.24 | 1.34 | 1.45 | 1.55 | 1.65 | 1.76 | 1.86 | 1.96 | 2.07 | 2.17 | 2.28 | 2.38 |
| — | 0.20 | 0.20 | 0.20 | 0.20 | 0.21 | 0.20 | 0.20 | 0.20 | 0.20 | 0.20 | 0.20 | 0.20 |
| #3 | 2.48 | 2.59 | 2.69 | 2.79 | 2.90 | 3.00 | 3.10 | 3.21 | 3.31 | 3.42 | 3.52 | 3.62 |
| — | 0.20 | 0.20 | 0.21 | 0.20 | 0.20 | 0.20 | 0.20 | 0.20 | 0.20 | 0.20 | 0.20 | 0.20 |
| #4 | 3.73 | 3.83 | 3.93 | 4.04 | 4.14 | 4.25 | 4.35 | 4.45 | 4.56 | 4.66 | 4.76 | 4.87 |
| — | 0.20 | 0.20 | 0.20 | 0.20 | 0.20 | 0.20 | 0.21 | 0.20 | 0.20 | 0.20 | 0.20 | 0.21 |
| #5 | 4.97 | 5.07 | 5.18 | 5.28 | 5.39 | 5.49 | 5.59 | 5.70 | 5.80 | 5.90 | 6.01 | 6.11 |
| — | 0.20 | 0.20 | 0.20 | 0.20 | 0.20 | 0.20 | 0.20 | 0.20 | 0.20 | 0.20 | 0.20 | 0.20 |
| #6 | 6.21 | 6.32 | 6.42 | 6.52 | 6.63 | 6.73 | 6.83 | 6.94 | 7.04 | 7.14 | 7.24 | 7.35 |
| — | 0.20 | 0.20 | 0.20 | 0.20 | 0.21 | 0.20 | 0.20 | 0.20 | 0.20 | 0.20 | 0.20 | 0.20 |
| #7 | 7.45 | 7.55 | 7.66 | 7.76 | 7.86 | 7.97 | 8.07 | 8.17 | 8.27 | 8.38 | 8.48 | 8.58 |
| — | 0.20 | 0.20 | 0.20 | 0.20 | 0.20 | 0.20 | 0.20 | 0.20 | 0.20 | 0.20 | 0.20 | 0.20 |
| #8 | 8.69 | 8.79 | 8.89 | 8.99 | 9.10 | 9.20 | 9.30 | 9.41 | 9.51 | 9.61 | 9.71 | 9.82 |
| — | 0.21 | 0.20 | 0.20 | 0.20 | 0.20 | 0.20 | 0.20 | 0.20 | 0.20 | 0.20 | 0.20 | 0.20 |
| #9 | 9.92 | 10.02 | 10.12 | 10.23 | 10.33 | 10.43 | 10.54 | 10.64 | 10.74 | 10.84 | 10.95 | 11.05 |
| — | 0.20 | 0.20 | 0.20 | 0.20 | 0.20 | 0.20 | 0.20 | 0.20 | 0.21 | 0.21 | 0.20 | 0.20 |
| #10 | 11.15 | 11.26 | 11.36 | 11.46 | 11.56 | 11.67 | 11.77 | 11.87 | 11.97 | 12.08 | 12.18 | 12.28 |
| — | 0.20 | 0.20 | 0.20 | 0.21 | 0.20 | 0.20 | 0.20 | 0.20 | 0.20 | 0.21 | 0.20 | 0.20 |
| #11 | 12.38 | 12.49 | 12.59 | 12.69 | 12.79 | 12.90 | 13.00 | 13.10 | 13.20 | 13.31 | 13.41 | 13.51 |
| — | 0.20 | 0.20 | 0.20 | 0.20 | 0.20 | 0.20 | 0.20 | 0.20 | 0.20 | 0.20 | 0.20 | 0.21 |
| #12 | 13.61 | 13.71 | 13.82 | 13.92 | 14.02 | 14.12 | 14.22 | 14.33 | 14.43 | 14.53 | 14.63 | 14.73 |
| — | 0.20 | 0.20 | 0.20 | 0.20 | 0.20 | 0.20 | 0.20 | 0.20 | 0.20 | 0.20 | 0.20 | 0.20 |
| #13 | 14.83 | 14.93 | 15.04 | 15.14 | 15.24 | 15.34 | 15.44 | 15.54 | 15.64 | 15.74 | 15.85 | 15.95 |
| — | 0.20 | 0.20 | 0.20 | 0.20 | 0.20 | 0.20 | 0.20 | 0.20 | 0.20 | 0.21 | 0.20 | 0.20 |
| #14 | 16.05 | 16.15 | 16.25 | 16.35 | 16.45 | 16.55 | 16.65 | 16.76 | 16.86 | 16.96 | 17.06 | 17.16 |
| — | 0.20 | 0.20 | 0.20 | 0.20 | 0.20 | 0.20 | 0.21 | 0.20 | 0.20 | 0.20 | 0.20 | 0.20 |
| #15 | 17.26 | 17.36 | 17.47 | 17.57 | 17.67 | 17.77 | 17.87 | 17.97 | 18.08 | 18.18 | 18.28 | 18.38 |
| — | 0.20 | 0.20 | 0.20 | 0.21 | 0.20 | 0.21 | 0.20 | 0.20 | 0.20 | 0.20 | 0.20 | 0.20 |
| #16 | 18.49 | 18.59 | 18.69 | 18.79 | 18.90 | 19.00 | 19.10 | 19.21 | 19.31 | 19.42 | 19.52 | 19.62 |
| — | 0.20 | 0.20 | 0.20 | 0.20 | 0.21 | 0.20 | 0.20 | 0.20 | 0.21 | 0.20 | 0.20 | 0.20 |
| #17 | 19.73 | 19.83 | 19.94 | 20.04 | 20.15 | 20.25 | 20.36 | 20.47 | 20.57 | 20.67 | 20.78 | 20.88 |
| — | 0.20 | 0.20 | 0.21 | 0.20 | 0.20 | 0.20 | 0.23 | 0.26 | 0.30 | 0.35 | 0.40 | 0.46 |
| #18 | 20.99 | 21.09 | 21.19 | 21.30 | 21.40 | 21.50 | 21.60 | 21.70 | 21.80 | 21.90 | 22.00 | 22.10 |
| — | 0.53 | 0.61 | 0.71 | 0.83 | 0.98 | 1.16 | 1.40 | 1.58 | 2.08 | 2.42 | 2.86 | 3.31 |
| #19 | 22.20 | 22.30 | 22.40 | 22.50 | 22.60 | 22.70 | 22.80 | 22.90 | 22.99 | 23.09 | 23.19 | 23.29 |
| — | 3.76 | 4.16 | 4.48 | 4.68 | 4.73 | 4.64 | 4.40 | 4.04 | 3.61 | 3.14 | 2.67 | 3.22 |
| #20 | 23.40 | 23.50 | 23.60 | 23.70 | 23.80 | 23.91 | 24.01 | 24.11 | 24.22 | 24.32 | 24.43 | 24.53 |
| — | 1.82 | 1.49 | 1.22 | 1.00 | 0.83 | 0.69 | 0.58 | 0.49 | 0.42 | 0.35 | 0.30 | 0.25 |
| #21 | 24.64 | 24.74 | 24.85 | 24.95 | 25.06 | 25.16 | 25.27 | 25.37 | 25.47 | 25.58 | 25.68 | 25.78 |
| — | 0.22 | 0.21 | 0.20 | 0.20 | 0.20 | 0.20 | 0.20 | 0.20 | 0.21 | 0.20 | 0.20 | 0.20 |
| #22 | 25.89 | 25.99 | 26.09 | 26.19 | 26.29 | 26.39 | 26.50 | 26.60 | 26.70 | 26.80 | 26.90 | 27.00 |
| — | 0.20 | 0.20 | 0.20 | 0.20 | 0.20 | 0.21 | 0.21 | 0.20 | 0.20 | 0.20 | 0.20 | 0.20 |
| #23 | 27.10 | 27.20 | 27.29 | 27.39 | 27.49 | 27.59 | 27.69 | 27.79 | 27.89 | 27.98 | 28.08 | 28.18 |
| — | 0.20 | 0.21 | 0.20 | 0.20 | 0.20 | 0.20 | 0.20 | 0.20 | 0.20 | 0.20 | 0.20 | 0.20 |

TABLE 14-continued

| Distances between conductors (1/2) | | | | | | | | | | | | |
|---|---|---|---|---|---|---|---|---|---|---|---|---|
| | z[mm] | | | | | | | | | | | |
| | 0.00 | 0.10 | 0.21 | 0.31 | 0.41 | 0.52 | 0.62 | 0.72 | 0.83 | 0.93 | 1.03 | 1.14 |
| | w[mm] | | | | | | | | | | | |
| | 0.20 | 0.20 | 0.20 | 0.20 | 0.20 | 0.20 | 0.20 | 0.20 | 0.20 | 0.20 | 0.20 | 0.20 |
| #24 | 28.28 | 28.38 | 28.47 | 28.57 | 28.67 | 28.77 | 28.86 | 28.96 | 29.06 | 29.16 | 29.26 | 29.35 |
| — | 0.20 | 0.20 | 0.20 | 0.20 | 0.20 | 0.20 | 0.20 | 0.20 | 0.20 | 0.20 | 0.20 | 0.20 |
| #25 | 29.45 | 29.55 | 29.65 | 29.75 | 29.84 | 29.94 | 30.04 | 30.14 | 30.24 | 30.34 | 30.44 | 30.54 |
| — | 0.20 | 0.20 | 0.20 | 0.20 | 0.20 | 0.20 | 0.20 | 0.20 | 0.20 | 0.20 | 0.20 | 0.20 |
| #26 | 30.63 | 30.73 | 30.83 | 30.93 | 31.03 | 31.13 | 31.24 | 31.34 | 31.44 | 31.54 | 31.64 | 31.74 |
| — | 0.20 | 0.20 | 0.20 | 0.20 | 0.20 | 0.20 | 0.20 | 0.20 | 0.20 | 0.20 | 0.20 | 0.20 |
| #27 | 31.85 | 31.95 | 32.05 | 32.15 | 32.26 | 32.36 | 32.47 | 32.57 | 32.67 | 32.78 | 32.88 | 32.99 |
| — | 0.20 | 0.20 | 0.20 | 0.20 | 0.21 | 0.20 | 0.20 | 0.20 | 0.20 | 0.20 | 0.21 | 0.21 |
| #28 | 33.09 | 33.20 | 33.30 | 33.41 | 33.51 | 33.62 | 33.72 | 33.83 | 33.93 | 34.03 | 34.13 | 34.24 |
| — | 0.20 | 0.22 | 0.26 | 0.30 | 0.35 | 0.41 | 0.48 | 0.56 | 0.66 | 0.78 | 0.92 | 1.09 |
| #29 | 34.34 | 34.44 | 34.54 | 34.64 | 34.74 | 34.84 | 34.94 | 35.04 | 35.14 | 35.24 | 35.34 | 35.44 |
| — | 1.30 | 1.54 | 1.82 | 2.12 | 2.42 | 2.71 | 2.95 | 3.13 | 3.23 | 3.24 | 3.15 | 2.99 |
| #30 | 35.54 | 35.64 | 35.74 | 35.84 | 35.94 | 36.04 | 36.14 | 36.25 | 36.35 | 36.45 | 36.56 | 36.66 |
| — | 2.76 | 2.49 | 2.20 | 1.91 | 1.64 | 1.40 | 1.19 | 1.01 | 0.87 | 0.75 | 0.65 | 0.56 |

TABLE 15

| Distances between conductors (2/2) | | | | | | | | | | | | |
|---|---|---|---|---|---|---|---|---|---|---|---|---|
| #31 | 36.76 | 36.87 | 36.97 | 37.08 | 37.18 | 37.29 | 37.39 | 37.50 | 37.60 | 37.71 | 37.81 | 37.92 |
| — | 0.49 | 0.43 | 0.37 | 0.33 | 0.29 | 0.25 | 0.22 | 0.20 | 0.20 | 0.20 | 0.21 | 0.21 |
| #32 | 38.02 | 38.13 | 38.23 | 38.33 | 38.44 | 38.54 | 38.65 | 38.75 | 38.85 | 38.95 | 39.06 | 39.16 |
| — | 0.21 | 0.20 | 0.20 | 0.20 | 0.20 | 0.20 | 0.20 | 0.21 | 0.20 | 0.20 | 0.20 | 0.20 |
| #33 | 39.26 | 39.36 | 39.47 | 39.57 | 39.67 | 39.77 | 39.87 | 39.98 | 40.08 | 40.18 | 40.28 | 40.38 |
| — | 0.20 | 0.20 | 0.20 | 0.20 | 0.20 | 0.20 | 0.20 | 0.20 | 0.20 | 0.20 | 0.20 | 0.20 |
| #34 | 40.48 | 40.58 | 40.68 | 40.78 | 40.89 | 40.99 | 41.09 | 41.19 | 41.29 | 41.39 | 41.49 | 41.59 |
| — | 0.20 | 0.20 | 0.20 | 0.20 | 0.20 | 0.20 | 0.20 | 0.20 | 0.20 | 0.20 | 0.20 | 0.20 |
| #35 | 41.69 | 41.79 | 41.89 | 41.99 | 42.09 | 42.20 | 42.30 | 42.40 | 42.50 | 42.60 | 42.70 | 42.80 |
| — | 0.20 | 0.20 | 0.20 | 0.20 | 0.20 | 0.20 | 0.20 | 0.20 | 0.20 | 0.20 | 0.20 | 0.20 |
| #36 | 42.90 | 43.00 | 43.11 | 43.21 | 43.31 | 43.41 | 43.51 | 43.61 | 43.71 | 43.82 | 43.92 | 44.02 |
| — | 0.20 | 0.20 | 0.20 | 0.20 | 0.20 | 0.20 | 0.20 | 0.20 | 0.20 | 0.20 | 0.20 | 0.21 |
| #37 | 44.12 | 44.22 | 44.33 | 44.43 | 44.53 | 44.63 | 44.74 | 44.84 | 44.94 | 45.04 | 45.15 | 45.25 |
| — | 0.21 | 0.21 | 0.20 | 0.20 | 0.20 | 0.20 | 0.21 | 0.20 | 0.20 | 0.20 | 0.20 | 0.20 |
| #38 | 45.35 | 45.45 | 45.56 | 45.66 | 45.77 | 45.87 | 45.97 | 46.08 | 46.18 | 46.28 | 46.39 | 46.49 |
| — | 0.20 | 0.20 | 0.20 | 0.21 | 0.20 | 0.20 | 0.21 | 0.20 | 0.20 | 0.21 | 0.20 | 0.20 |
| #39 | 46.59 | 46.70 | 46.80 | 46.90 | 47.01 | 47.11 | 47.23 | 47.32 | 47.42 | 47.53 | 47.63 | 47.73 |
| — | 0.20 | 0.20 | 0.20 | 0.20 | 0.20 | 0.20 | 0.20 | 0.20 | 0.20 | 0.20 | 0.20 | 0.20 |
| #40 | 47.84 | 47.94 | 48.05 | 48.15 | 48.25 | 48.36 | 48.46 | 48.56 | 48.67 | 48.77 | 48.87 | 48.98 |
| — | 0.20 | 0.20 | 0.20 | 0.20 | 0.21 | 0.20 | 0.20 | 0.20 | 0.21 | 0.20 | 0.20 | 0.20 |
| #41 | 49.08 | 49.19 | 49.29 | 49.39 | 49.50 | 49.60 | 49.70 | 49.81 | 49.91 | 50.01 | 50.12 | 50.22 |
| — | 0.20 | 0.21 | 0.20 | 0.21 | 0.20 | 0.21 | 0.20 | 0.21 | 0.20 | 0.21 | 0.20 | 0.21 |
| #42 | 50.32 | 50.43 | 50.53 | 50.63 | 50.74 | 50.84 | 50.94 | 51.05 | 51.15 | | | |
| — | 0.20 | 0.21 | 0.20 | 0.20 | 0.20 | 0.20 | 0.20 | 0.20 | 0.20 | | | |

Figure 31:
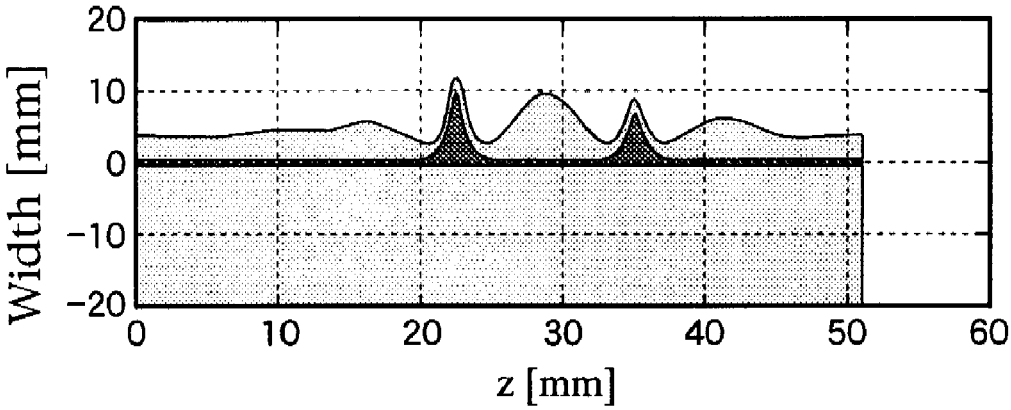
FIG. 31 is a graph showing a first shape for the micro-coplanar strip line in the reflection-type bandpass filter fabricated in Embodiment 5.
Figure 32:
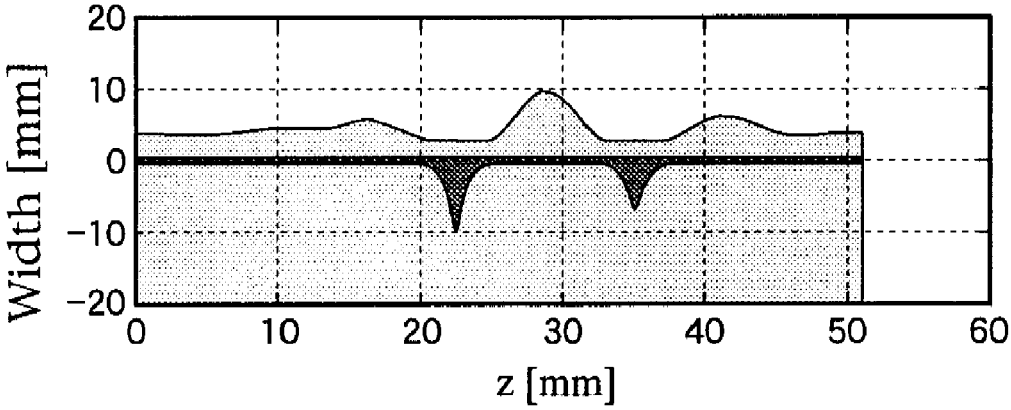
FIG. 32 is a graph showing a second shape for the micro-coplanar strip line in the reflection-type bandpass filter fabricated in Embodiment 5.
Figure 33:
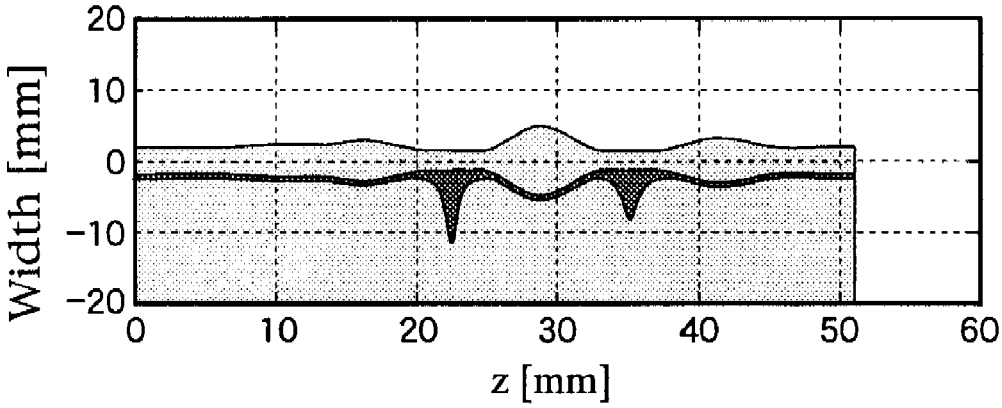
FIG. 33 is a graph showing a third shape for the micro-coplanar strip line in the reflection-type bandpass filter fabricated in Embodiment 5.
Figure 34:
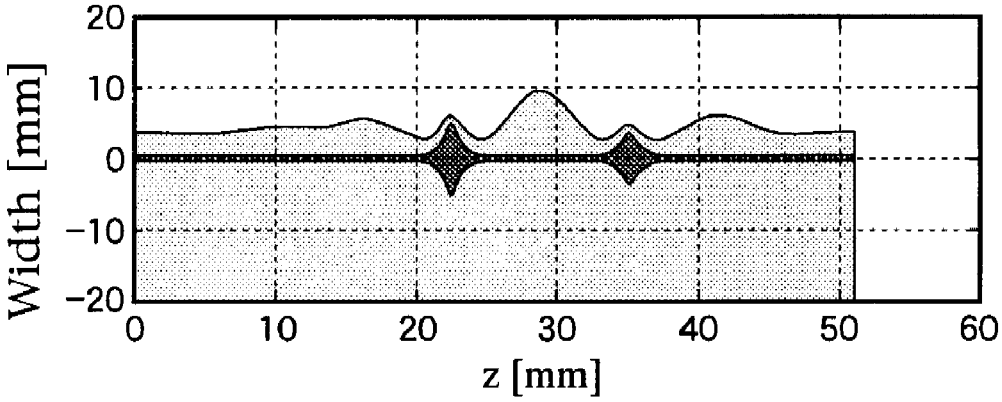
FIG. 34 is a graph showing a fourth shape for the micro-coplanar strip line in the reflection-type bandpass filter fabricated in Embodiment 5.

FIG. 31 to FIG. 34 show shapes of four types of micro-coplanar strip lines in bandpass filters 1 fabricated in Embodiment 5. In FIG. 31, a micro-coplanar strip line is formed with the side edge 7*a* of the side conductor 7 made a straight line, and with both side edges 5*a*, 5*b* of the center conductor 5 changed such that the center conductor width w and distance between conductors s take on calculated values. In FIG. 32, a micro-coplanar strip line is formed with the side edge 5*a* of the center conductor 5 made a straight line, and with the side edge 5*b* of the center conductor 5 and the side edge 7*a* of the side conductor 7 changed such that the center conductor width w and distance between conductors s take on calculated values. In FIG. 33, a micro-coplanar strip line is formed with both side edges 5*a*, 5*b* of the center conductor 5 varied such that the center conductor width w takes on calculated values, and so as to be symmetric with respect to the center line of the center conductor 5, and with the side edge 7*a* of the side conductor 7 varied such that the distance between conductors s takes on calculated values. In FIG. 34, a micro-coplanar strip line is formed with the side edge 5*a* of the center conductor 5 and the side edge 7*a* of the side conductor 7 varied such that the distance between conductors s takes on calculated values, and so as to be symmetrical with respect to the center line of the non-conducting portion 6, and with the side edge 5*b* of the center conductor 5 varied such that the center conductor width w takes on calculated values. In these figures, lightly shaded portions denote the center conductor 5 and side conductor 7, and darkly shaded portions denote the non-conducting portion 6. A non-reflecting terminator, or an R=50Ωresistance, is provided on the terminating side (the face at z=51.15 mm) of the reflection-type bandpass filter 1. The thicknesses of the metal films of the center conductor 5 and of the side conductor 7 may be thick compared with the skin depth at f=1 GHz. For example, when using copper, the thickness of the center conductor 5 and of the side conductor 7 may be 2.1 μm or greater. The thickness of the ground layer 4 may be the same as or greater than the thicknesses of the center conductor 5 and side conductor 7. This bandpass filter 1 is used in a system with a characteristic impedance of 50Ω.

Figure 35:
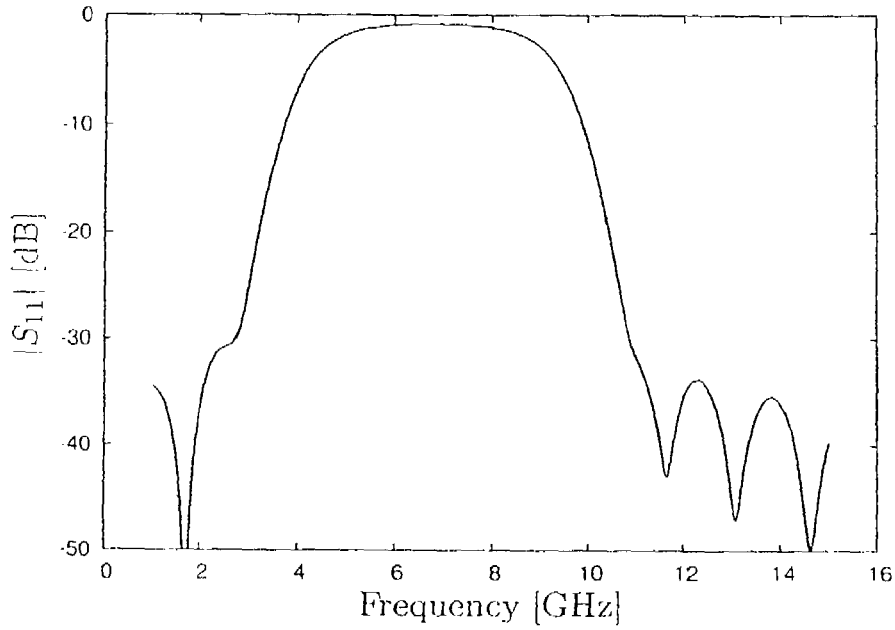
FIG. 35 is a graph showing the reflected wave amplitude characteristic in the reflection-type bandpass filter fabricated in Embodiment 5.
Figure 36:
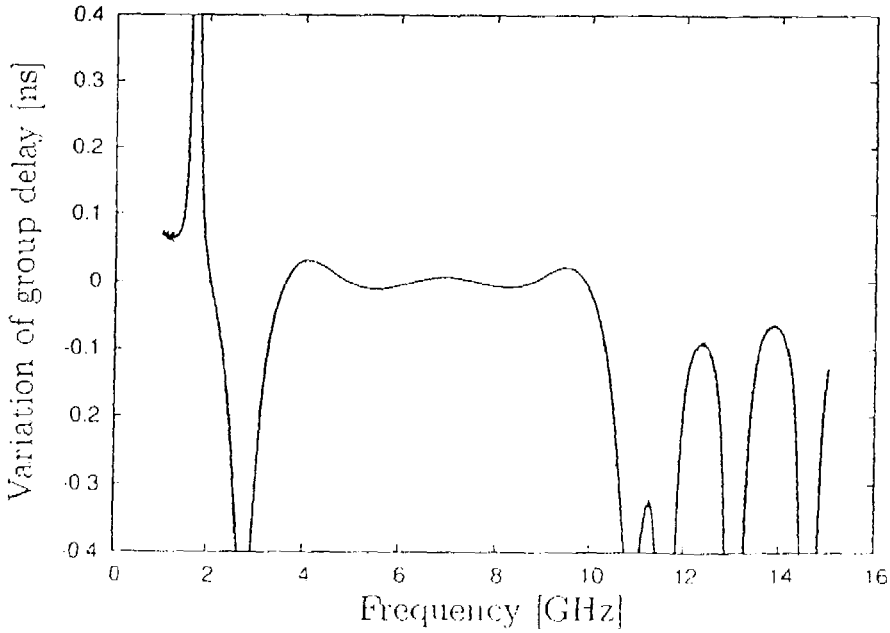
FIG. 36 is a graph showing the reflected wave group delay characteristic in the reflection-type bandpass filter fabricated in Embodiment 5; and, FIG. 37 is an equivalent circuit of a non-uniform transmission line.

FIG. 35 and FIG. 36 show the amplitude characteristic and group delay characteristic respectively of reflected waves ($S_{11}$) in bandpass filters of Embodiment 5. As shown in the figures, in the range of frequencies f for which 4.4 GHz≦f≦9.2 GHz, the reflectance is −5 dB or greater, and the group delay variation is within ±0.05 ns. In the region f<3.1 GHz or f>10.6 GHz, the reflectance is −15 dB or lower.

In the above, exemplary embodiments of the invention have been explained; but the invention is not limited to these embodiments. Various additions, omissions, substitutions, and other modifications to the configuration can be made, without deviating from the gist of the invention. The invention is not limited by the above explanation, but is limited only by the scope of the attached claims.

What is claimed is:

1. A reflection-type bandpass filter for ultra-wideband wireless data communication, the filter comprising a substrate comprising a dielectric layer and a ground layer formed on a surface of the dielectric layer, a center conductor provided on a surface of the dielectric layer opposite the ground layer, and a side conductor provided on the surface of the dielectric layer opposite the ground layer, wherein there is a prescribed distance between the center and side conductors, with a non-conducting portion intervening therebetween, wherein one or more of a center conductor width, and the distance between the center and side conductors, are distributed non-uniformly in a length direction of the center conductor; and wherein length-direction distributions of the center conductor width and of the distance between the center and side conductors satisfy a design method based on a inverse problem of deriving a potential from spectral data in a Zakharov-Shabat equation.

2. The reflection-type bandpass filter according to claim 1, wherein the distance between the center and side conductors is constant, and the center conductor width is distributed non-uniformly.

3. The reflection-type bandpass filter according to claim 1, wherein the center conductor width is constant, and the distance between the center and side conductors is distributed non-uniformly.

4. The reflection-type bandpass filter according to claim 1, wherein the center conductor width is distributed symmetrically about a center line of the center conductor.

5. The reflection-type bandpass filter according to claim 1, wherein a non-conducting portion width is distributed symmetrically about a center line of the non-conducting portion.

6. The reflection-type bandpass filter according to claim 1, wherein at least one of opposing side edges of the center conductor and the side conductor is a straight line.

7. The reflection-type bandpass filter according to claim 1, wherein a difference between a reflectance in a range of frequencies f for which f<3.1 GHz and f>10.6 GHz, and a reflectance in a range of frequencies for which 3.7 GHz≦f≦10.0 GHz, is 10 dB or greater, and wherein, in the range 3.7 GHz≦f≦10.0 GHz, a group delay variation is within ±0.05 ns.

8. The reflection-type bandpass filter according to claim 1, wherein a difference between a reflectance in a range of frequencies f for which f<3.1 GHz and f>10.6 GHz, and a reflectance in a range of frequencies for which 3.9 GHz≦f≦9.8 GHz, is 10 dB or greater, and wherein, in the range 3.9 GHz≦f≦9.8 GHz, a group delay variation is within ±0.07 ns.

9. The reflection-type bandpass filter according to claim 1, wherein a difference between a reflectance in a range of frequencies f for which f<3.1 GHz and f >10.6 GHz, and a reflectance in a range of frequencies for which 4.5 GHz≦f≦9.4 GHz, is 10 dB or greater, and wherein, in the range 4.5 GHz≦f≦9.4 GHz, a group delay variation is within ±0.07 ns.

10. The reflection-type bandpass filter according to claim 1, wherein a difference between a reflectance in a range of frequencies f for which f<3.1 GHz and f>10.6 GHz, and a reflectance in a range of frequencies for which 3.7 GHz≦f≦10.0 GHz, is 10 dB or greater, and wherein, in the range 3.7 GHz≦f≦10.0 GHz, a group delay variation is within ±0.1 ns.

11. The reflection-type bandpass filter according to claim 1, wherein a difference between a reflectance in a range of frequencies f for which f<3.1 GHz and f>10.6 GHz, and a reflectance in a range of frequencies for which 4.4 GHz≦f≦9.2 GHz, is 10 dB or greater, and wherein, in the range 4.4 GHz≦f≦9.2 GHz, a group delay variation is within ±0.05 ns.

12. The reflection-type bandpass filter according to claim 1, further comprising an input terminal of the bandpass filter, wherein a characteristic impedance Zc of the input terminal satisfies 10Ω≦Zc≦300Ω.

13. The reflection-type bandpass filter according to claim 12, further comprising one of a resistance having an impedance equal to the characteristic impedance Zc, and a non-reflecting terminator, provided on a terminating side of the bandpass filter.

14. The reflection-type bandpass filter according to claim 1, wherein the center conductor and the side conductor comprise metal plates of thickness equal to or greater than a skin depth of the metal plates at a frequency f=1 GHz.

15. The reflection-type bandpass filter according to claim 1, wherein the dielectric layer has a thickness h in a range 0.1 mm≦h≦10 mm, a relative permittivity $\in_r$ in a range $1 \leqq \in_r \leqq 100$, a width W in a range 2 mm≦W≦100 mm, and a length L in a range 2 mm≦L≦500 mm.

16. The reflection-type bandpass filter according to claim 1, wherein the length-direction distributions of the center conductor width and of the distance between the center and side conductors are determined using a window function method.

17. The reflection-type bandpass filter according to claim 1, wherein the length-direction distributions of the center conductor width and of the distance between the center and side conductors satisfy a Kaiser window function method.

* * * * *